US006892405B1

(12) United States Patent
Dimitriu et al.

(10) Patent No.: US 6,892,405 B1
(45) **Date of Patent: *May 17, 2005**

(54) THERAPEUTIC BED AND RELATED APPARATUS AND METHODS

(75) Inventors: Dan Dimitriu, San Antonio, TX (US); Alan L. Bartlett, New Braunfels, TX (US)

(73) Assignee: KCI Licensing, Inc., San Antonio, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/672,442

(22) Filed: Jun. 28, 1996

Related U.S. Application Data

(63) Continuation-in-part of application No. 08/448,081, filed on May 23, 1995, now abandoned, which is a continuation-in-part of application No. 08/241,075, filed on May 9, 1994, now Pat. No. 5,611,096.

(51) Int. Cl.[7] ..... A61G 7/06; A61G 7/057

(52) U.S. Cl. ..... 5/615; 5/609; 5/715; 5/713

(58) Field of Search ..... 5/601, 609, 615, 5/710, 713, 715, 722, 731, 733, 734, 914, 709

(56) References Cited

U.S. PATENT DOCUMENTS

| | | | | |
|---|---|---|---|---|
| 1,772,310 A | | 8/1930 | Hart | |
| 3,426,373 A | | 2/1969 | Scott et al. | 5/348 |
| 3,492,988 A | | 2/1970 | DeMare | 128/33 |
| 3,836,900 A | | 9/1974 | Mansfield | 340/279 |
| 3,935,604 A | * | 2/1976 | Collins | 5/715 X |
| 4,320,766 A | | 3/1982 | Alihanka et al. | 128/671 |
| 4,542,547 A | * | 9/1985 | Sato | 5/715 X |
| 4,697,290 A | | 10/1987 | Alklind et al. | 5/61 |
| 4,827,763 A | | 5/1989 | Bourland et al. | 73/172 |
| 4,873,737 A | | 10/1989 | Savenije | 5/453 |
| 4,941,221 A | * | 7/1990 | Kanzler | 5/903 X |
| 4,949,412 A | * | 8/1990 | Goode | 5/914 X |
| 4,977,629 A | | 12/1990 | Jones | 5/61 |
| 4,989,283 A | * | 2/1991 | Krouskop | 5/713 |
| 4,995,124 A | * | 2/1991 | Wridge, Jr. et al. | 5/713 X |
| 4,999,867 A | * | 3/1991 | Toivio et al. | 5/713 |
| 5,090,077 A | | 2/1992 | Caden et al. | 5/456 |
| 5,092,007 A | * | 3/1992 | Hasty | 5/715 |
| 5,394,577 A | * | 3/1995 | James et al. | 5/715 X |
| 5,452,486 A | * | 9/1995 | Czako | 5/715 X |
| 5,487,196 A | * | 1/1996 | Wilkinson et al. | 5/710 X |
| 5,560,057 A | * | 10/1996 | Madsen et al. | 5/713 X |
| 5,560,374 A | * | 10/1996 | Viard | 5/713 X |
| 5,611,096 A | * | 3/1997 | Bartlett et al. | 5/713 X |

FOREIGN PATENT DOCUMENTS

EP 0 218 301 A2 4/1987 ..... A47C/27/10

OTHER PUBLICATIONS

U.S. Appl. No. 09/271,580 filed Mar. 18, 1999.

* cited by examiner

*Primary Examiner*—Michael E. Trettel
(74) *Attorney, Agent, or Firm*—Eric W. Cernyar

(57) ABSTRACT

A therapeutic mattress system and bed are disclosed for providing a comprehensive system of pulmonary and skin care therapies for the critically ill, immobilized patient. The features provided include rotational therapy, percussion therapy and pulsation therapy on a critical care bed frame with a low air loss patient support, all of which are controlled with various types of feedback from particularized sensors in the bed.

27 Claims, 44 Drawing Sheets

129
130
133
134
131
132
85
84
83
118
122
6
108
107A
110
82
107C
109
119
123
86
87
88
89
111
112
114
120
124
127
90
91
92
93
94
95
96
97
107D
116
98
99
100
101
113
102
103
104
105
106
107B
107
117
125
121
126
128

THERAPEUTIC BED AND RELATED APPARATUS AND METHODS

This application is a continuation-in-part of U.S. patent application Ser. No. 08/448,081 filed May 23, 1995, now abandoned, which is a continuation-in-part of U.S. patent application Ser. No 08/241,075 filed May 9, 1994, which issued Mar. 18, 1998 as U.S. Pat. No. 5,611,096. This application is also a continuation-in-part of U.S. patent application Ser. No. 08/679,135, which is a continuation of U.S. patent application Ser. No. 08/241,075 filed May 9, 1994, which issued Mar. 18, 1997 as U.S. Pat. No. 5,611,096. This application is also a continuation-in-part of U.S. reissue patent application Ser. No. 09/271,580 filed Mar. 18, 1999, which is a reissue application of U.S. Pat. No. 5,611,096 issued Mar. 18, 1997. By this reference, U.S. patent application Ser. No. 08/448,081 and U.S. patent application Ser. No. 08/241,075 are each incorporated herein as though now set forth in their respective entirety.

BACKGROUND OF THE INVENTION

1. Field of the Invention

The present invention relates to apparatus and methods for monitoring and/or controlling therapeutic beds and mattress systems and the patients supported thereon. More particularly, the invention relates to monitoring angular deviations of the mattress surface and patient from the flat, horizontal position and for controlling the system in response.

2. Description of Background Art

Therapeutic supports for bedridden patients have been well-known for many years. Well-known therapeutic supports include (without limitation) low air loss beds, lateral rotation beds and fluidized bead beds. Commercial examples are the "KinAir," "Roto Rest" and "FluidAir" beds, all of which are products manufactured and commercialized by Kinetic Concepts, Inc. of San Antonio, Tex. Similar beds are described in U.S. Pat. Nos. 4,763,463, 4,175,550 and 4,635,564, respectively.

Other examples of well-known therapeutic supports for bedridden patients are the inflatable mattresses, mattress overlays or mattress replacements that are commercialized independent of a rigid frame. Because of the simpler construction of these products separate from a costly rigid frame, they tend to be more versatile and economical, thereby increasing options for customers and allowing them to control costs. A specific example of one such mattress is the "TheraKair" mattress, described in U.S. Pat. No. 5,267,364, dated Dec. 7, 1993, also manufactured and commercialized by Kinetic Concepts, Inc. The TheraKair mattress is a composite mattress including a plurality of transversely-oriented inflatable support cushions that are controlled to pulsate and to be selectively adjustable in groups.

Most therapeutic mattresses are designed to reduce "interface pressures," which are the pressures encountered between the mattress and the skin of a patient lying on the mattress. It is well-known that interface pressures can significantly affect the well-being of immobile patients in that higher interface pressures can reduce local blood circulation, tending to cause bedsores and other complications. With inflatable mattresses, such interface pressures depend (in part) on the air pressure within the inflatable support cushions. Although a number of factors are at play, as the cushion's air pressure decreases, the patient interface pressure also tends to decrease, thereby reducing the likelihood that the patient will develop bedsores and other related complications. Hence, there has been a long-felt need to have an inflatable mattress which optimally minimizes the air pressure in the inflated cushions.

The desired air pressure within a given cushion or group of cushions may also depend on inclination of the patient support, or portions thereof. For instance, it is known that when the head end of a bed is raised, a greater proportion of the patient's weight tends to be concentrated on the buttocks section of the mattress. Hence, it has long been known to divide inflatable therapeutic mattresses into groups of transversely-oriented inflatable cushions corresponding to different regions of patient's body, with the pressure in each group being separately controlled. Then, when a patient or attendant controls the bed to elevate the patient's head, pressure in the buttocks cushions is automatically increased to compensate for the greater weight concentration and to prevent bottoming of the patient. ("Bottoming" refers to any state where the upper surface of any given cushion is depressed to a point that it contacts the lower surface, thereby markedly increasing the interface pressure where the two surfaces contact each other.)

It is also well-known in the field of treating and preventing bedsores that therapeutic benefits may be obtained by raising and lowering (or "pulsating") the air within various support cushions. The effectiveness of this therapy may be reduced or negated if the surface inclination of a region (i.e., angle of the region relative to horizontal plane) changes, or if the pressure in the appropriate support cushions is not properly adjusted. As with bottoming, such a condition may occur when the head of the patient is raised to facilitate, for example, feeding of the patient. As the angle of the head end of the support mattress (and, thus, the angle of patient's head) becomes greater, the patient's weight redistributes. Consequently, a greater proportion of the patient's weight is concentrated on the patient's buttocks region, while less weight is concentrated on the head and back region.

It is also known to subject patients to gentle side-to-side rotation for the treatment and prevention of pulmonary problems. It is known to achieve such rotation therapy by alternating pressure in two inflatable bladders which are disposed longitudinally under the support mattress along the length of the left and right sides of the patient. Consequently, as one of the inflatable bladders inflates, the patient rotates by an angle up to approximately 45 degrees. Although references such as RWM's U.S. Pat. No. 4,769,584 have long taught the importance of sensing the actual angle of rotation, the actual rotation angle in inflatable supports is typically controlled by the amount of pressure applied to the pivot bladder without measuring the actual angle of rotation attained. Unfortunately, during this treatment, if too great of a rotation angle is achieved, then the patient tends to roll to the edge of the support mattress as one of the inflatable bladders inflates. Therefore, if an apparatus could be designed which would measure and control rotation angles of the therapeutic bed surface, this would prevent attaining excess angles resulting in the patient rolling to the edge of the support mattress during side-to-side alteration, and possibly falling off the support mattress. Also, if a minimum rotation angle of about 25 degrees is not attained, then minimal or no therapeutic value is received by the patient.

It has also long been known in the art to control other aspects of the patient surface in response to inclination of specific portions of the patient. For instance, the Eggerton "Tilt and Turn" bed popular in the 1980's was adapted to raise a restraining portion of the patient surface during lateral turning, in order to help prevent the patient from rolling off the bed. Another example is the automatic knee gatch feature popularized in Hill-Rom frames, particularly such as described in U.S. Pat. No. 3,237,212. Such knee gatch feature was adapted to automatically raise the knee section of the patient support whenever the patient or caregiver desired to raise the head section, hence compensating to prevent a patient from sliding toward the foot end of the bed when the head section was raised.

The concept of controlling air pressure inflatable support cushions in response to changes in the patient surface is at least plausible in bed systems which utilize a rigid frame structure beneath the patient. The frame structure provides an attractive location for mounting the transducers required for such control. This would allow for the use of flexible mattresses, as well as to position any foreign devices in closer proximity to a patient. Because a patient might be injured by contact with the device, mounting a sensor to a rigid base board helps shield a patient from contact with the sensor. The result, though, is that a health care facility is inclined to acquire the entire bed system in order to gain the benefits of such technology—an acquisition which may not be readily affordable. Such acquisitions also limit the health care facility to using specific mattresses with specific frames, rather than separately selecting and interchanging the preferred mattresses and bed frames. Interchangeability, on the other hand, would tend to maximize the facilities' cost containment and efficiency.

Unfortunately, conventional support mattresses fail to properly adjust the pressure within the support cushions as the surface angles of the support mattress vary. As a result, pressure points are created on conventional mattresses increasing the risks of bedsores.

Others have taught that the desired air pressure within the air cushions may depend in part on the angle to which the patient is desired to be rotated. For instance, U.S. Pat. No. 5,003,654 dated Apr. 2, 1991 described an oscillating low air loss bed which laterally rotates a patient to varying degrees, depending in part on the pressure within the cushions which achieve the turn.

Prior developments have also encountered numerous other obstacles, which will be evident, to one of ordinary skill in the art, especially in view of the prior art and in light of this specification.

SUMMARY OF THE INVENTION

The present invention comprises new and improved apparatus and methods for controlling therapeutic mattress surfaces and related patient supports. The invention is particularly suited for use with a therapeutic mattress which comprises a plurality of inflatable support cushions positioned latitudinally under the patient's body. Typically, such mattress is divided into four regions: the head region, the back region, the buttocks region, and the legs/feet region.

It is a basic object of the invention to improve upon the prior art, including to enhance the controls of such beds. Many objects, features, and advantages of the present invention will become evident to those of ordinary skill in the art in light of the following descriptions, the accompanying drawings and the appended claims, particularly when viewed with reference to the prior art.

DETAILED DESCRIPTION OF THE PREFERRED EMBODIMENT

Figure 1:
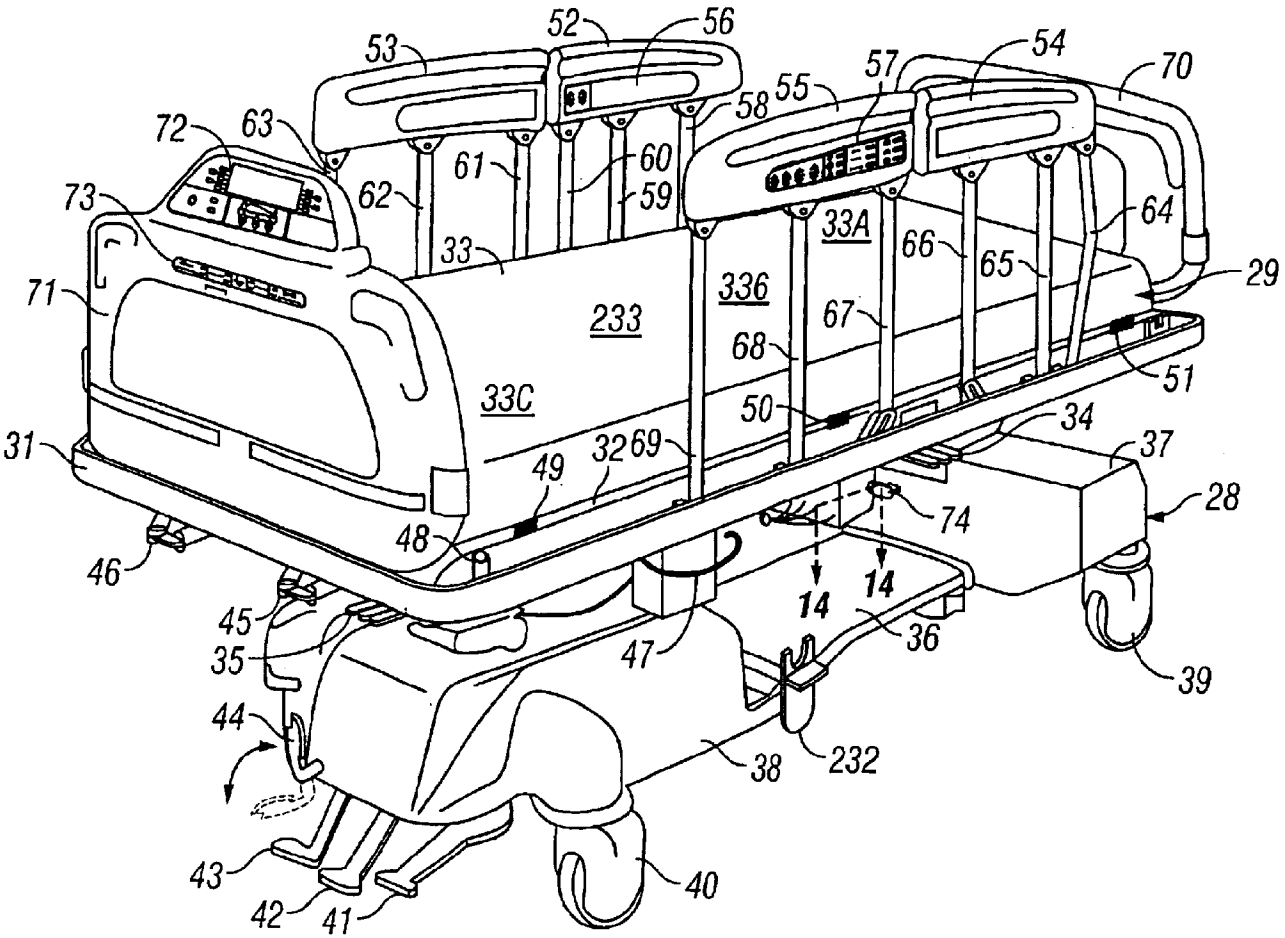
FIGS. 1, 2, 3 & 4 show various perspective views of the preferred embodiment of the invention, with siderails 52–55 in the raised position.
Figure 2A:
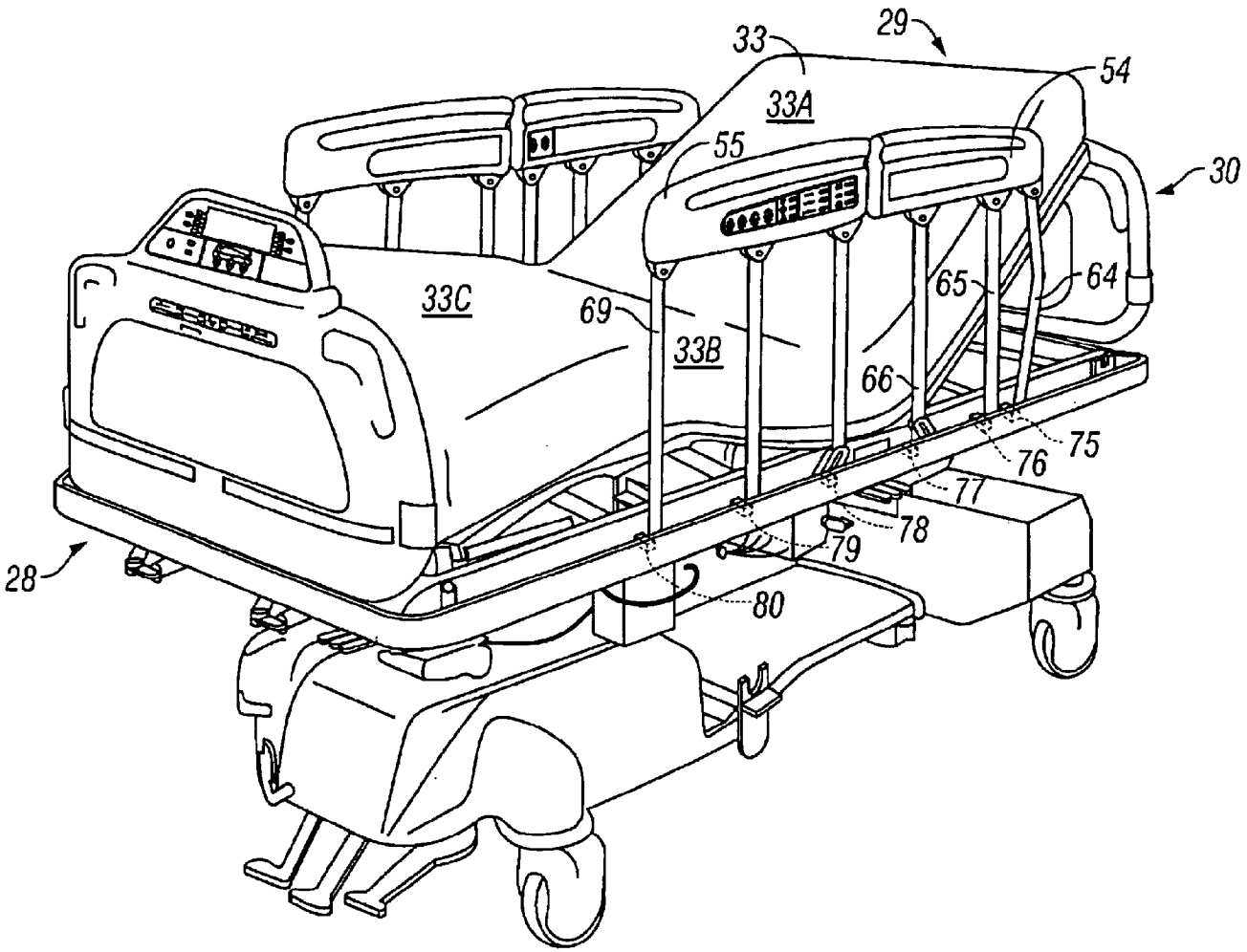
Figure 2B:
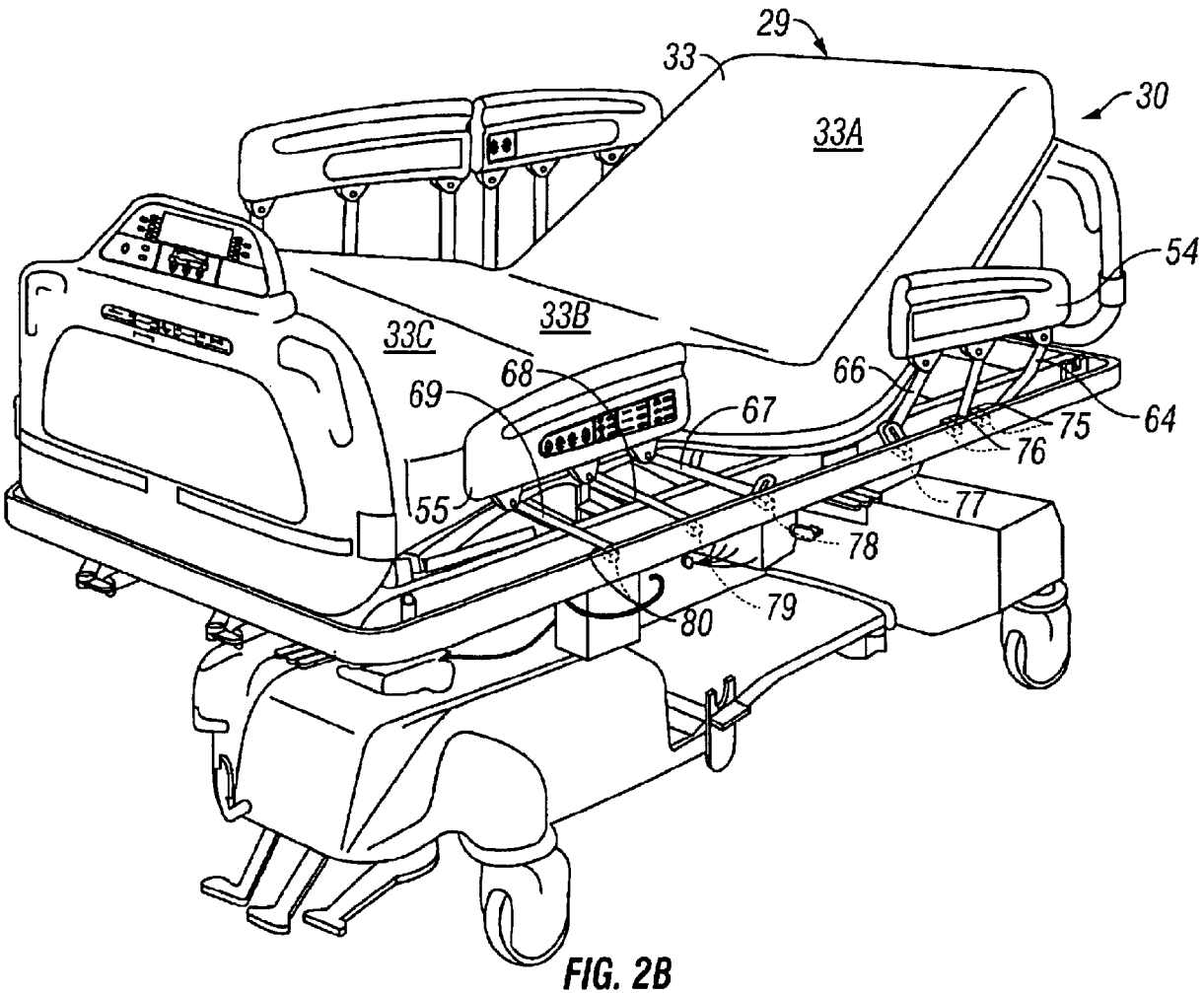
Figure 3:
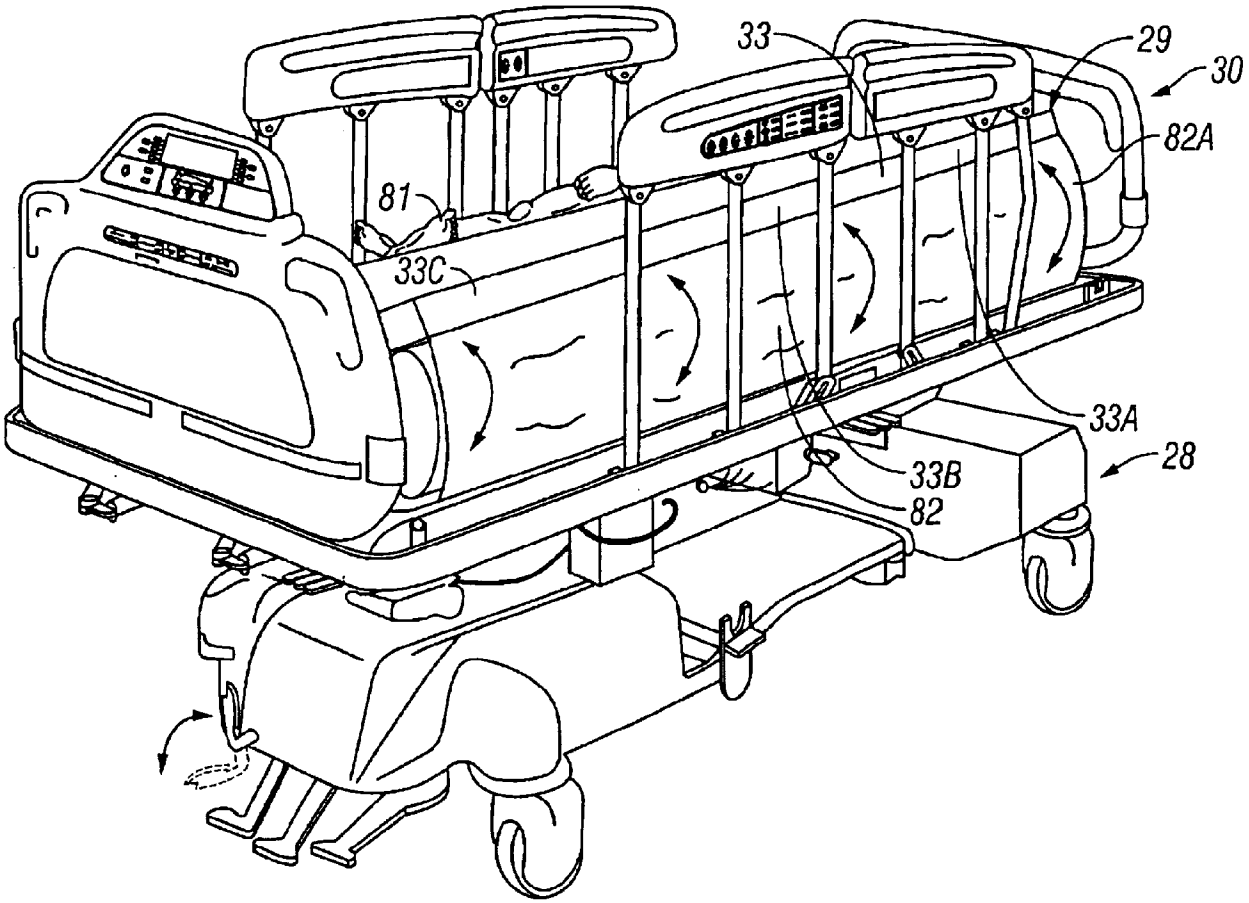
Figure 4:
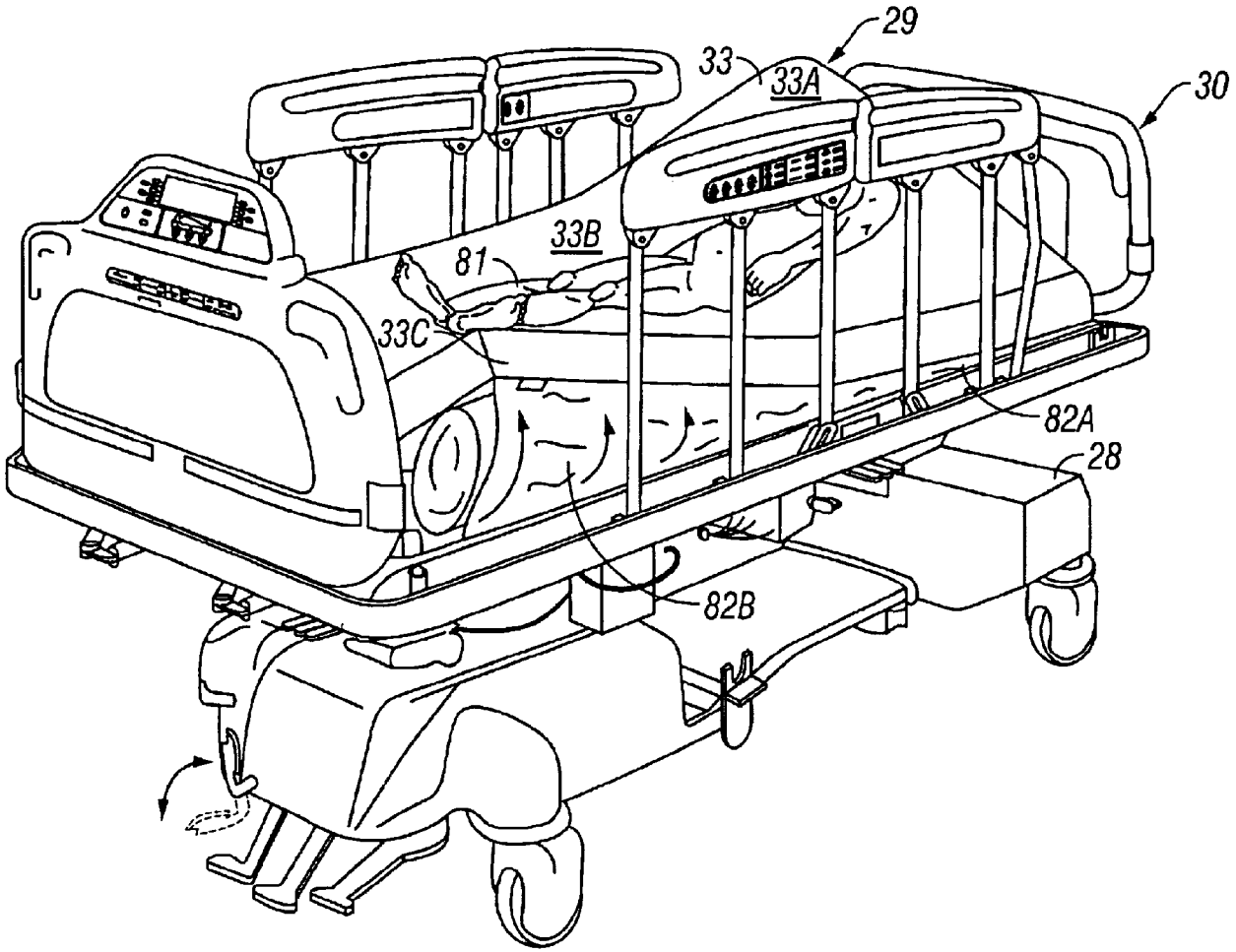

Referring to FIGS. 1–4, there is shown a therapeutic patient treatment bed 30 constructed according to the teachings of the present invention. The bed 30 shown is considered to be a presently preferred embodiment of the invention, although those skilled in the art will recognize many alternate embodiments upon reading of the descriptions further herein. Further reference may be made to the commercial embodiment of bed 30, which is being commercialized on the date commensurate with filing of this patent specification under the trade designation "TriaDyne," commercially available through Kinetic Concepts, Inc. of San Antonio, Tex., or through its subsidiary, KCI Therapeutic Services, also of San Antonio, Tex.

The bed 30 is generally constructed of a mattress system 29 mounted atop a bed frame 28. Mattress system 29 is a specialty low air loss mattress providing a comprehensive system of pulmonary and skin care therapies for the critically ill, immobilized patient. Such therapies include gentle side-to-side rotation of a patient, percussion (or vibration) therapy, and gentle pulsation of the air cells supporting the patient. Bed frame 28, in the preferred embodiment, is a specially adapted bed commercially available through the Stryker Bed Corporation of Kalamazoo, Mich.—namely, the Stryker Model 2020, Critical Care Bed of Stryker's Renaissance Series.

Bed frame 28, more particularly, includes lower base frame 36, a middle patient support frame 31 and an upper patient support sub-frame 32. The patient support frame 31 may be referred to as perimetrically-shaped in that it is formed of rigid members outlining the perimeter, together with supporting members in between. The central area of middle support frame 31 is substantially open for permitting the various components of the bed, and also for permitting radiolucense in the head section. Upper patient support sub-frame 32 is an articulated patient support for allowing articulation of the leg and head sections of the patient support within the confines of the support frame 31. Such an articulated support sub-frame 32 is conventional in the art. The base frame 36 is modified to comprise a head end section under cover 37 and foot end section under cover 38.

Covers 37 and 38 serve to conveniently house many of the components of bed 30 detailed further herein. Cover 37, more particularly, encloses the lower frame assembly 500 described in reference to FIG. 29, described further herein.

The base frame 36 rests upon four floor engaging casters 39 and 40 conventionally journaled adjacent the four corners of base frame 36 for rotational movement about a vertical axis. Foot end casters 40 are equipped with caster brakes activated by a pivotally-mounted lever 44. By using lever 44, such caster brakes can be adjusted for entering a steering, neutral or brake mode. In the steering mode, activated when lever 44 is in its fully counter-clockwise position, the foot end casters 40 turn freely but do not deviate in rotation from the longitudinal axis of the bed 30. In the brake mode, activated when pivotally mounted lever 44 is in its fully clockwise position, the foot end casters 40 neither turn freely nor deviate in rotation from the longitudinal axis of bed 30. In the neutral mode, activated when pivotally mounted lever 44 is in a position between that of the steering mode and that of the brake mode, the foot end casters 40 are free to both turn and rotate. In the preferred embodiment, it is recommended that all casters be set to the brake mode at all times except when a care giver desires to move bed 30. It is considered mandatory practice to set the casters to the brake mode during patient 81 placement in to or out of bed 30.

The conventionally constructed middle patient support frame 31 is primarily indicated to provide vertical motion of the patient support surface 33 by extension and compression of head end hydraulic cylinder 34 and foot end hydraulic cylinder 35 which are dependently connected between support frame 31 and base frame 36. The ability for vertical translation of patient support surface 33 conveniently enables the care giver to raise or lower the height of bed 30 to the same level as the surface to or from which the patient 81 may be transferred. Such ability aids in compliance with standard safety rules and hospital protocols. Means to effect such translation will be apparent further herein.

A plurality of bag holders 47 or standard intravenous injection mounts 48 as are commonly found on typical hospital type beds may conveniently be attached to the support frame 31.

Support frame 31 itself includes a plurality of side rails 52–55 for patient safety. These side rails 52–55 dependently attach to side rail bars 58–69 which in turn pivotally attach to support frame 31. The side rails 52–55 translate forward or backward within a vertical plane parallel to the longitudinal axis of patient 81. This allows the side rails 52–55 shown in a raised position in FIG. 2A to also take on a lowered position as shown by side rails 54 and 55 in FIG. 2B.

Figure 10:
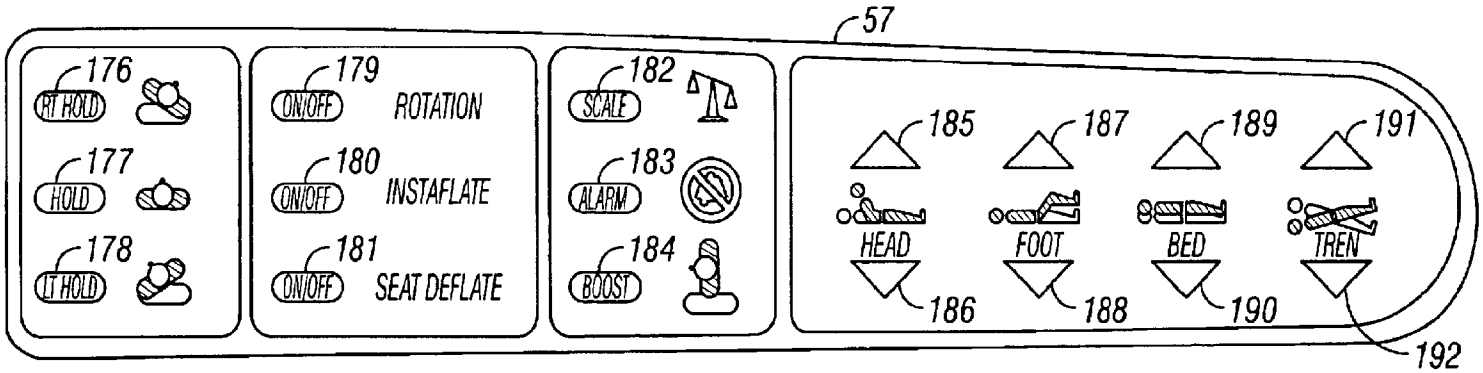
FIGS. 10–13 show various control panels for the preferred embodiment.
Figure 11:
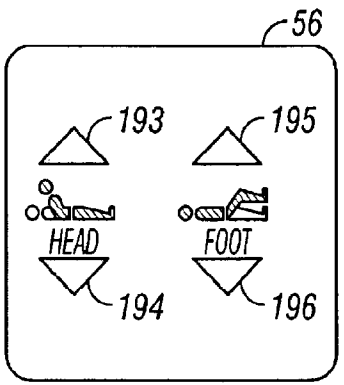

Patient head end side rails 52 and 54 further comprise patient control panel 56 for controlling the functions of bed 30. Patient controls 56 are positioned on the interior of said side rails 52 and 54 for convenient patient access. Patient controls 56, shown in FIG. 11, allow the patient 81 to control head up 193 or head down 194 functions or knee gatch up 195 or knee gatch down 196 functions of bed 30. Patient foot end side rails 53 and 55 comprise nurse control panel 57 for bed 30. Such controls 57 are positioned on the exterior of said side rails 53 and 55 for convenient nurse access. Nurse controls 57 shown in FIG. 10 allow a care giver to control a plurality of functions as detailed further herein. Nurse controls 57 work in concert with nurse display 582 (sown in FIG. 29). Nurse display 582 is located on the side of foot end rail 71 facing patient 81. Nurse display 582 is a one-line liquid crystal display in electrical communication with master control board 581. Details of the usage of nurse display 582 are apparent further herein.

Figure 12:
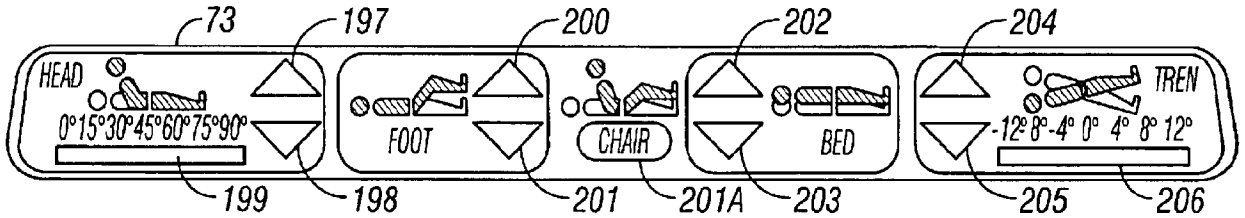
Figure 13:
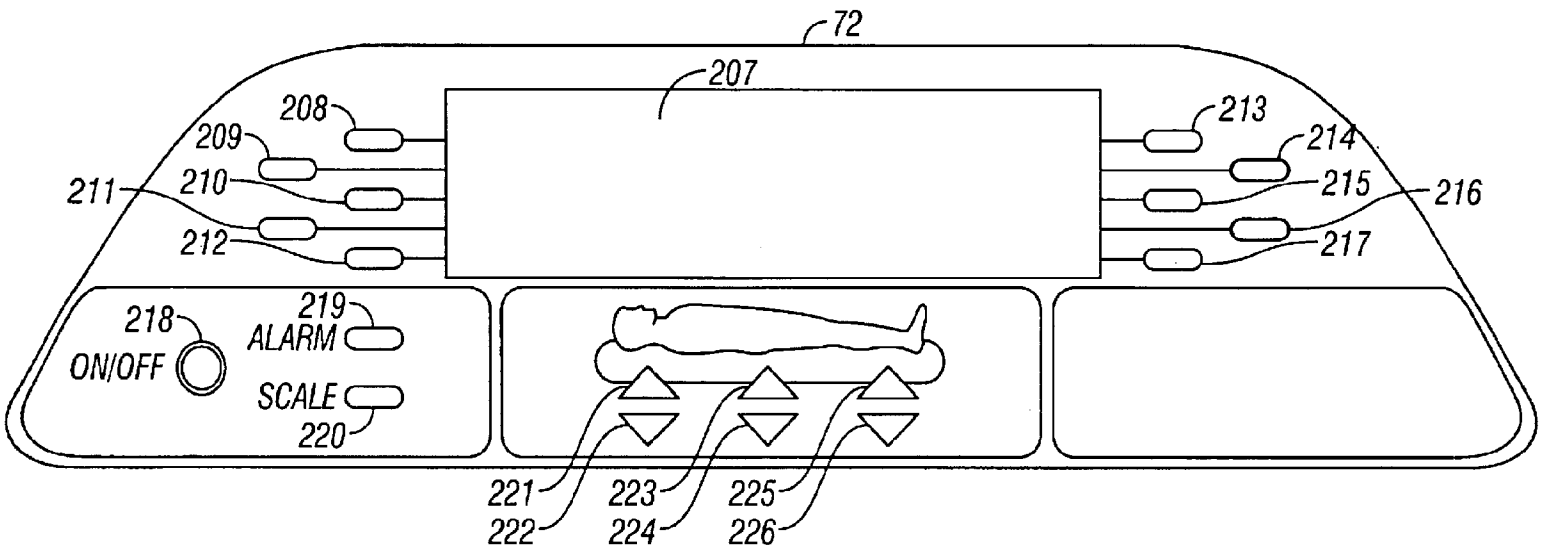

The patient support frame 31 also comprises dependently attached patient head end rail 70 and foot end rail 71. Patient foot end rail 71 itself comprises bed position control panel 73 shown in FIG. 12 and detailed further herein and main control panel 72 shown in FIG. 13 and also detailed further herein.

The patient support sub-frame 32 constructed within patient support frame 31 is primarily indicated for angular movement of the patient support surface 33. Specifically, through conventional methods as are well-known in the art, the patient sub-frame 32 may be manipulated such that head section 33*a* of patient support surface 33 is raised as is shown in FIG. 2. Torso section 33*b* and legs section 33*c* may also be raised (or "gatched") as is also shown in FIG. 2.

Figure 6:
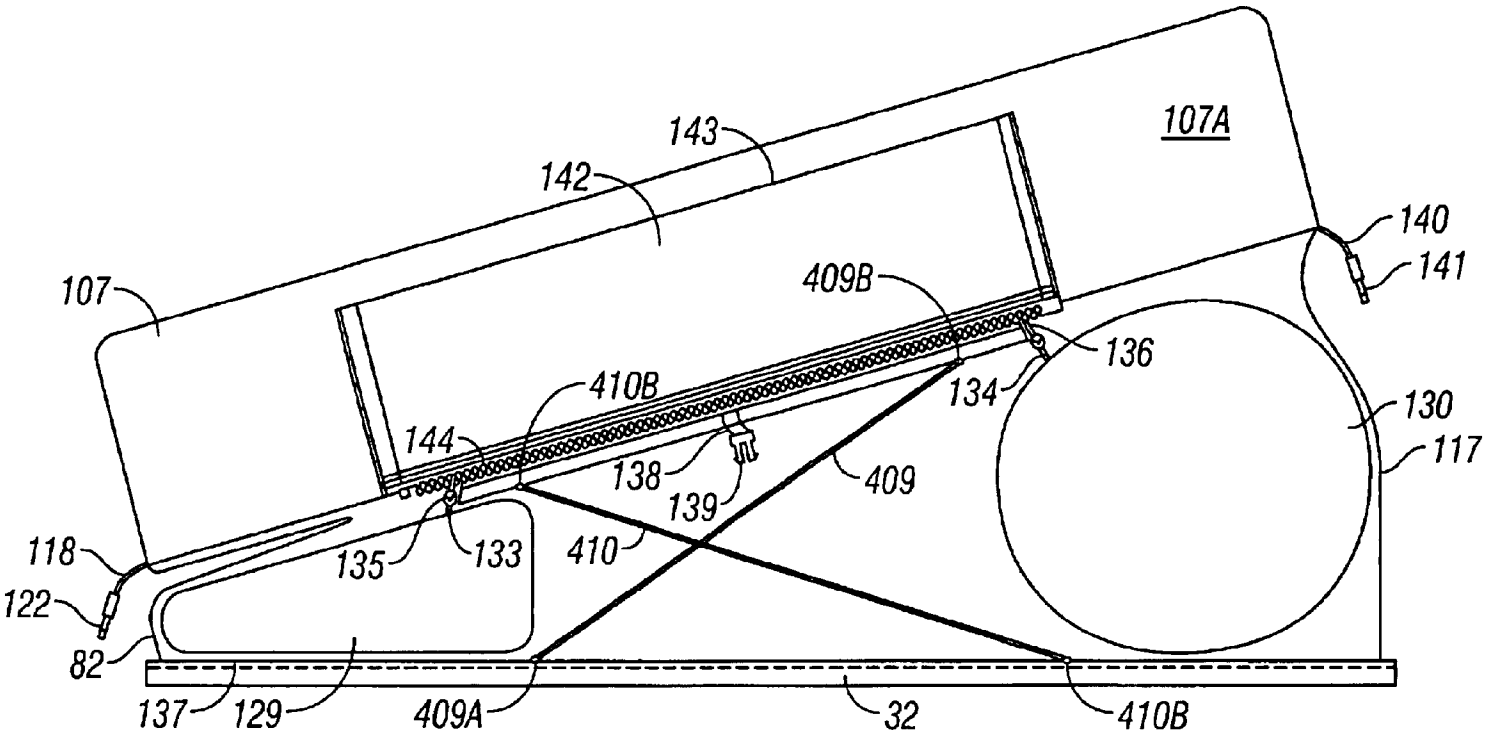
FIG. 6 shows an end-on view of the turning bladders.

In order to support the patient support surface 33, the patient support sub-frame 32 is covered with a platform 137 shown in FIG. 6 which in the best mode is comprised of a radiolucent material such as polycarbonate or paper phenolic in order that an X-ray apparatus may be utilized upon a bed-ridden patient 81. In the preferred embodiment, this platform 137 is comprised of a polycarbonate material which is commercially available under the trademark "LEXAN." This platform 137 may be provided with attachment points as necessary for fixing the stability of the supported patient support surface 33.

In addition to electrically activated control systems detailed elsewhere herein, the preferred embodiment also has manually activated hydraulic 41–43 and mechanical 45–46 control systems.

Figure 14:
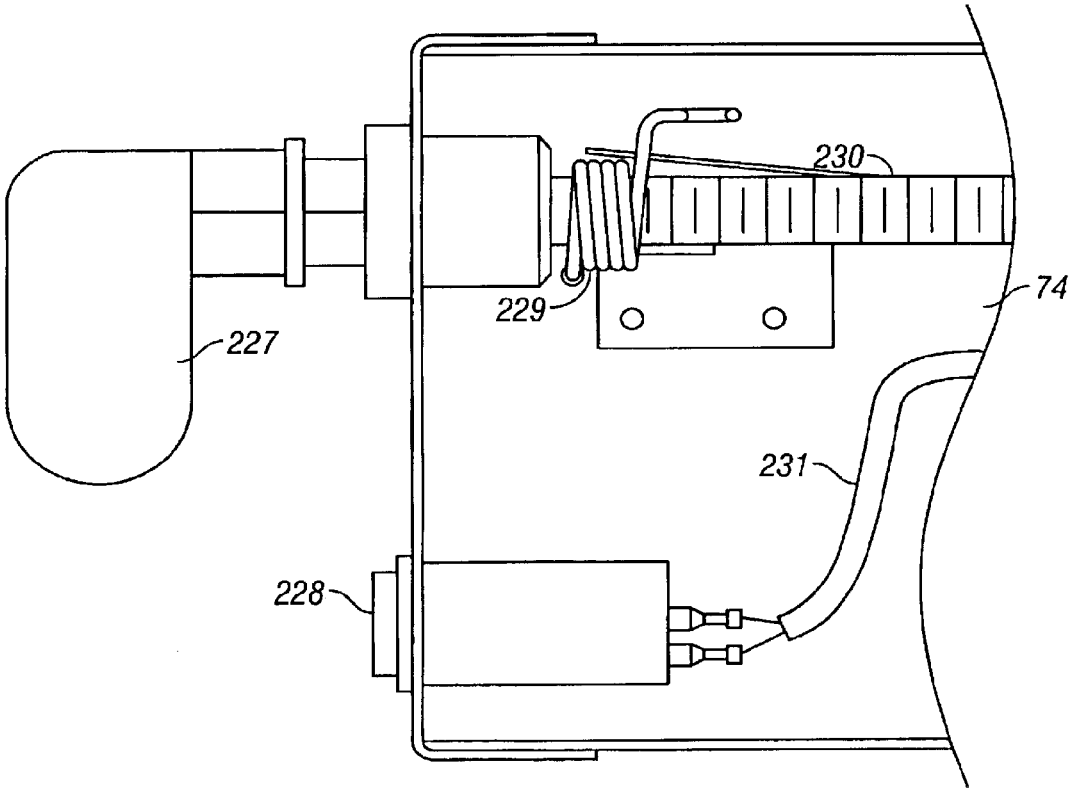
FIGS. 14–18 show various detailed components of the preferred embodiment.

The bed 30 has an automated CPR mode system which is activated and deactivated via a plurality of CPR mode activation controls 74 as shown in FIGS. 1 and 14. Activation is caused by rotation of lever 227 attached to torsion spring 229 and loaded rod 230. Deactivation is accomplished by return of lever 227 to its original position and pressing single pole, double throw, momentary push button switch 228 connected to other control systems through twin lead cable 231. The detailed operation of the CPR mode activation system will be apparent further herein.

The therapeutic structure of patient treatment bed 30 of FIG. 1 is generally comprised of patient support surface 33, blower and valve box assemblies shown in FIGS. 15A, 15B, 16A–16C and 17 and detailed further herein, and patient rotation angle sensing system shown in FIGS. 21–25 and 27A–27C and also detailed further herein.

Figure 5:
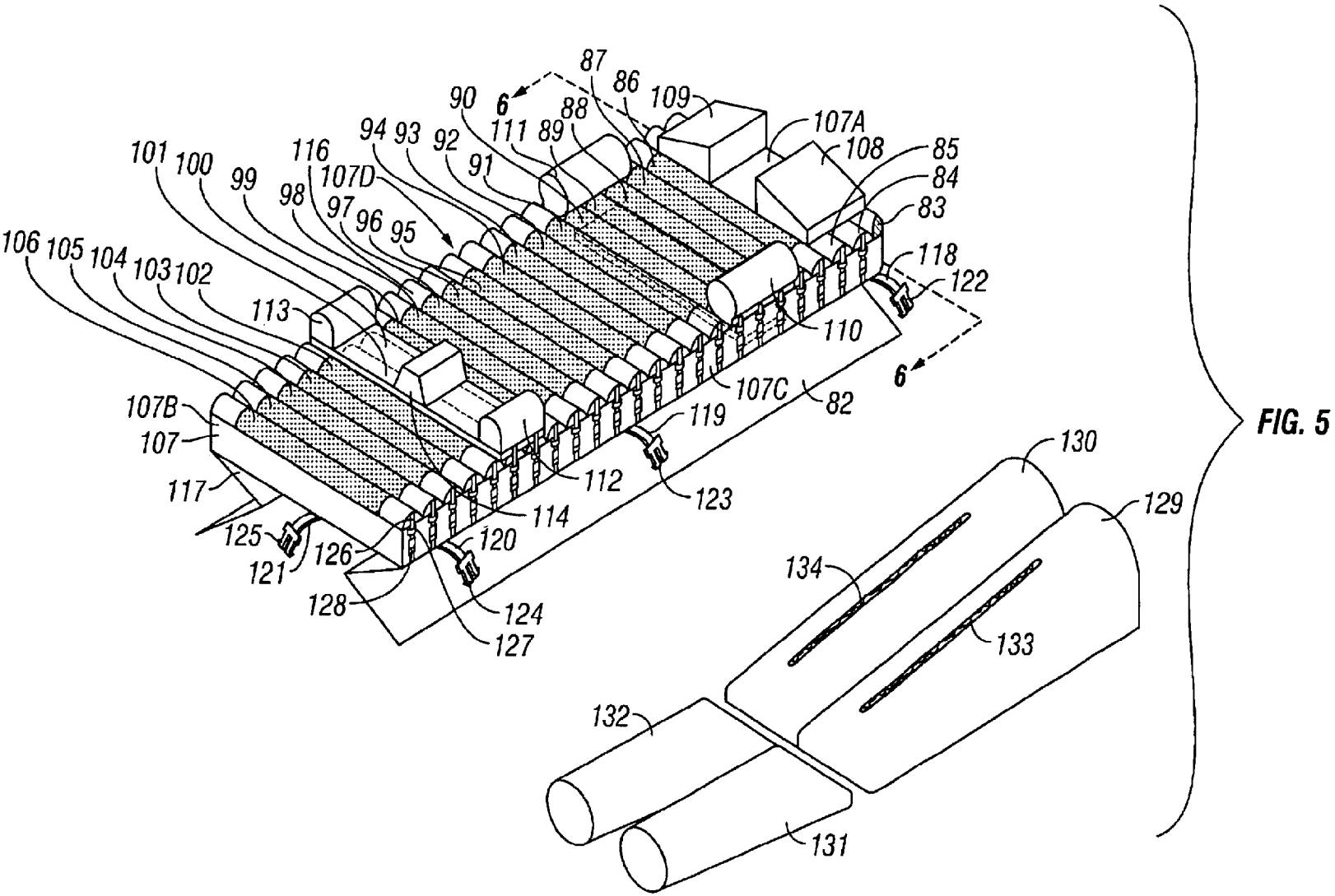
FIG. 5 shows an exploded perspective view of the mattress system 29 of the preferred embodiment.
Figure 7:
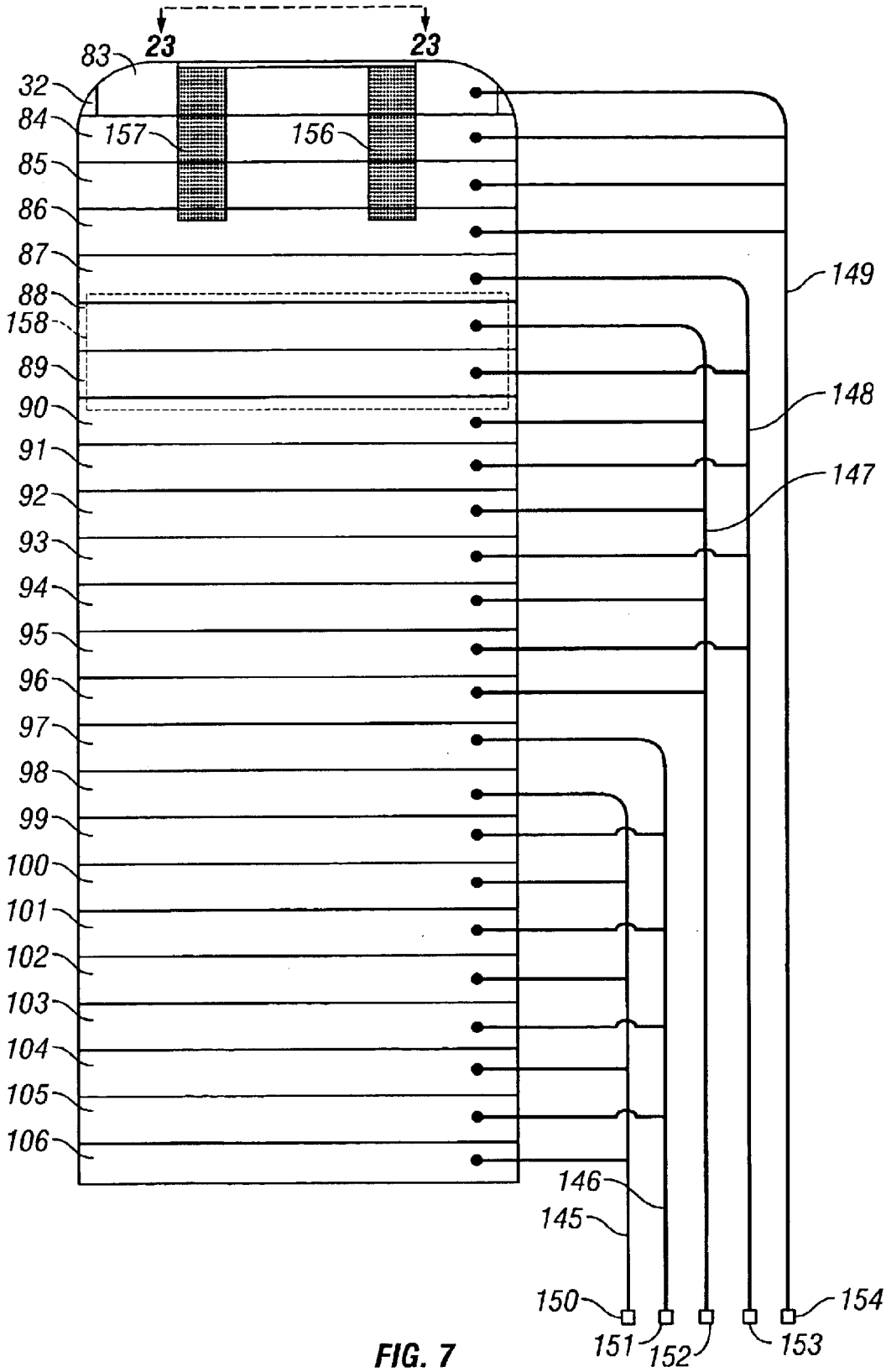
FIGS. 7–9 show a schematic view of the air conduits for the mattress system 29.

The patient support surface 33, normally covered by sheet 233 but shown in detail in FIG. 5 with the sheet removed, generally comprises a plurality of patient support air bladders 83–106, turning air bladders 129–132, patient restraining bladders 108–111 and 114, percussor bladder 158 shown in FIG. 7, and bladder containment system 82, 107, and 117. All air bladders in the preferred embodiment are comprised of polyurethane coated impermeable heavy duty fabric.

Referring to FIG. 5, it can be seen that the patient support air bladders 83–106 are contained by a semi-rigid structure 107 having a head end 107*a*, a foot end 107*b*, and patient left and right sides 107*c* and 107*d*, respectively. The semi-rigid structure 107, in the preferred embodiment, is a two-ply Regency fabric which defines the general outline of the mattress system 29 and helps maintain the position of the air bladders 83–106; however, in alternative embodiments, such semi-rigid structure 107 may include plastic or other material inserts for varying the flexibility thereof. A plurality of securing straps 126 held in place by positioning straps 127 and tightened by fasteners 128 serve to restrain the patient support air bladders 83–106 in place within the containment structure 107. Patient restraint bladders 108–114 are held in place by conventional snapping, fastening, strapping, or sewing as is well known in the art. Specifically, the preferred embodiment comprises patient left and right head restraint air bladders 108 and 109, respectively; patient left and right shoulder restraint air bladders 110 and 111, respectively; and a patient abductor restraint air bladder 114. Additionally, the patient 81 is provided support from patient left and right foam leg cushions 112 and 113, respectively.

The containment structure of the patient support surface 33 further comprises skirting 82 and 117. Skirting 82 and 117 are primarily indicated for aesthetics but in the absence of hinging and zipper systems shown in FIGS. 5, 28A and 28B and detailed further herein, skirting 82 and 117 also provides containment of turning bladders 129–132. Turning bladders 129 and 130 are themselves further comprised of zipper elements 133 and 134, respectively, which serve to ensure the turning bladders 129 and 130 remain in place directly under the patient 81 during turning operations. This allows higher turning angles to be attained than does prior art fabrications.

As best shown by FIG. 7, patient support air bladders 83–106 are inflated by air which has been transmitted through a plurality of polyethylene hoses 145–149 from a blower and valve assembly shown in FIGS. 15A, 15B, 16A–16C and 17 and detailed further herein. The plurality of hoses 145–149 are connected to the bladders sectionally, hence compartmenting air flow into the head section 33*a,* torso section 33*b,* and legs section 33*c*. Further, the bladders 87–96 of the torso section 33*b* are supplied with air in alternating fashion from hoses 147 and 148. Similarly, bladders 97–106 of the legs section 33*c* are in alternating fashion supplied with air from hoses 145 and 146. This allows the patient 81 supported by surface 33 to receive pulsation therapy as is well known in the treatment and prevention of bedsores and other pressure related complications of extended confinement to hospital beds. Pulsation therapy is accomplished by first reducing pressures through hoses 145 and 147 hence deflating bladders 88, 90, 92, 94, 96, 98, 100, 102, 104, and 106. Upon attaining the maximum deflation in these bladders air flow is restored through hoses 145 and 147, again inflating the connected bladders. Simultaneously, with the re-inflation of bladders 88, 90, 92, 94, 96, 98, 100, 102, 104, and 106, pressure is decreased in bladders 87, 89, 91, 93, 95, 97, 99, 101, 103, and 105 by decreasing flow through hoses 146 and 148. Upon attaining the maximum deflation in bladders 87, 89, 91, 93, 95, 97, 99, 101, 103, and 105 and simultaneously the maximum inflation in alternate bladders 88, 90, 92, 94, 96, 98, 100, 102, 104, and 106, the cycle is reversed and repeated. It should be noted that for the purpose of this discussion maximum inflation and deflation is determined by the desired therapy intensity which in the preferred embodiment is care giver selectable as low, medium or high. Under the control of the microprocessor systems detailed further herein, this pulsation is available with cycle periods from two to forty minutes. Separation of the air bladders 835 106 into head section 33*a,* torso section 33*b,* and legs section 33*c* also allows independent adjustment of maximum pressures in each region allowing minimization of pressure points against the patient 81.

Figure 8:
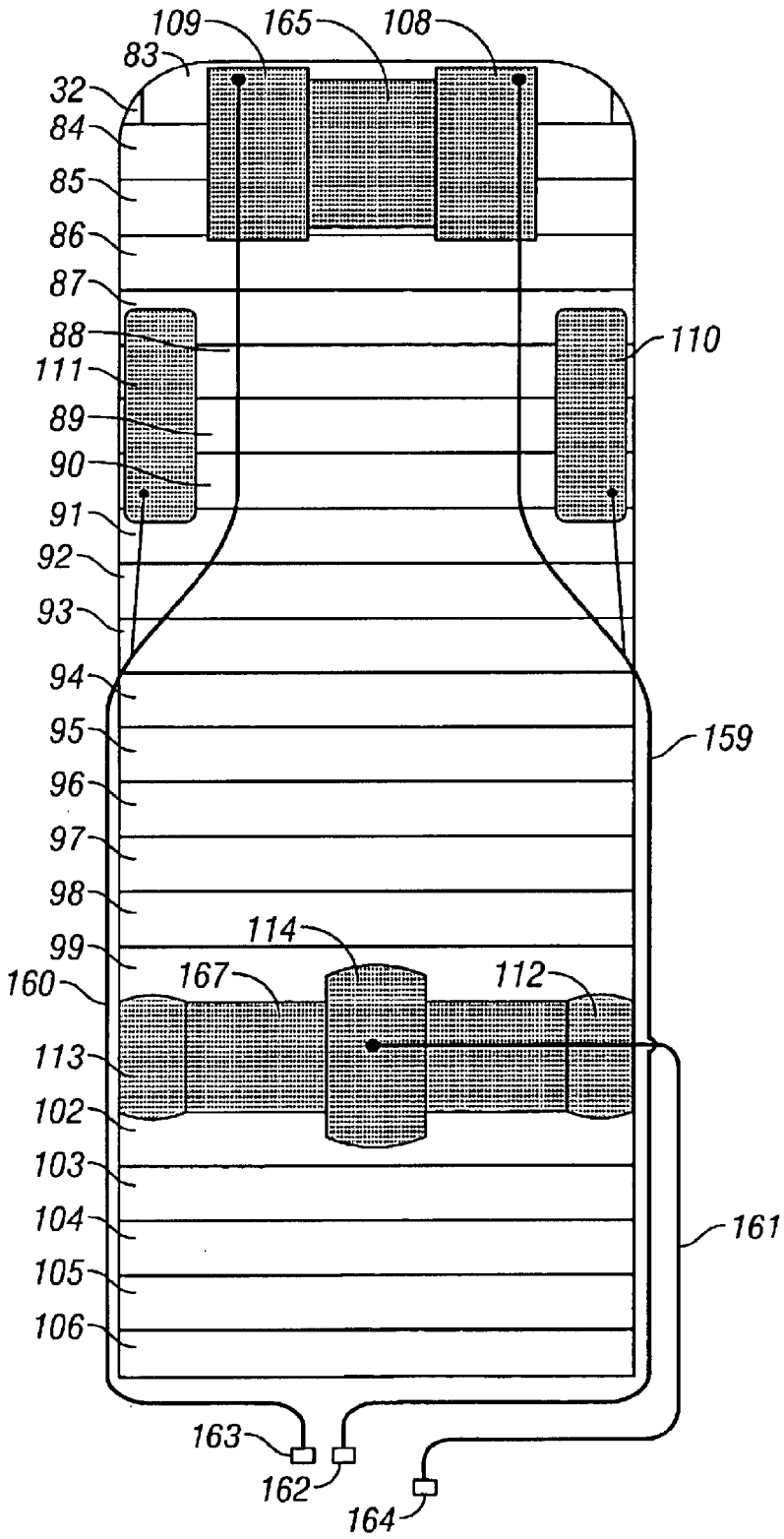

FIG. 8 shows that patient restraint bladders 108–114 are also inflated through polyethylene hoses 159–161. Hose 161 originates from the same blower and valve assembly as hoses 145–149 (as shown in FIG. 7), while hoses 160 and 159 originate from splicing with hoses 168 and 169, respectively, themselves originating from valve switch 406 shown in FIG. 18 and detailed further herein. Through this splicing arrangement, patient left head restraint 108 and left shoulder restraint 110 are inflated through hose 159 while the patient 81 is in a left turning rotation. Patient right head restraint 109 and right shoulder restraint 111 are inflated through hose 160 while the patient 81 is in a right turning rotation. Patient abductor restraint 114 is inflated through hose 161 during rotation operation of bed 30.

Figure 9:
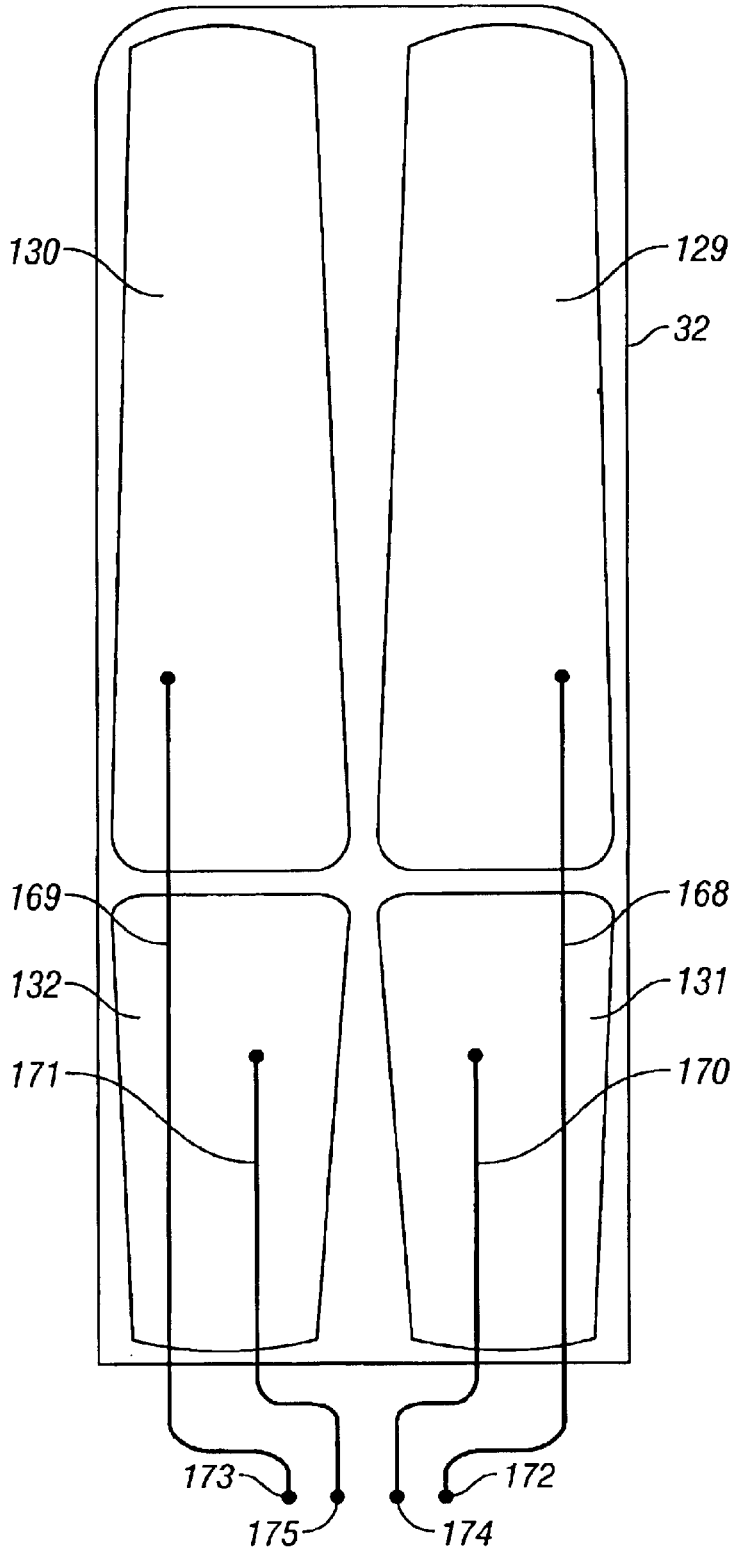

FIG. 9 best shows the inflation structure for the turning bladders 129–132 of bed 30. A left standard rotation turn of patient 81 is accomplished by inflation of turning bladders 130 and 132 through hoses 169 and 171 while simultaneously exhausting air in bladders 129 and 131 through hoses 168 and 170. A right standard rotation turn of patient 81 is accomplished by inflation of bladders 129 and 131 through hoses 168 and 170 while simultaneously exhausting air in turning bladders 130 and 132 through hoses 169 and 171. As will be apparent further herein, air flow may be configured so as to produce a counter rotation turn wherein the patient 81 torso turns in one direction and the patient 81 legs turn in opposite direction. A left counter rotation turn is accomplished by inflation of turning bladders 130 and 131 through hoses 169 and 170 while simultaneously exhausting air in turning bladders 129 and 132 through hoses 168 and 171. A right counter rotation turn is accomplished by inflation of turning bladders 129 and 132 through hoses 168 and 171 while simultaneously exhausting air in turning bladders 130 and 131 through hoses 169 and 170.

Referring to FIGS. 15A, 15B, 16A–16C, and 17, the best mode embodiment of the patient treatment bed 30 blower and valve block assembly is shown. The valve block generally comprises manifold 370 and motor mounting plate 371 supported a distance separated from manifold 370 by a plurality of industry standard stand-offs 372. Dependently mounted upon motor mounting plate 371 is a plurality of 12-volt reversible direction direct current motors 382–389. Each motor 382–389 is provided with electrical connection from a positive terminal 390 and a negative terminal 391 through connector 393 to slave board 340 detailed further herein. Each motor 382–389 is further provided with a chassis ground connection 392. Additionally, the valve block assembly comprises a plurality of air tubes 374–381 which provide air flow to the patient supporting air bladders 83–106, patient abductor restraint bladder 114 and valve switch 406, the function and operation of which is detailed further herein. Specifically in the preferred embodiment, tubes 374 and 375 provide air to valve switch 406 which in turn routes said air flow as appropriate to provide standard rotation, counter rotation or no-leg rotation of patient support surface 33. Tube 376 provides air to patient support air bladders 98, 100, 102, 104 and 106 through connector 150 to air hose 145. Tube 377 provides air to patient support air bladders 97, 99, 101, 103 and 105 through connector 151 to air hose 146. Tube 378 provides air to patient support air bladders 88, 90, 92, 94 and 96 through connector 152 to air hose 147. Tube 379 provides air to patient support air bladders 87, 89, 91, 93 and 95 through connector 153 to air hose 148. Tube 380 provides air to patient support air bladders 83–86 through connector 154 to air hose 149.

Figure 15A:
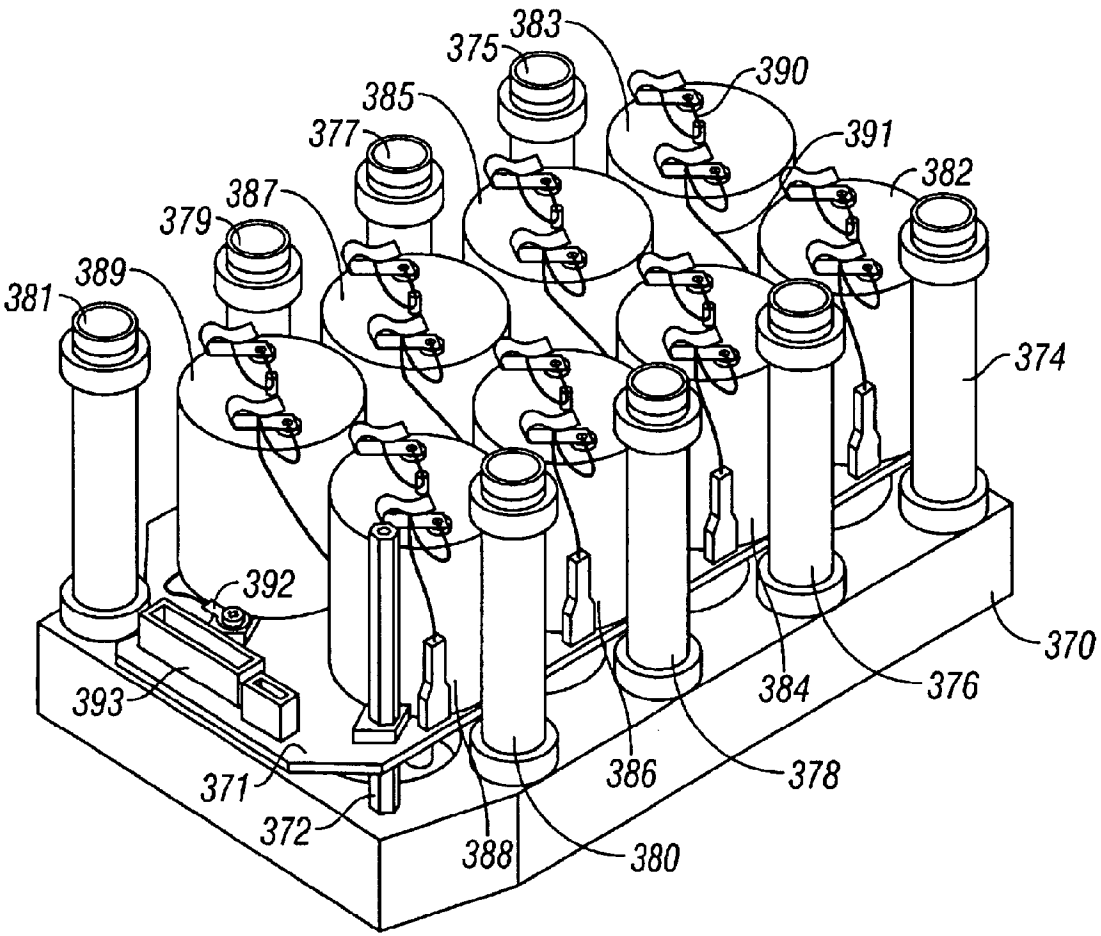
Figure 15B:
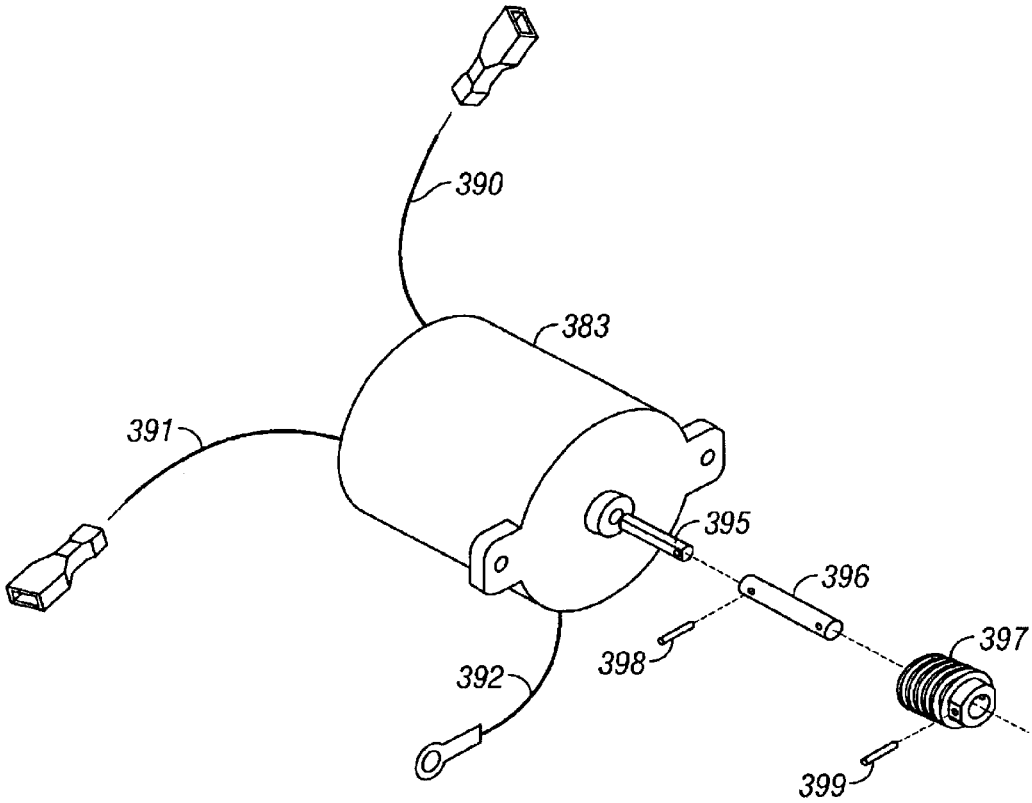
Figure 16A:
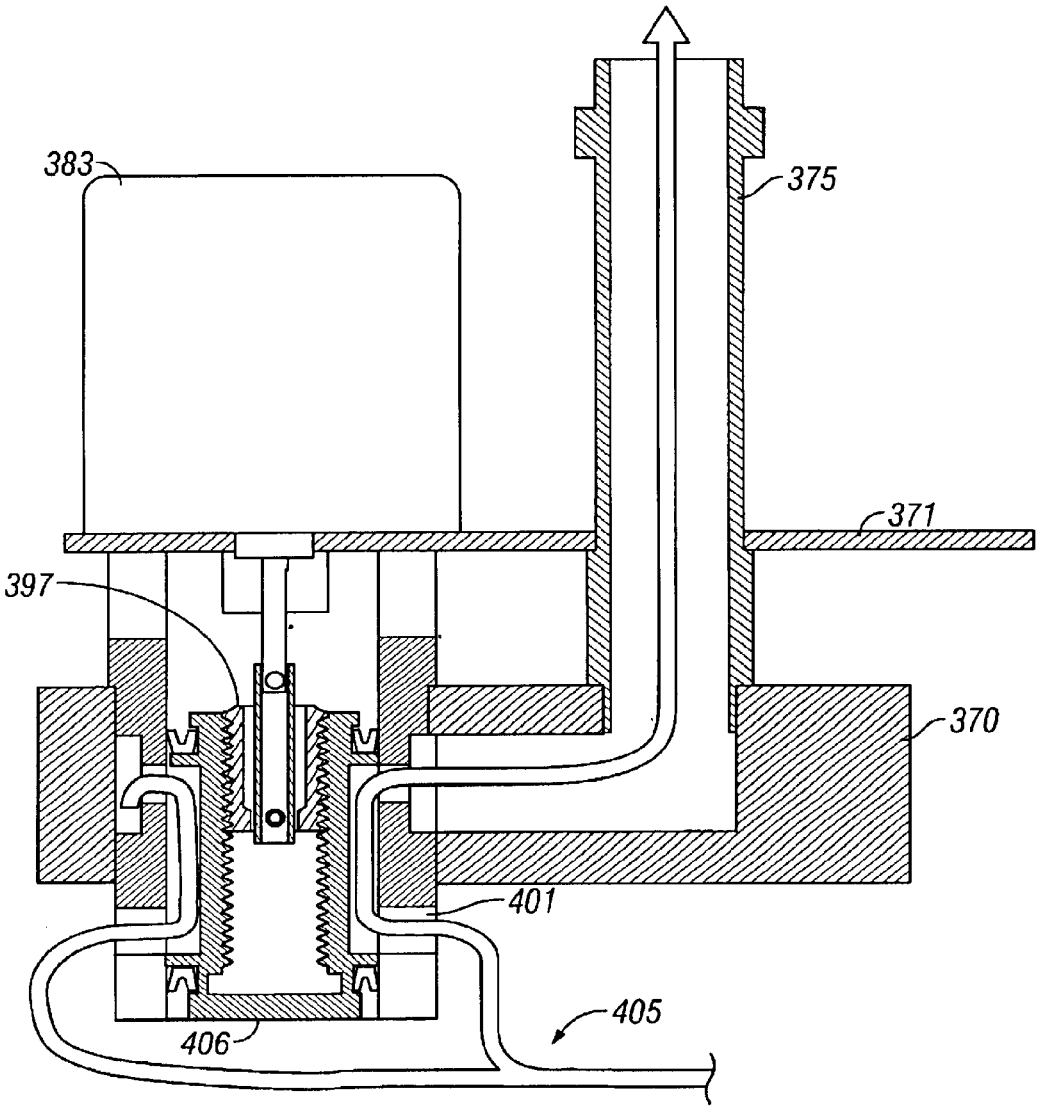
Figure 16B:
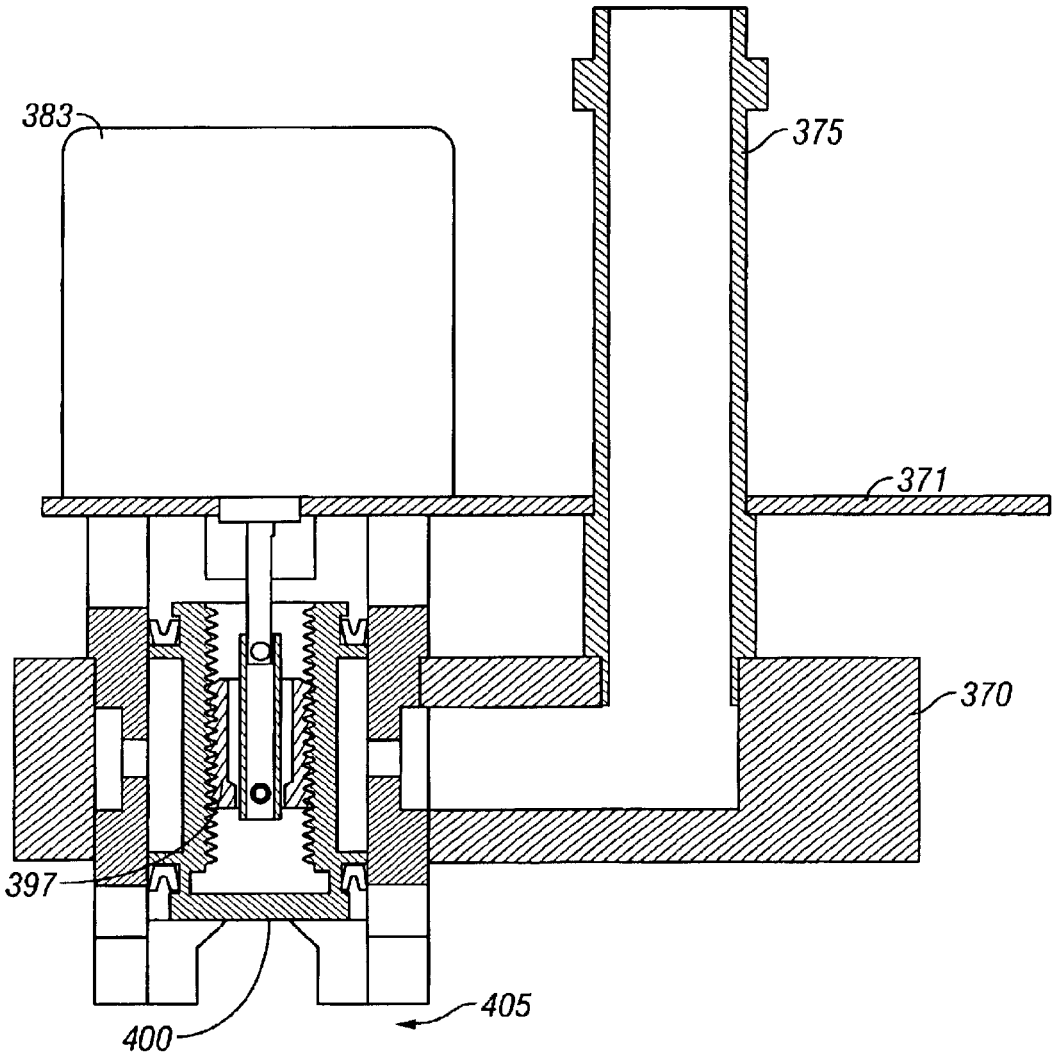
Figure 16C:
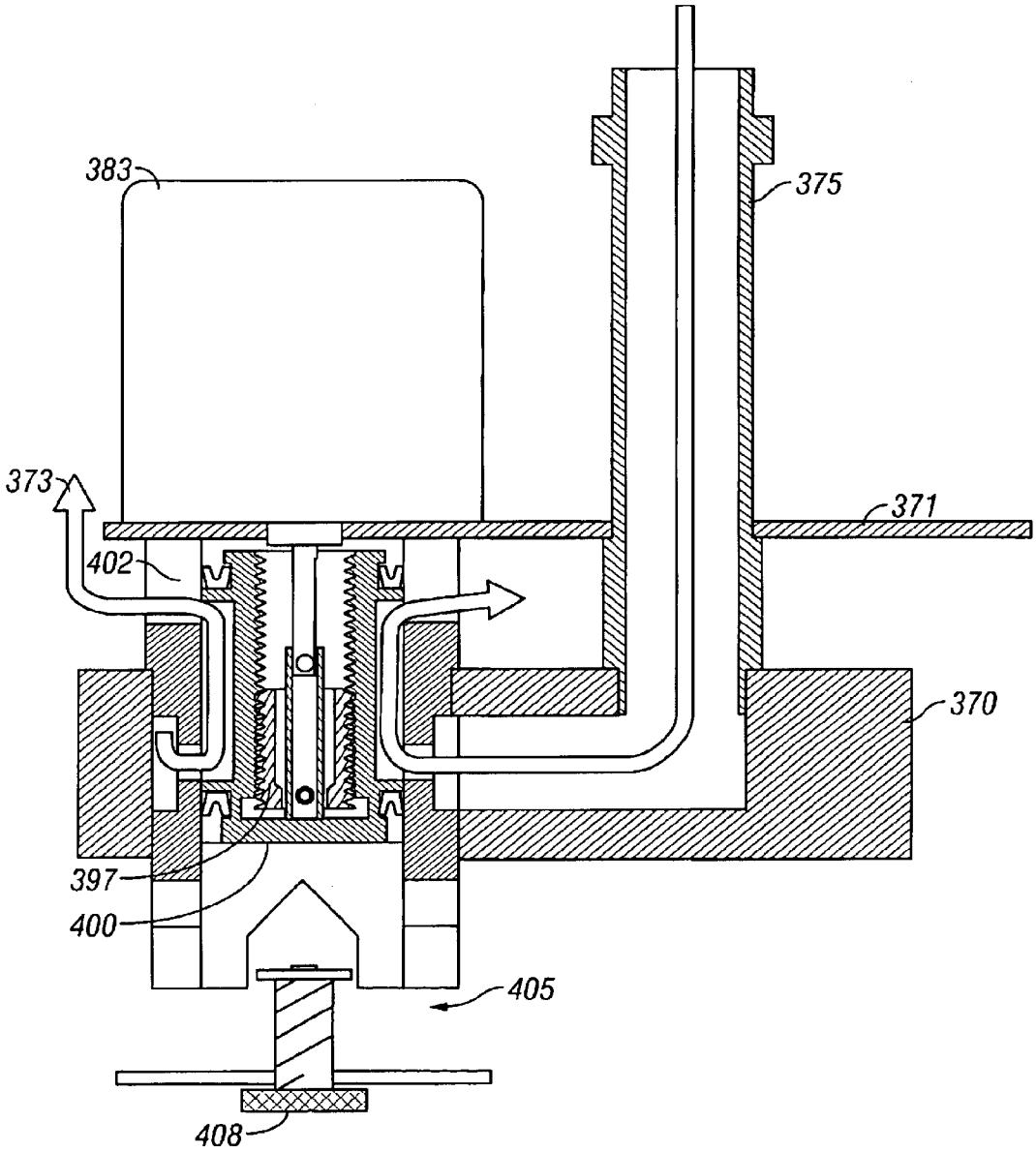
Figure 17:
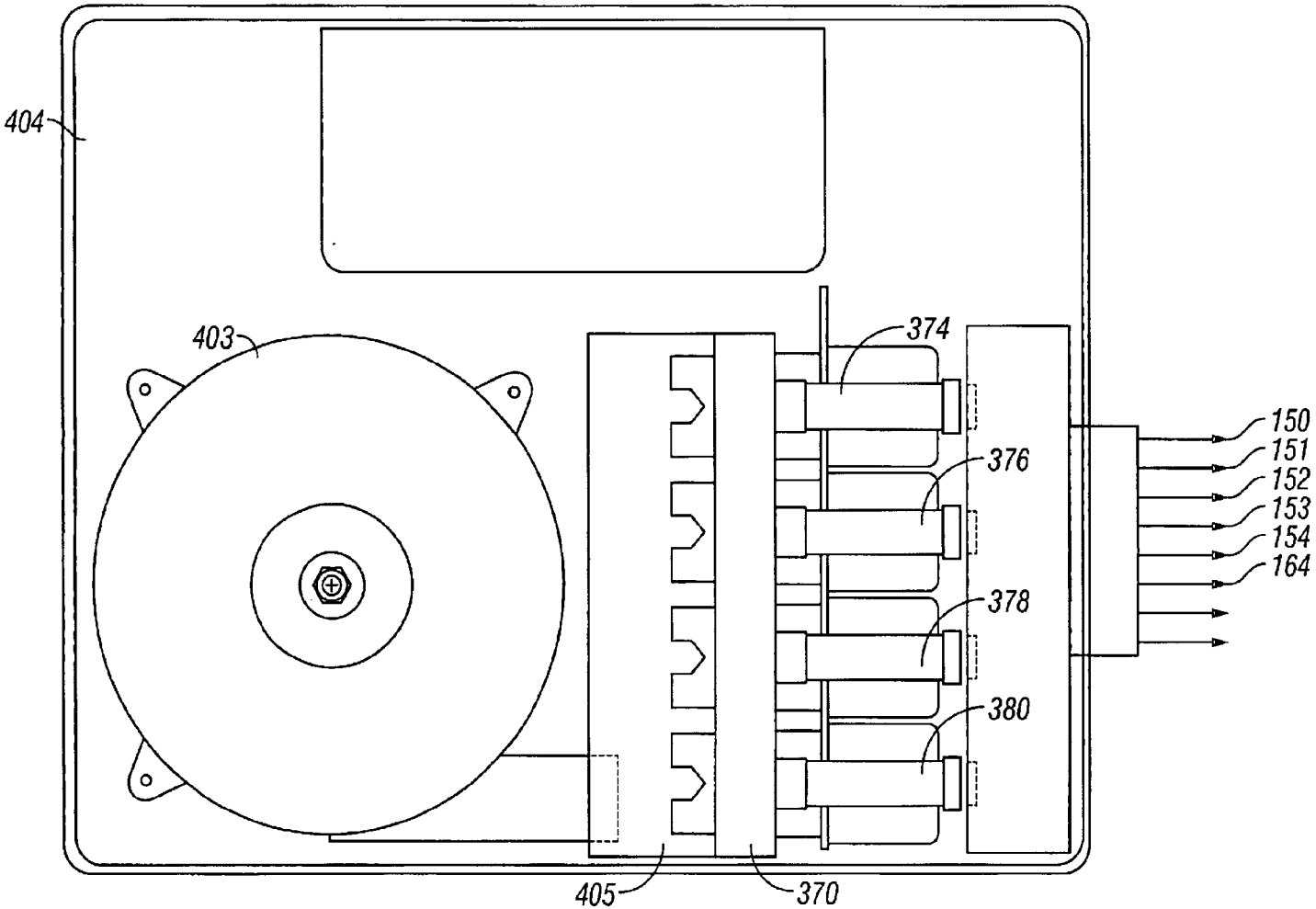

Referring specifically to FIG. 15B, valve control motor 383 is detailed showing connection of valve control motor shaft 395 to coupling 396 by pin 398 and further connection of coupling 396 to valve screw 397 by pin 399. In the preferred embodiment, space is conserved by utilizing a valve screw 397 which is of adequate diameter to fit coaxially over coupling 396 hence eliminating the need for an additional shaft. This reduces the longitudinal dimension of the valve block assembly while utilizing only that space required in any case due to the diameter of the valve motors 382–389. Connection of shaft 395 to valve screw 397 via coupling 396 and pins 398 and 399 allows floating of valve screw 397 for self-alignment with the valve spool 400, shown in FIGS. 16A–16C and detailed further herein. This design simplifies manufacture and increases reliability of valve block assembly operation. FIGS. 16A–16C show valve motor 383 with valve spool 400 in the air inflation position, no flow position and air exhausting positions, respectively. When valve motor 383 turns in the valve opening direction, valve screw 387 drives valve spool 400 away from valve motor 383 creating a flow path between cavity 405 and tube 375. Cavity 405 is pressurized by blower 403 as shown within housing 404 in FIG. 17. In an alternate embodiment, without loss of performance, blower 403 may be mounted separately from housing 404 and cavity 405. In such an embodiment, which may be advantageous for conservation of space, blower 403 would connect to cavity 405 via an air hose. Air flow between cavity 405 and tube 375 serves to inflate any air bladders which may be connected. FIG. 16B shows valve spool 400 in the closed position so as to block any flow into or out of tube 375. FIG. 16C shows valve spool 400 in the exhausting position. When valve motor 383 turns in the valve exhausting direction, valve screw 387 drives valve spool 400 toward valve motor 383 creating a flow path between tube 375 and the atmosphere 373. In the exhausting position, air escapes from whichever bladders may be connected to tube 375 to the atmosphere 373 shown in FIG. 16C. Flow to the atmosphere 373 takes place between manifold 370 and motor mounting plate 371. Because of the ability to provide control of three way air flows as described, embodiments making use of spool valves are preferred over embodiments which attempt to make use of poppet valves, or other forms of valves which rise perpendicularly to or from their seats. Use of "V" shaped slots in the valve spool bore allows fine control of air flow due to the gradual opening of the air port which is provided by such slots.

In the preferred embodiment, cavity 405 of the valve block assembly shown in FIGS. 16A–16C and 17 is modified to allow insertion of a nylon thumb screw 408 shown in FIG. 16C to limit opening motion of valve spools 400 under control of valve motors 382 and 383. These motors and their respective assemblies control air flow into and out of turning bladders 129–132 and the thumb screw 408 maintains the valve spool 400 position within the region of control of air flow. Maintenance of the region of control is necessary for the efficient operation of rotation function control algorithm 235 shown in FIGS. 26A–26E and detailed further herein.

Figure 19:
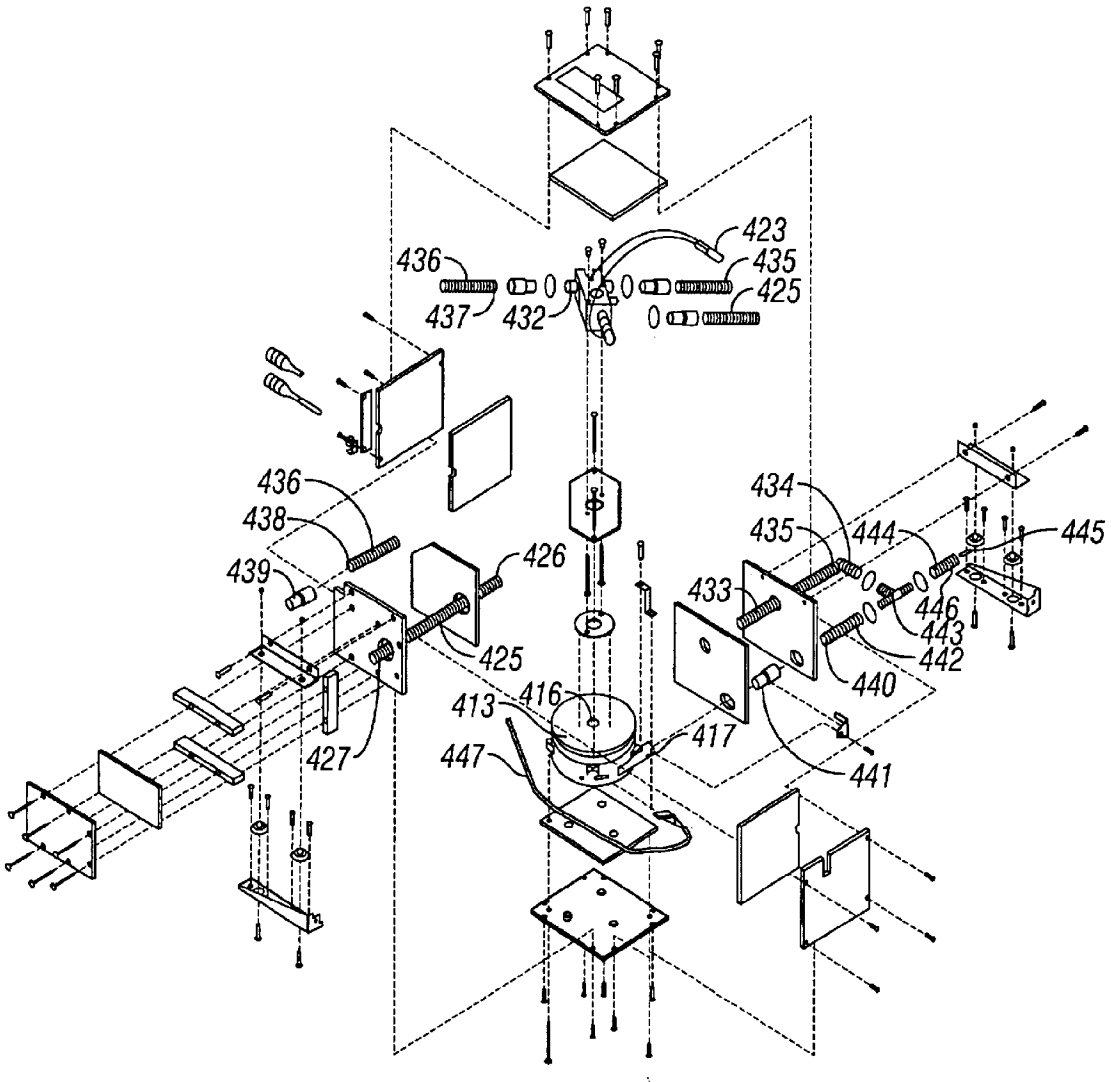
FIGS. 19 and 20 show two exploded perspective views of subsystems of the preferred embodiment.
Figure 20:
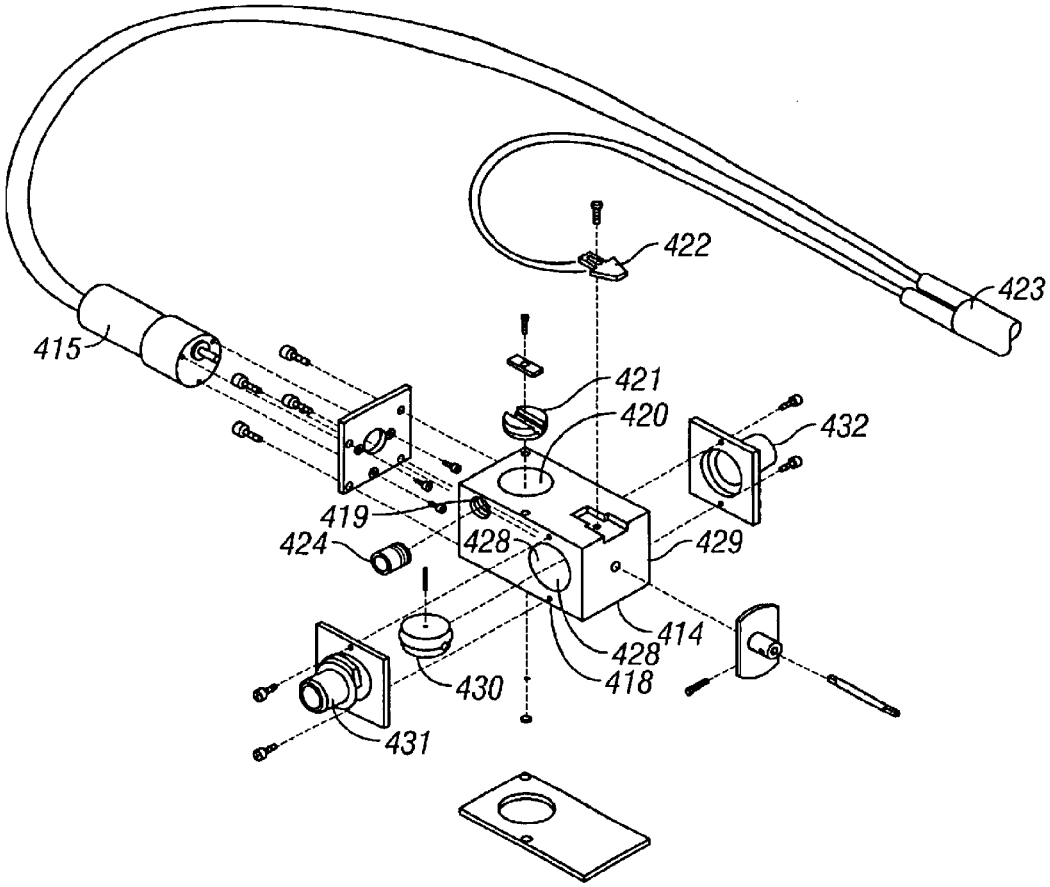

Referring to FIG. 19, the percussor system of therapeutic bed 30 is shown to generally include blower 413, valve block 414 (also referred to as "percussion body 414"), itself detailed in FIG. 20, and motor 415. Blower 413 is powered by an internal three speed alternating current motor. Said motor is controlled by an internal circuit board in response to inputs received through direct current channels. Said direct current channel is through transmission line assembly 447 as is also alternating current power for the internal motor. The three speeds of blower 413 allow three levels of intensity for percussion as will be evident further herein. High vacuums are introduced by the operation of the percussor system necessitating that motor 415 be of the type referred to in the industry as gear head. Gear head motors have high power per size ratios.

Referring now to FIG. 19 and detail FIG. 20, the air flow path through the percussor apparatus is described. Disruption of flow by valve block 414 is disregarded for purposes of this illustration. Fresh air enters the system through open end 427 of air hose 425. End 426 of hose 425 delivers said air to valve block port 419 through fitting 424. Fresh air entering valve block port 419 subsequently exits valve block 414 through port 418. Valve block 414 and blower 413 are aligned and mated such that flow from port 418 of valve block 414 is directly into port 416 of blower 413. Air exits blower 413 through port 417 into air hose 440 through fitting 441. End 442 of air hose 440 delivers said air to "T" fitting 443. From "T" fitting 443, air may travel in either of two paths. As description further herein will make clear, air from blower 413 will flow into the path guided by air hose 446. End 444 of air hose 446 receives said flow from "T" fitting 443. End 445 of air hose 446 connects to percussion bladder 158 shown in FIG. 7. Percussion bladder 158 is generally positioned beneath the chest area of patient 81. It is specifically preferred that percussion bladder 158 be positioned between the clavicle and the Xiphoid process of patient 81. Sharp, periodic inflation of said percussion bladder 158 loosens phlegm in the lungs of a bed ridden patient. Such percussion treatment is well known in the art. Percussion bladder 158 is generally impermeable and has only the inlet and outlet provided by air hose 446 for inflation and deflation. Air returning from percussion bladder 158 flows from air hose 446 into "T" fitting 443. As will be apparent further herein, return flow from percussor bladder 158 will flow from "T" fitting 443 into the path guided by air hose 435. Return flow enters air hose 435 through end 434 connected to "T" fitting 443. Return air is delivered from end 433 of air hose 435 into valve block port 428 through fitting 431. Return air entering valve block port 428 subsequently exits valve block 414 through port 429. Return air exiting port 429 enters end 437 of air hose 436 through fitting 432. Return air is exhausted from end 438 of air hose 436 into fitting 439. Fitting 439 connects directly to a muffler apparatus similar to that used in automobile exhaust systems, not shown herein.

Referring specifically to FIG. 20, it is noted that the fresh air flow path and return air flow path through valve block 414 are in perpendicular orientation. Further it is noted that valve disks 421 and 430 are co-planar. Valve disks 421 and 430 are rotated by gear head motor 415. The orientation described ensures that while one of either the fresh air or return air flow paths is open the other is closed. When the fresh air path is closed, a negative pressure differential arises between the port inlet 416 of blower 413 and percussion bladder 158 which is open through the return air path to the exhaust. When the fresh air flow path opens and the exhaust path simultaneously closes, the said pressure differential causes a sharp inflation of percussion bladder 158 as is therapeutically desired. The power of the gear head motor 415 is required to ensure this pressure differential does not cause valve disk 430 to stick or bind. Faster operation of blower 413 causes increased intensity of the percussion treatment given.

Still referring to FIG. 20, an infrared emitter and receiver pair 422 is provided for measurement of percussion frequency provided by gear head motor 415. Said measurement is transmitted through cable 423 for processing. Necessary adjustments are made by varying the direct current voltage provided to gear head motor 415, also through cable 423. Through this feedback system, precise user selectable frequency of percussion is generated as may be required for a particular patient case.

Figure 28A:
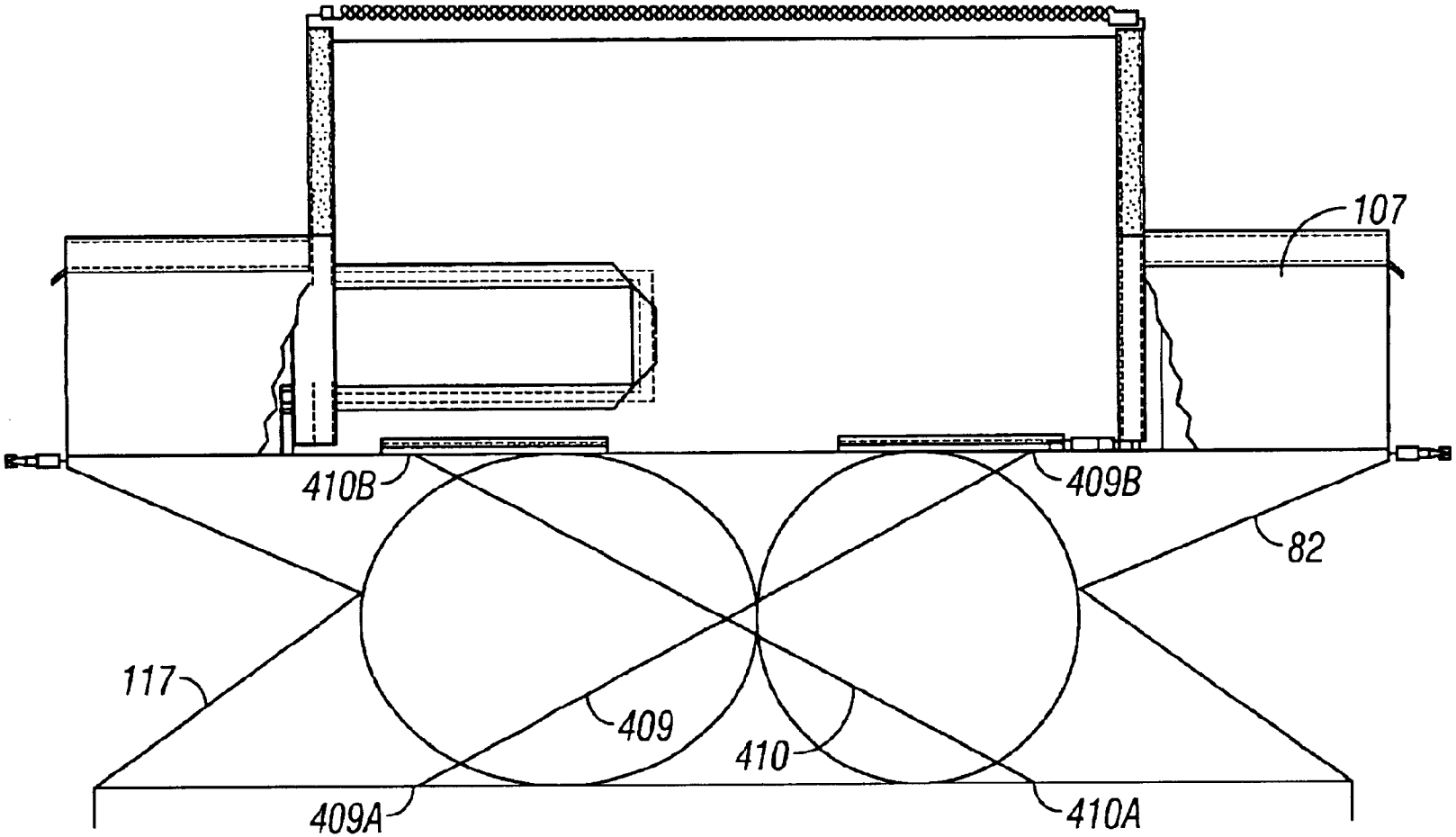
FIGS. 28A and 28B show two views of the particular features of the mattress system 29.
Figure 28B:
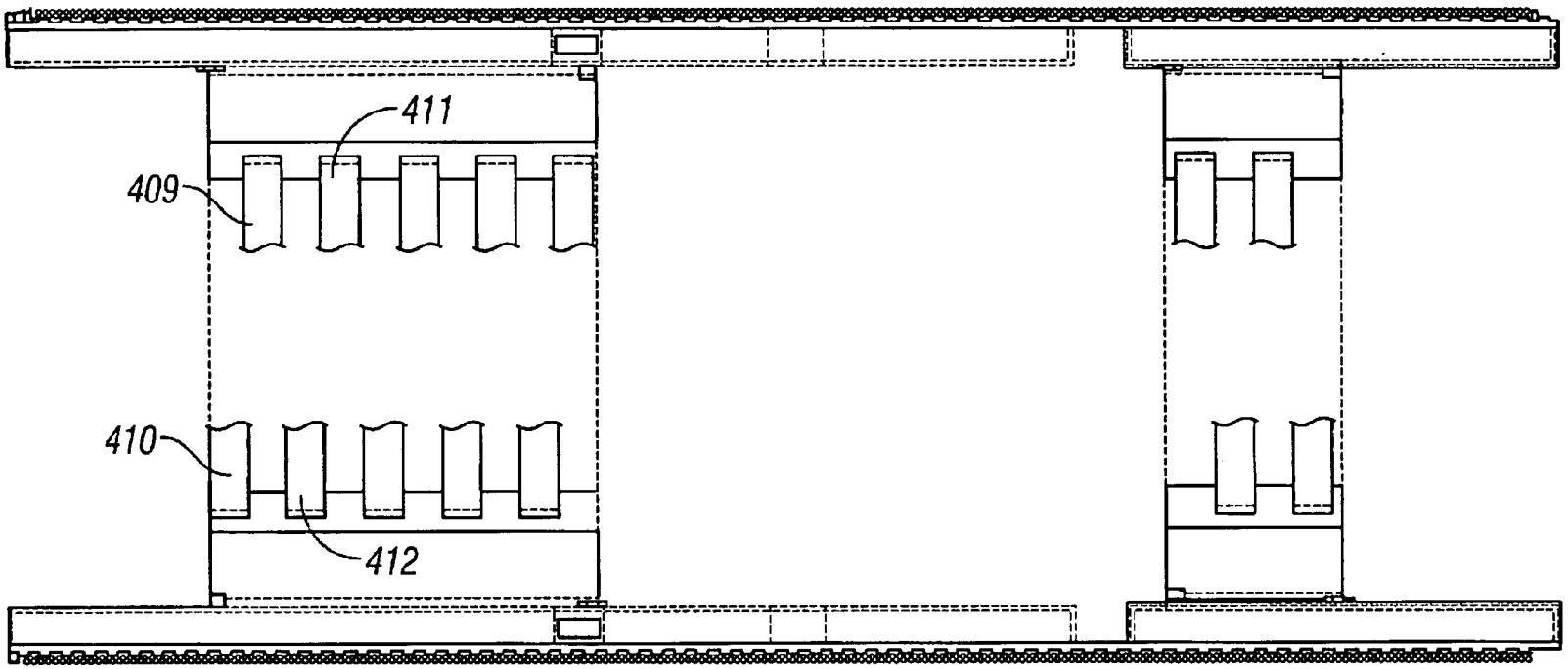

Referring to FIGS. 28A and 28B, there is shown a hinging system wherein a plurality of straps, such as 409–412, comprised of heavy duty webbing are arranged in a criss-cross fashion along the longitudinal axis of the patient support sub-frame 32 platform 137 (as will be described further herein with reference to FIG. 6). One end of each strap, such as 409*a* and 410*a,* is connected in alternating fashion to the platform 137 on first the right side and next on the left side of patient 81 and continuing like so longitudinally. The opposite end of each strap, such as 409*b* and 410*b,* is connected to the underside of patient support bladder containment structure 107 on first the left side and next on the right side of patient 81 and continuing like so longitudinally. The hinging system is intentionally left without a fixed articulation point so as to allow rotation of patient support surface 33 without lateral translation. This system does in fact resist lateral motion of patient support surface 33. Those skilled in the art of design and manufacture of therapeutic treatment beds will quickly recognize many alternate materials for the construction of hinges 409–412 such as plastic bars, metal plates, wooden slats or other fabric materials. The preferred embodiment makes use of heavy duty webbing such as that commonly found in automobile passenger restraint systems. This material is not only radiolucent, but is readily available, of high strength and of high manufacturability.

Referring to FIG. 5, turning bladders 129 and 130 are shown to each be provided with a zipper 133 and 134, respectively. Zippers 133 and 134 allow longitudinal attachment of turning bladders 129 and 130 to the underside of patient support bladder containment structure 107. Such connection of turning bladders 129 and 130 to structure 107 prevents lateral dislocation of bladders 129 and 130 during rotation of patient support surface 33.

Figure 18:
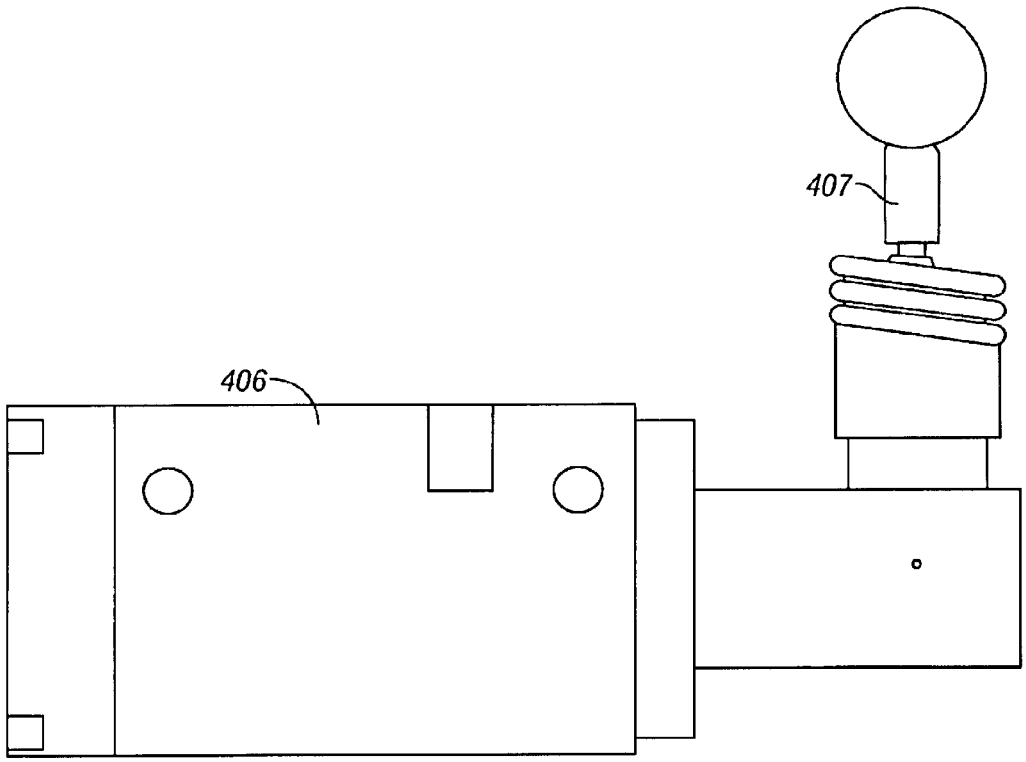

Referring to FIG. 18, there is shown a three position air valve switch 406 which allows air from tubes 374 and 375 (shown in FIG. 15A) of the valve block assembly to be switched in order to selectively enable standard rotation, no leg rotation or counter rotation according to the position of lever 407. In the preferred embodiment, the selectable positions of lever 407 are marked with "II" for standard or in-line rotation, "O" for no leg rotation and "X" for counter rotation. As a matter of standard practice, it is preferred that the care giver verify that kinetic therapy adjustment lever 407 is correctly set for the kinetic therapy prescribed during preparation for patient 81 placement on bed 30. When lever 407 is in the position indicated for standard rotation, tube 374 is connected via switch 406 and through connectors 163, 172 and 174 to air hoses 159, 168 and 170, respectively, shown in FIGS. 8 and 9, and tube 375 is connected via switch 406 and through connectors 162, 173 and 175 to air hoses 160, 169 and 171, respectively. The effect of selecting standard rotation is that both patient support head and torso sections 33*a* and 33*b* and patient support legs section 33*c* rotate in the same direction. Lever 407 may be placed in a no legs rotation position in which case tube 374 connects via switch 406 and through connectors 163 and 172 to air hoses 159 and 168, respectively, and tube 375 connects via switch 406 through connectors 162 and 173 to air hoses 159 and 169, respectively. The effect of selecting no legs rotation is that patient support legs section 33*c* remains stationary while the patient support head and torso sections 33*a* and 33*b* rotate. Lever 407 may also be positioned in a counter rotation position. In counter rotation, tube 374 is connected via switch 406 and through connectors 163, 172 and 175 to air hoses 160, 168 and 171, respectively, and tube 375 is connected via switch 406 and through connectors 162, 173 and 174 to air hoses 159, 169 and 170, respectively. The effect of counter rotation is that the patient support head and torso sections 33*a* and 33*b* rotate in opposite direction as does the patient support legs section 33*c*. Utilization of counter rotation promotes maintenance of patient 81 position upon patient support surface 33 and also allows a more natural bending of the patient's 81 body during turning. This provides increased patient 81 comfort, security and feeling of stability. Note that in all three rotation modes the patient restraint bladders 108–111 inflate on the side to which the head and torso of patient 81 are rotated, providing increased positional support of patient 81 and further preventing patient 81 from rolling out of bed 30.

The combination of the hinging system, bladder attachment system and counter rotation system described herein allows the preferred embodiment of patient treatment bed 30 of FIG. 1 to attain higher turning angles than previously available on an air surface, and yet simultaneously promote increased stability of patient 81 position and increased patient 81 comfort.

Figure 21:
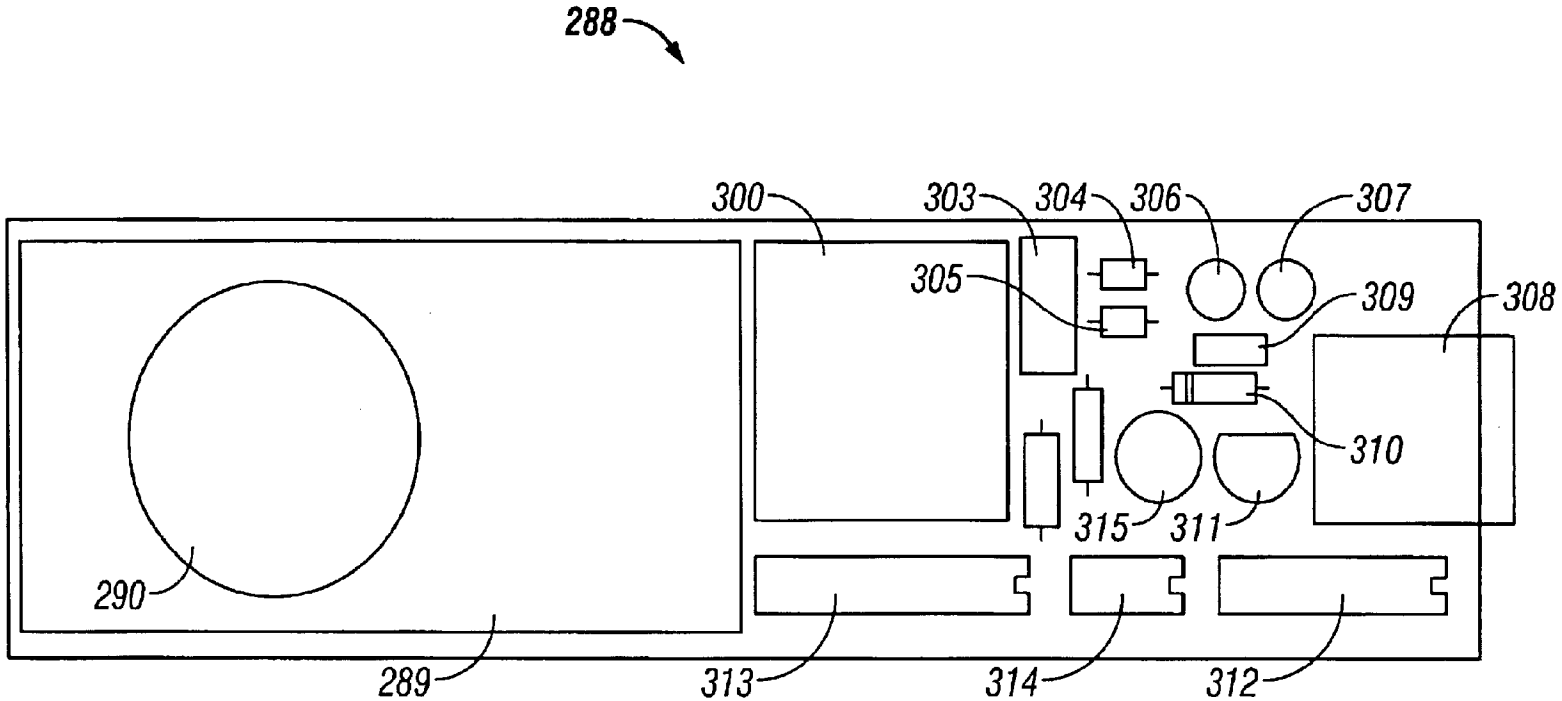
FIGS. 21–24 show various views relating to the angle sensor of the preferred embodiment, including a block control diagram shown in FIG. 22.
Figure 22:
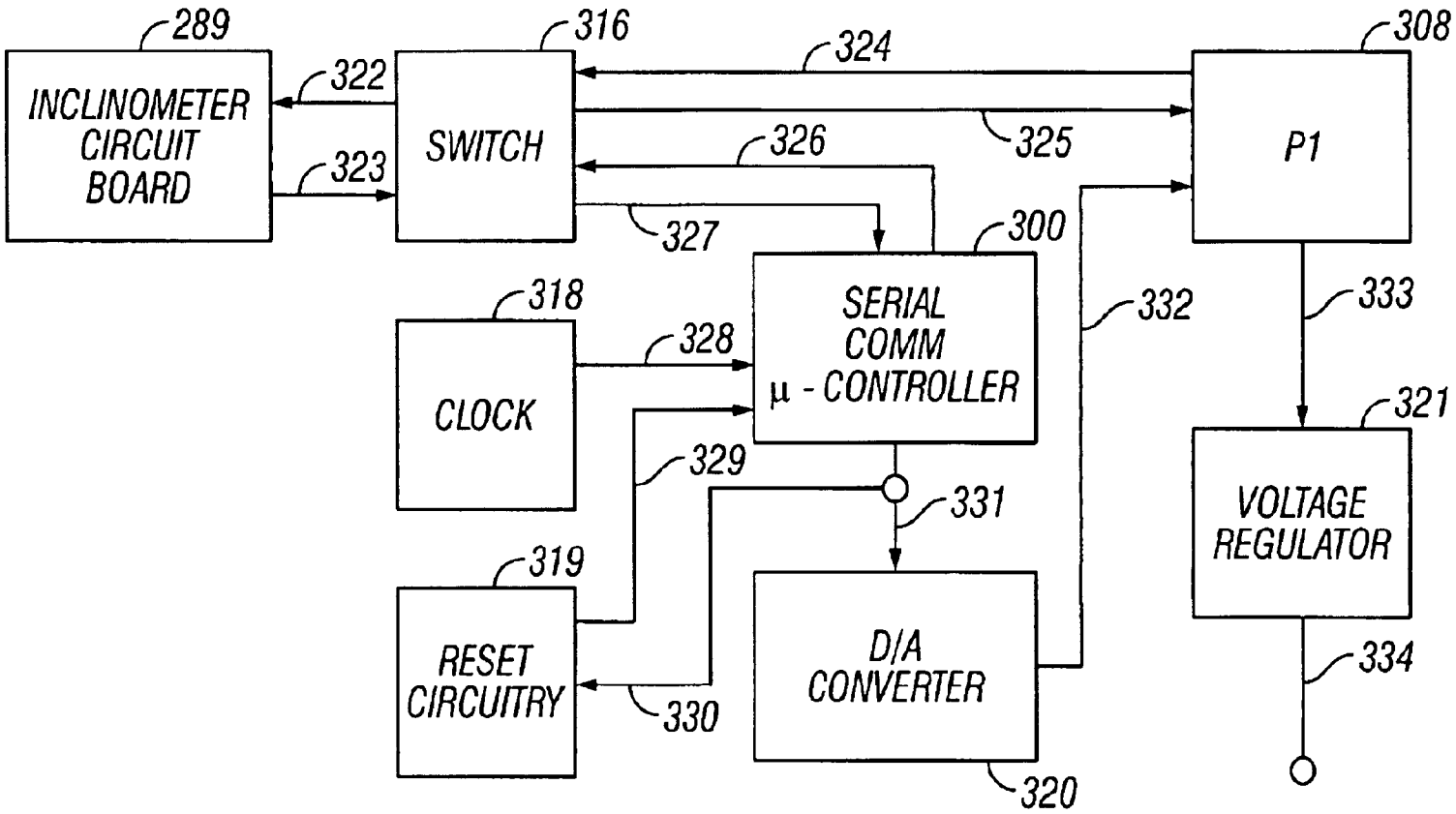

The patient rotation angle sensing system generally includes an angle sensor unit 288 and angle sensor housing 155. Referring to FIGS. 21 and 22, the angle sensor unit 288 is shown to generally include an inclinometer circuit board 289, serial communications controller 300 with clock circuity 318 and reset circuitry 319, a digital to analog converter 320, an external interface plug 308, on-unit voltage regulator 321 and electronic switch 316. The inclinometer circuit board 289 which is commercially available from Macklanburg-Duncan in Oklahoma City, Okla. under trademark "SMART LEVEL," itself includes inclinometer 290. Serial communications controller 300 includes an "INTEL 8751" (a trademark of Microsoft) type micro-controller, which is a four port eight bit input/output micro-controller with on chip memory and counter. Controller 300 receives 328 clocking from clock circuitry 318 comprising crystal 303 and capacitors 304 and 305. In the preferred embodiment, crystal 303 is resonant at 11.059 MHz. Reset is provided 329 to controller 300 from reset circuitry 319 including an integrated low power monitor 314 with watchdog capability for monitoring 330 connection 331 between controller 300 and digital to analog converter 320. Digital to analog converter 320 comprises a twelve bit precision integrated circuit converter 313 with manufacturer's specified compensation network including resistor 301 and capacitors 306 and 307. Interface to external circuitry is provided through plug 308 which is a six pin telephone type receptacle connector. Diode 310 and capacitor 315 provide an isolation filter for unregulated voltage arriving 333 from plug 308 to voltage regulator 321. Regulator 321 which further comprises integrated circuit 311 and capacitor 306 provides 334 regulated five volt supply to all angle sensor unit 288 components as required. Switch 316, comprised of a quad two to one line integrated circuit 312, maintains direct digital communication through external plug 308 and inclinometer circuit board 289 via connection of communication paths 324 and 325 to 322 and 323, respectively or analog communication by connection of paths 326 and 327 to 322 and 323, respectively. The digital or analog option will be apparent further herein. Pull-up resistor 309 serves as a current limiter into an open gate of switch 316 integrated circuit 311 which is tied high under manufacturer's specification.

Figure 23:
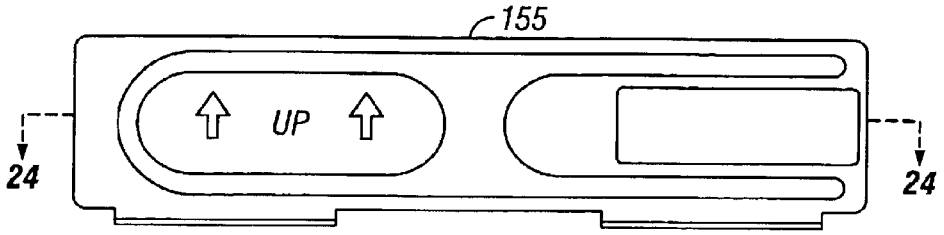
Figure 24:
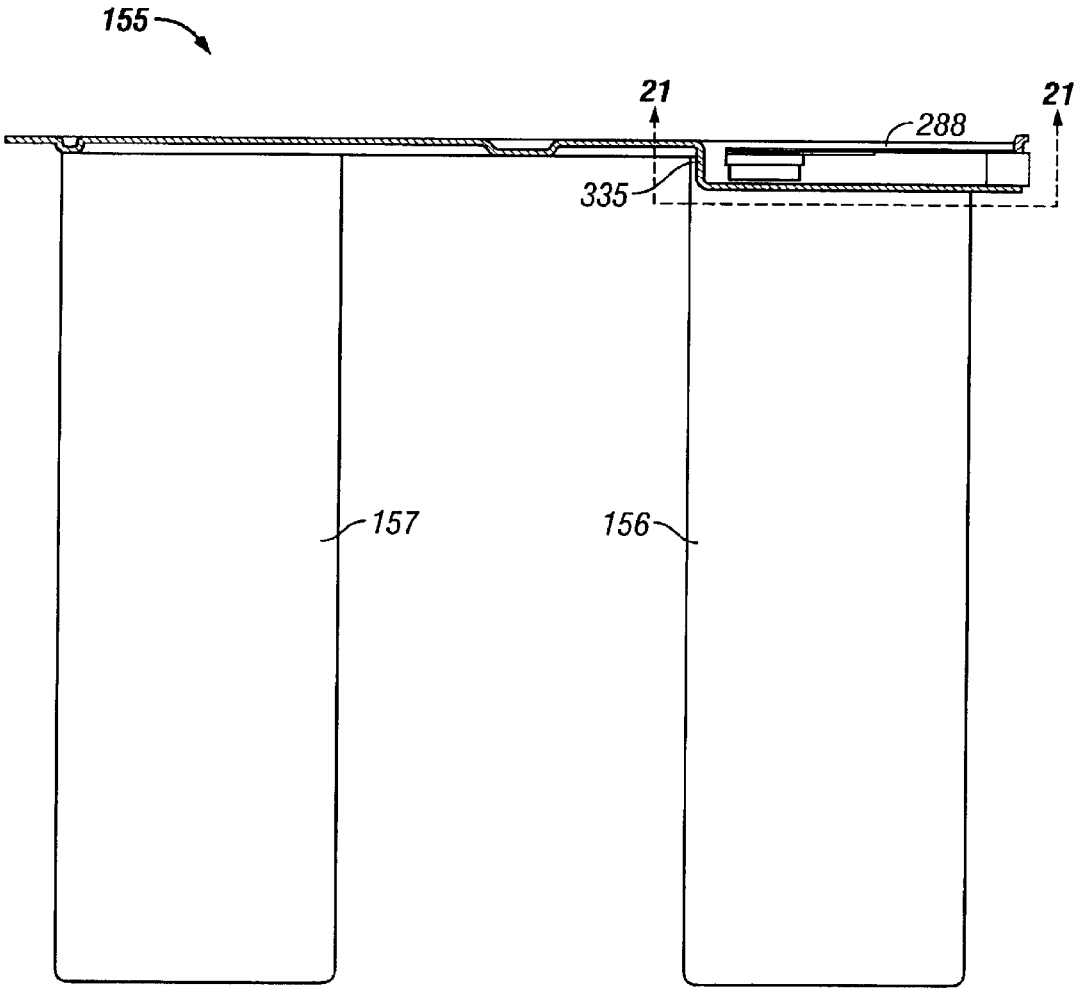

Referring to FIGS. 23 and 24, there is shown an angle sensor housing 155. The housing 155 is comprised of molded plastic which is both easily fabricated and radiolucent. Many other materials will be apparent to those skilled in the art of therapeutic bed design and manufacture. Housing 155 is comprised of recessed area 355 for mounting of angle sensor unit 288 (as shown in FIG. 21). In the best mode, housing 155 is further comprised of flanges 156 and 157 which slide into sleeves in cover sheet 233 under the patient support air bladders 83–86 on the head end 33*a* of patient support surface 33 as shown in FIGS. 6 and 7. Mounting of flanges 156 and 157 in sleeves prevents torquing of housing 155 thus promoting accurate measurements by angle sensor unit 288 during rotation. Referring to FIGS. 5 and 6, rotation angle sensor housing 155 is held in place within bladder containment structure 107 by flap 142 which bends about line 143 and is held closed by zipper 144. It should be noted that it is only necessary that flanges 156 and 157 of housing 155 be radiolucent as the remaining structure of housing 155 is not in the line of X-rays taken of patient 81. This may be beneficial in cases where it is found necessary to use materials in the area about recess 355 which are necessarily not radiolucent in order to provide radio frequency interference shielding of angle sensor unit 288.

Figure 29:
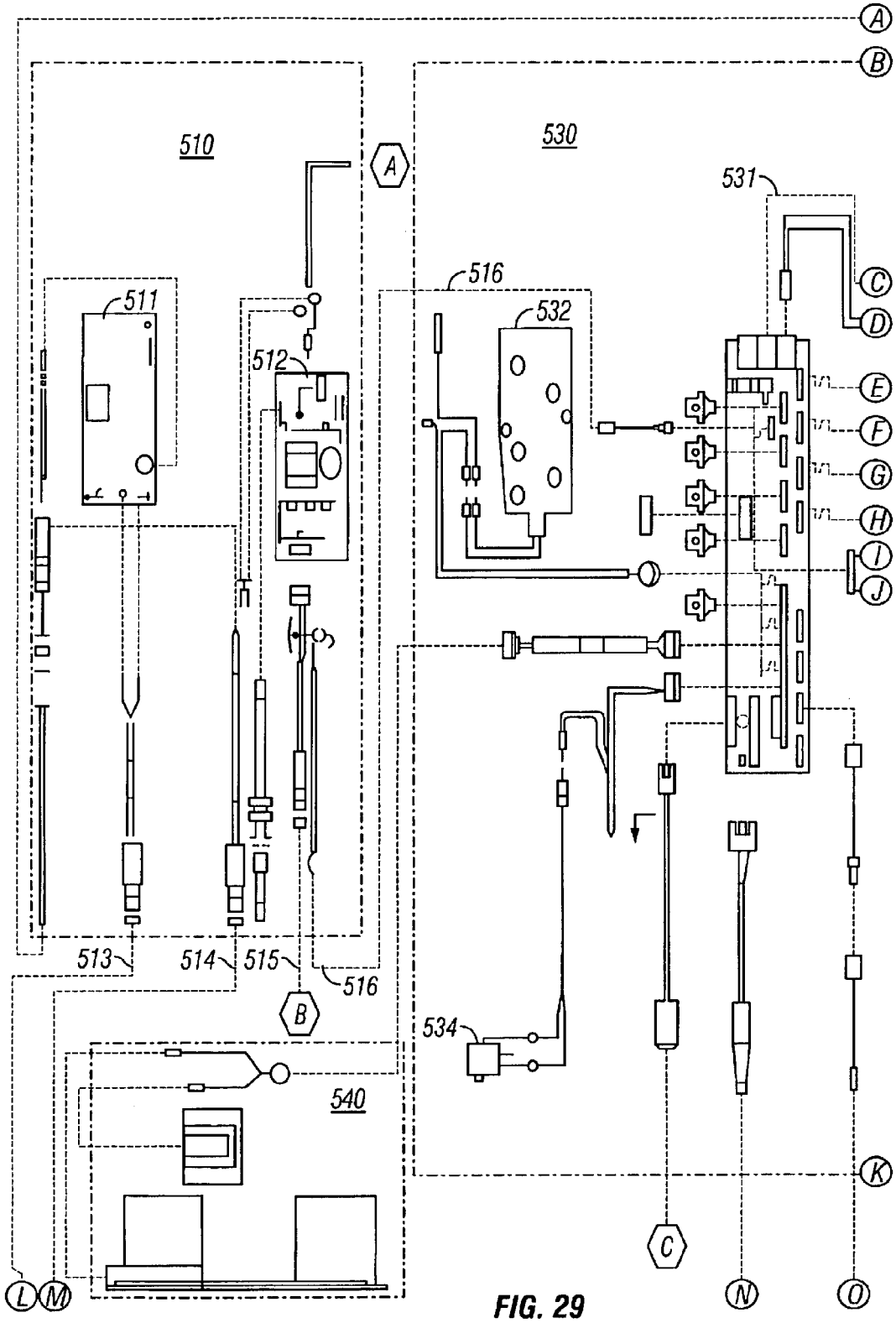
FIG. 29 shows a schematic layout of major electrical components of the preferred embodiment.
Figure 29:
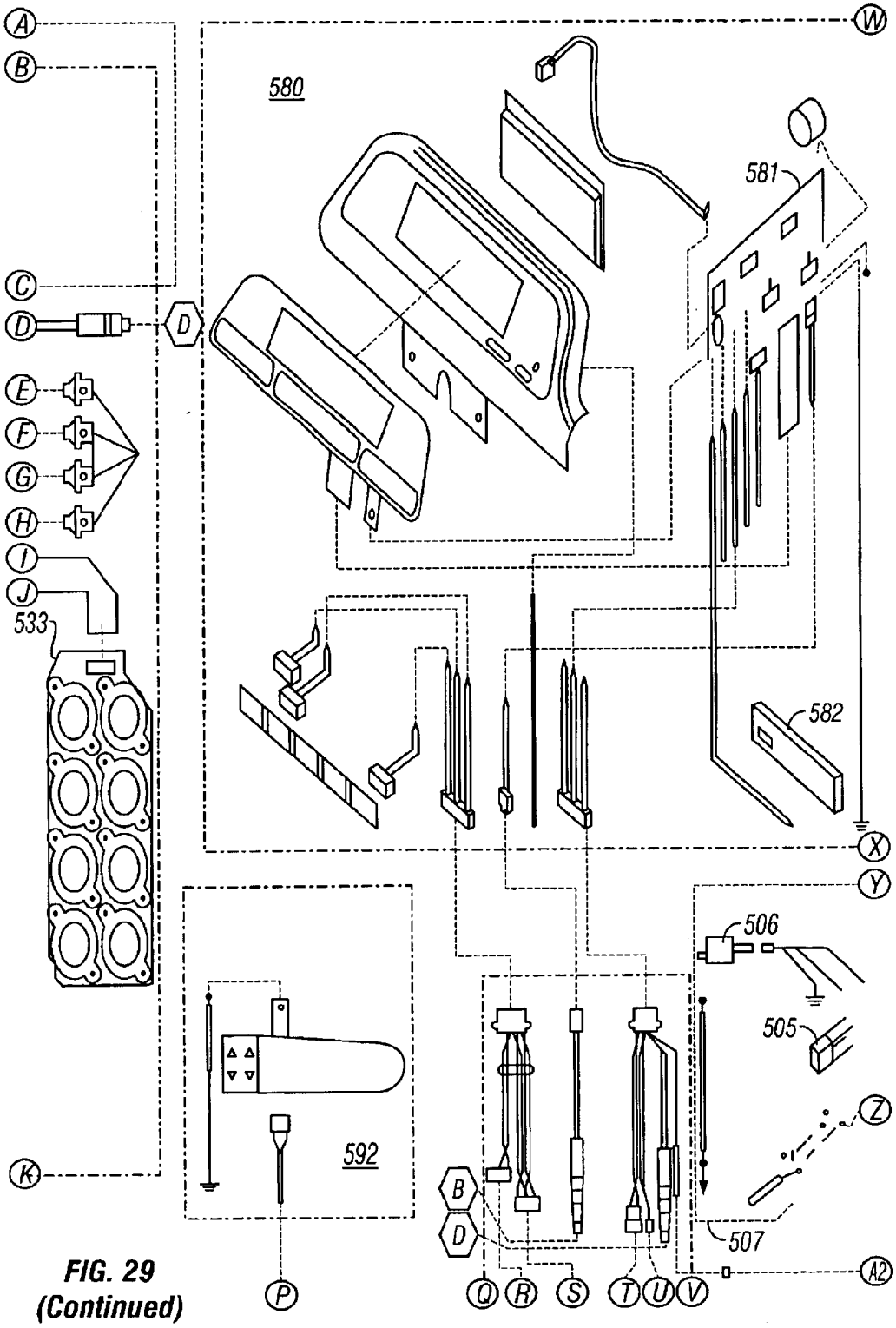
Figure 29:
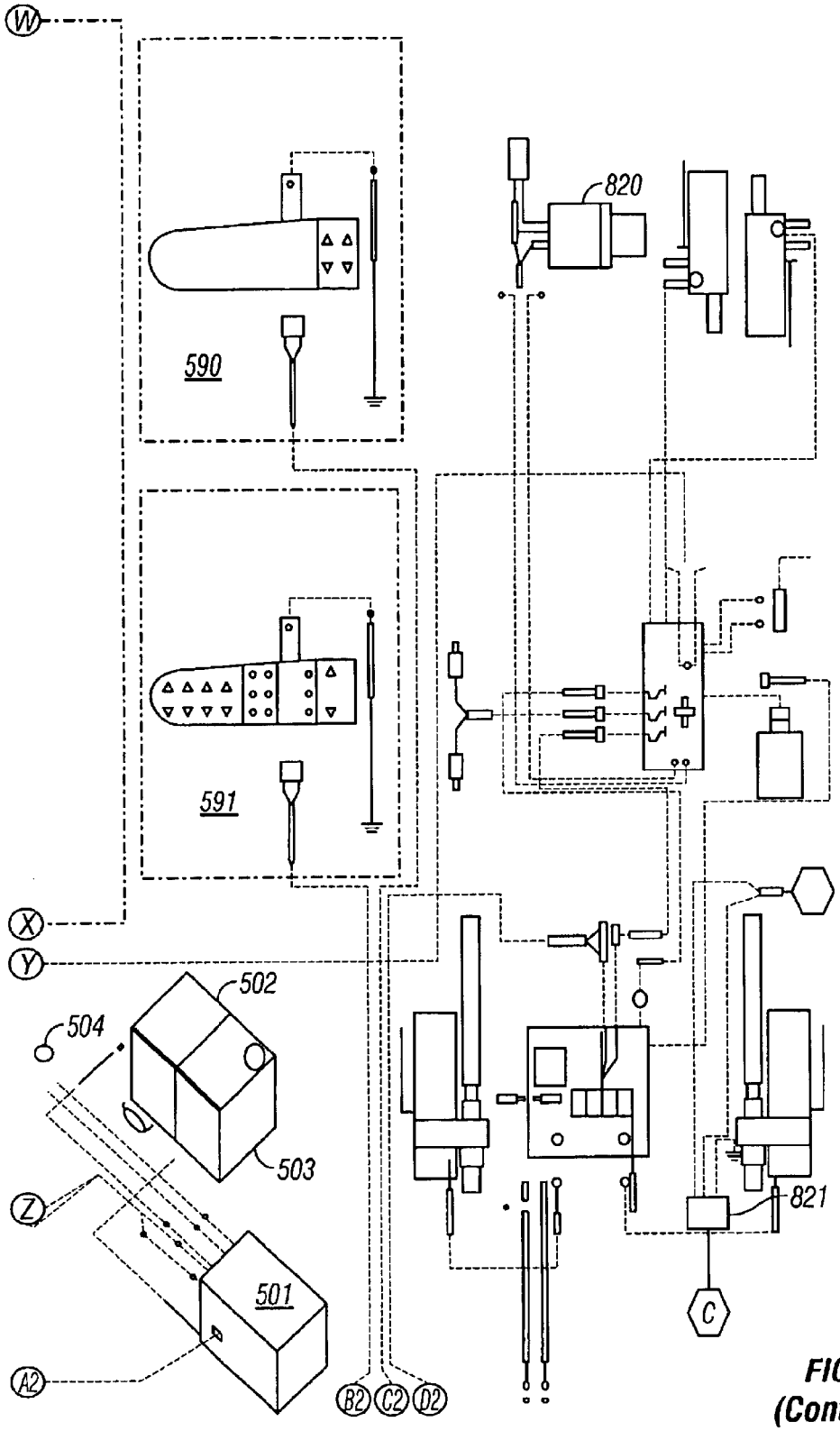
Figure 29:
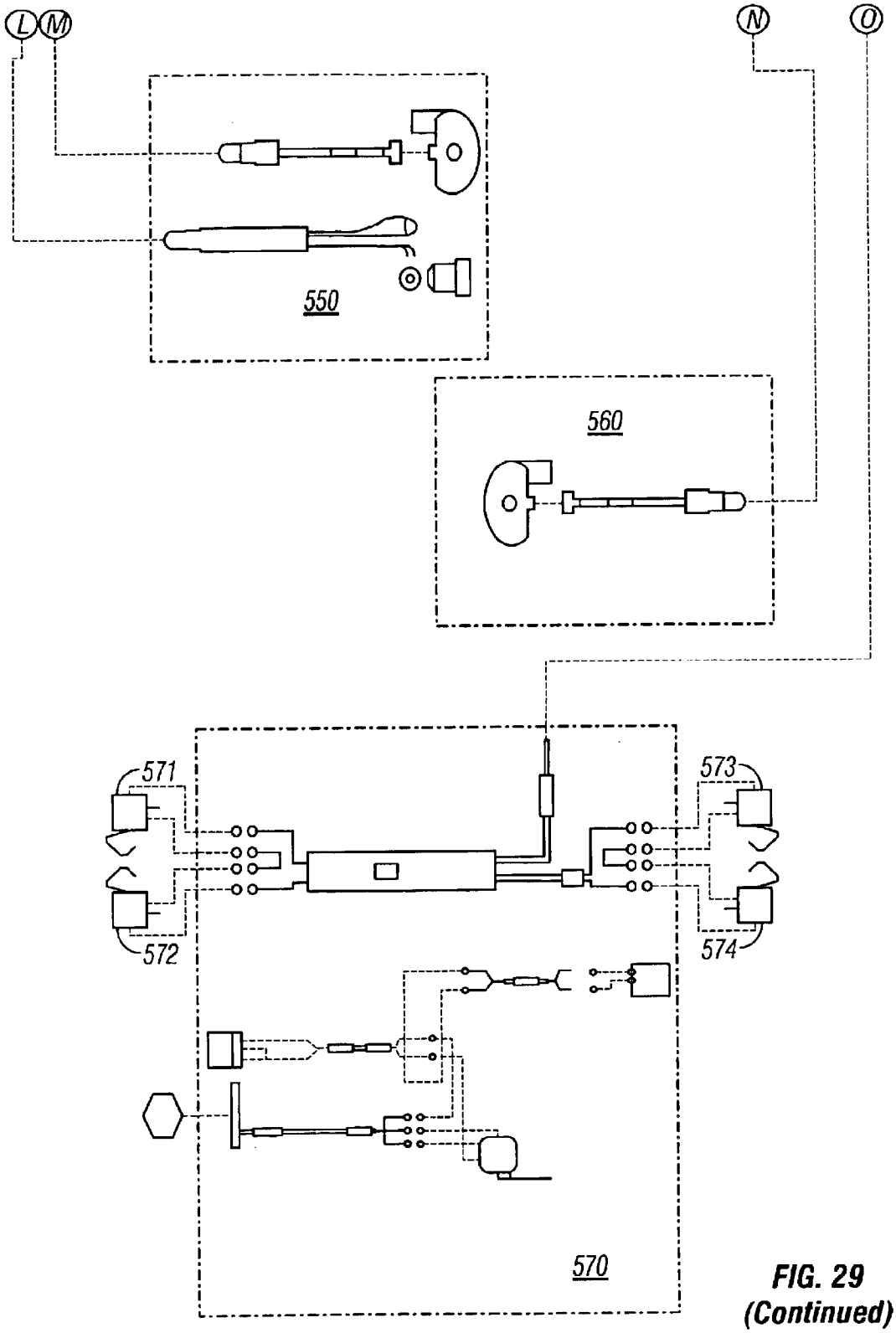
Figure 29:
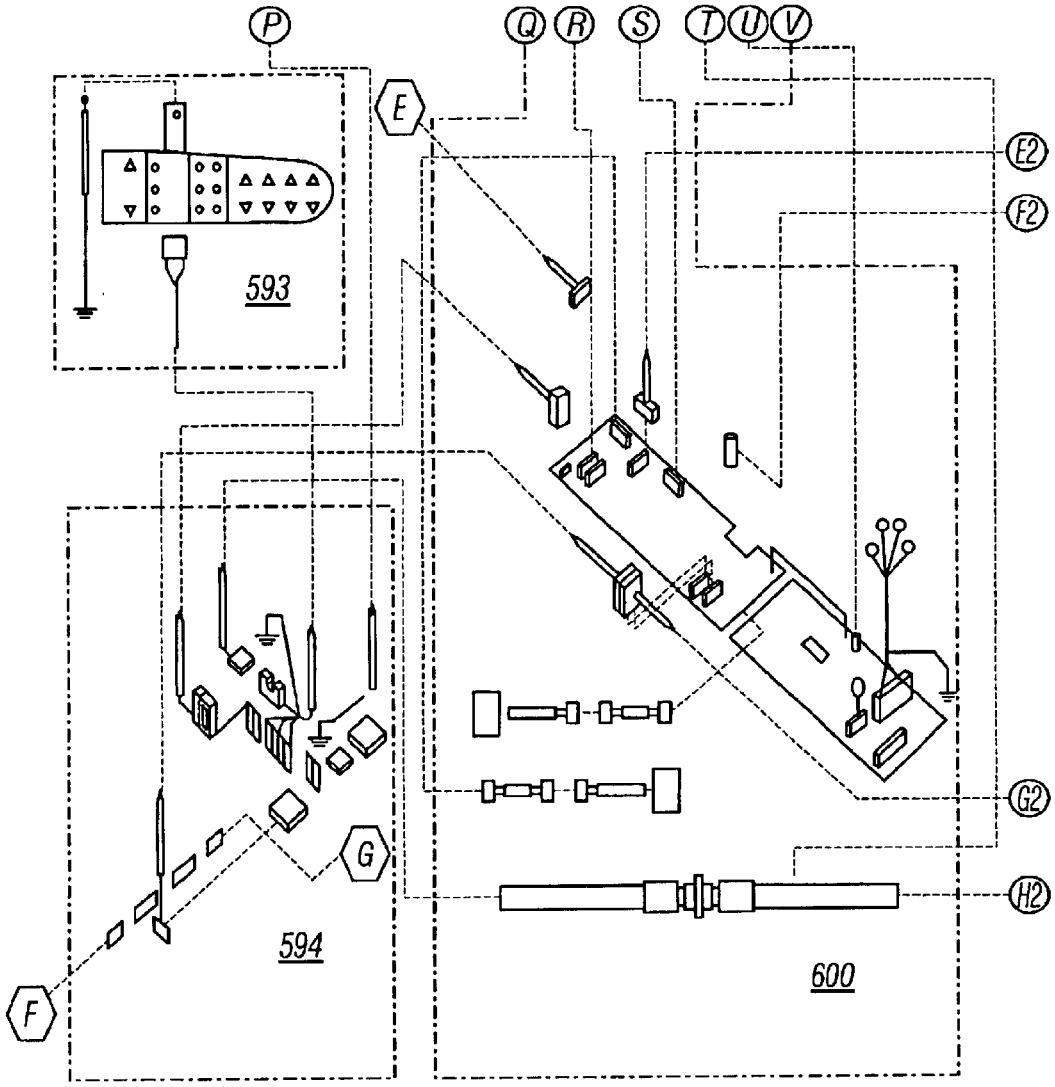
Figure 29:
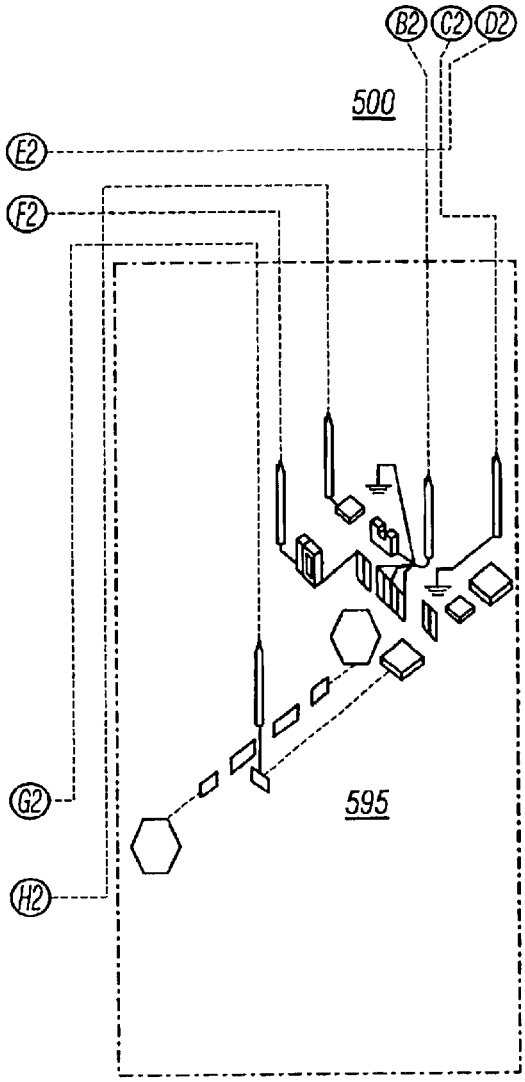
Figure 29:
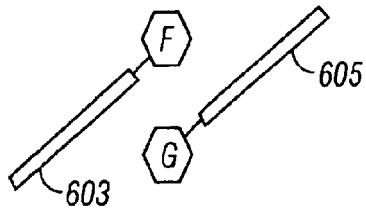
Figure 29:
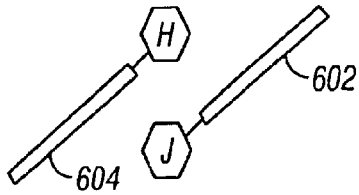

Referring to FIG. 29, a schematic layout of the major electrical components of bed 30 is shown. Such components can be subdivided into various subsystems, namely, lower frame assembly 500, power supply assembly box 510, valve assembly box 530, angle sensors 540, percussor assembly box 550, blower assembly box 560, CPR assembly 570, footboard assembly 580, side rail assemblies 590–593, cable interface box 594 and 595, lower footboard enclosure 600, and various other Stryker Model 2020 components 620.

Lower frame assembly 500 includes a power inverter 501, rechargeable batteries 502–503, circuit breaker 504, relay 505 and connecting brackets and the like, as shown in the lower frame assembly portion 500 of FIG. 29. Such components provide bed 30 with a standard AC power supply and, alternately, an AC-like power supply from the rechargeable batteries. The power inverter 501 is connected in series with the standard AC power cord 506, which enters the foot end of bed 30 in conventional manner. Power cord 506 is a conventional 115 VAC, hospital-grade power supply cord. It is desired that power cord 506 be only plugged into a properly grounded 115 VAC wall outlet. The inverter operates to recharge the batteries 502–503 while power is being supplied to the remainder of bed 30 from power cord 506. Then, when power cord 506 is unplugged, the inverter 501 operates to utilize the battery power for producing an AC-like signal for operating bed 30. Such power inverter 501 and batteries 502–503 are generally capable of sustaining operation of bed 30 for a period of roughly two hours during a power outage and/or transport.

Power from the lower frame assembly 500 is directed through power line 507 to the pre-existing components 620 of the Stryker frame 28, in the same manner as though not adapted with lower frame assembly 500. Such components 620 are substantially as provided in the commercially-available version of the Stryker Model 2020, Critical Care Bed of Stryker's Renaissance Series, although AC power is diverted therefrom at reference points "A" and "C." A 10-Amp fuse is also added in connection with the power supply tapped at reference point "C."

The AC power tapped at reference point "A" is provided directly to the power supply assembly box 510, which includes the percussor control board (or "KPAC") 511 and the power supply board 512. The percussor control board 511 produces (in combination with the power supply board 512) power and control signals for operatively actuating the percussor assembly box 550. Such power and control signal is provided through lines 513–514, as is shown. The power supply board 512, which serves to convert AC power to 5-volt and 12-volt DC power, provides 12-volt signals to the valve assembly box 530 (through line 516) and to the percussor assembly box (through line 514). The 5-volt signal is provided to the master board which is included within the footboard assembly 580 (referring to reference point "B").

The valve assembly box includes a 16-sensor board (or "GACP") 531 and its related sensors (or "GAPCs"), a heater assembly 532 and valve assembly 533. The CPR door switch 534 is also included within the valve assembly box as it operates to disengage the power when the door to the valve assembly 533 is opened. The 16-sensor board 531 is also connected to the master control board 581 (included in footboard assembly 580), which together operate to control both the heater assembly 532, the valve assembly 533 and the blower assembly box 560, in response to feedback from angle sensors 540 and the other sensors connected to 16-sensor board 531. In addition to the CPR door switch 534, bed 30 includes CPR assembly 570, which is actuated by CPR handle referenced elsewhere herein. CPR assembly 570 also includes a plurality of switches 571–574 for signaling the 16-sensor board 531 and master control board 581 when a corresponding one of the four bed side rails is lowered. The master control board 581 is programmed to disrupt certain therapies, including rotation and percussion, upon lowering of the side rail, in response to a signal from switches 571–574.

Figure 25:
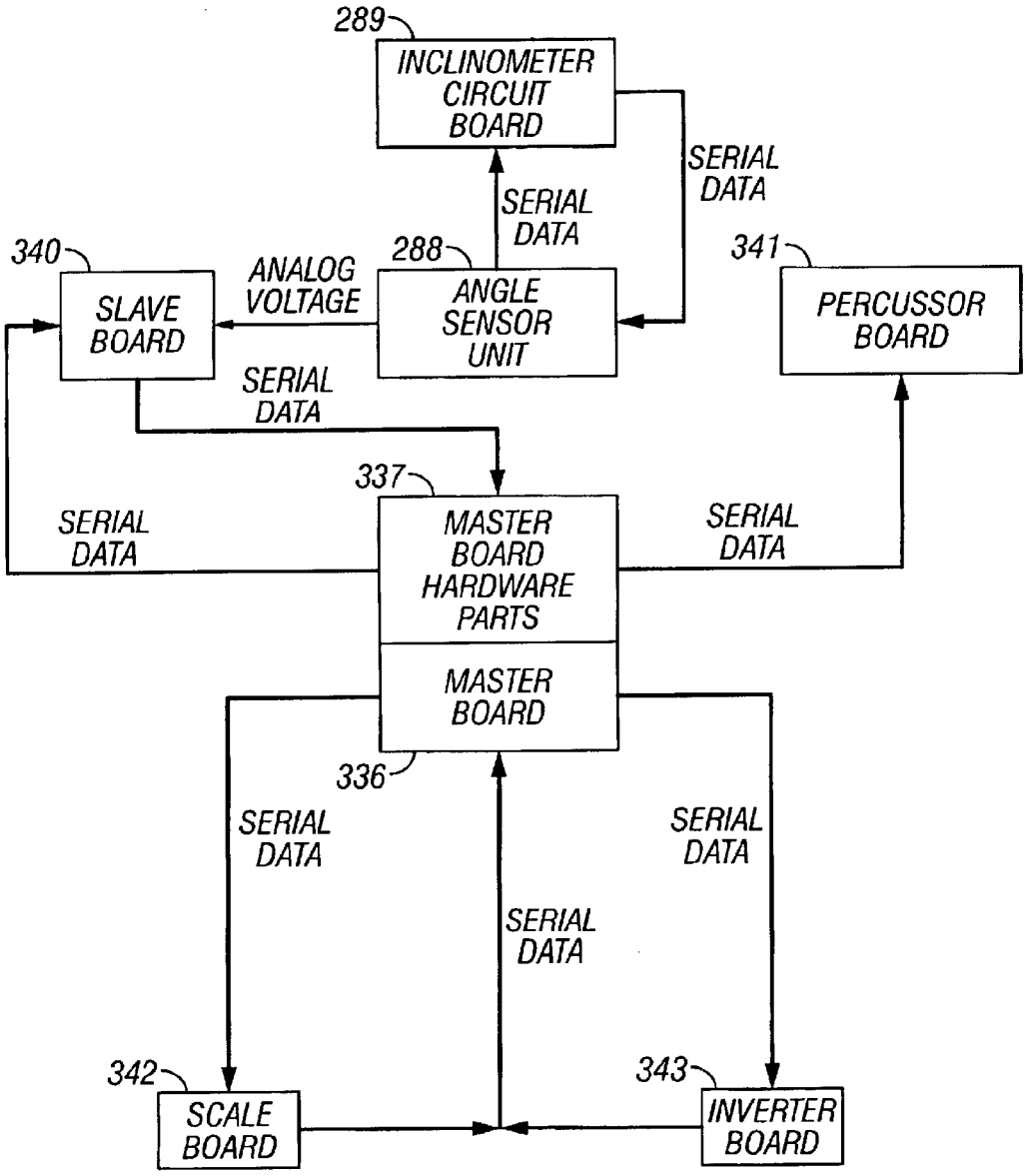
FIG. 25 shows a block diagram of the microprocessor communications for the preferred embodiment.

All digital communication in the preferred embodiment is carried out serially. The microprocessor communications structure of the patient treatment bed 30 of FIG. 1 is best shown in FIG. 25. Communication with slave board 340 and percussor board 341 is fully under the control of the master board 336 which effects its control though a plurality of hardware universal asynchronous receiver transmitters (UARTs). Such UARTs are included as Master Board Hardware Parts 337 of master board 336. The UARTs of master board 336 have two-way serial communication with the percussor board 341 and two-way serial communication with a slave board 340. Slave board 340 receives analog voltage from the angle sensor interface board 288 (shown in FIG. 21) referred to here as "angle sensor unit", which further includes the inclinometer circuit board 289. The master board communicates through a software UART directly with a scale board 342 and inverter board 343 which share a common return communications path.

Figure 27A:
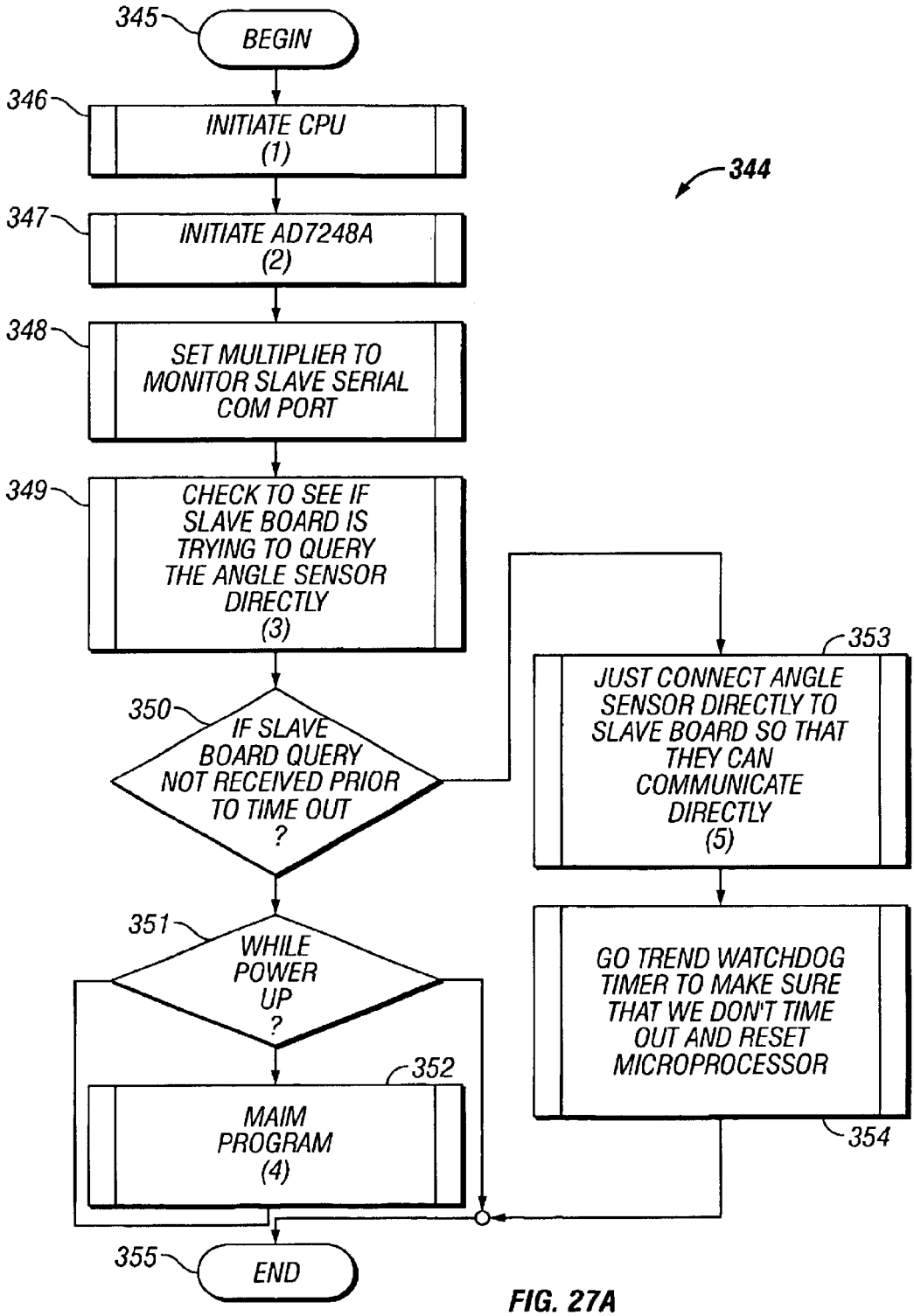
Figure 27B:
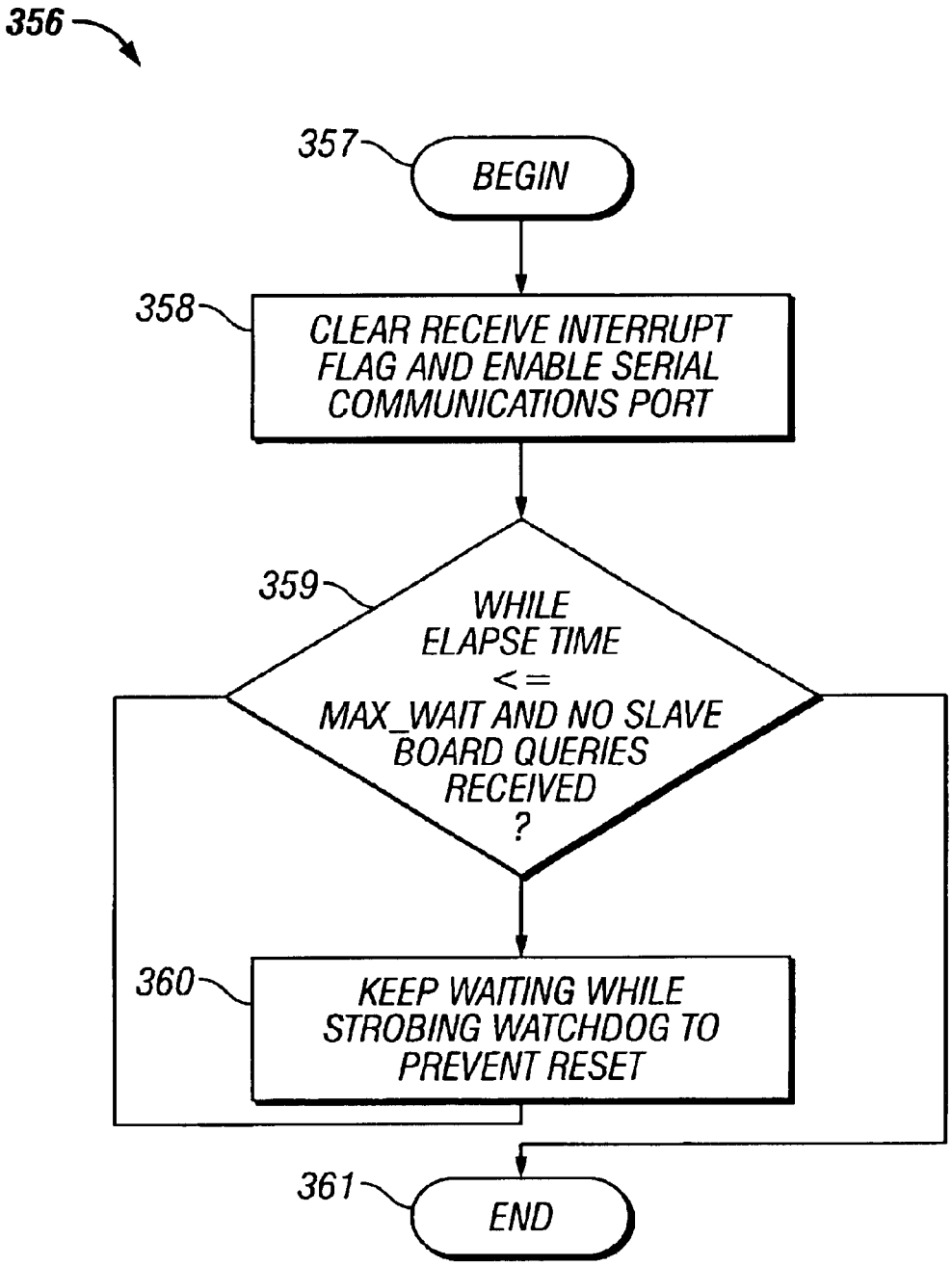
Figure 27C:
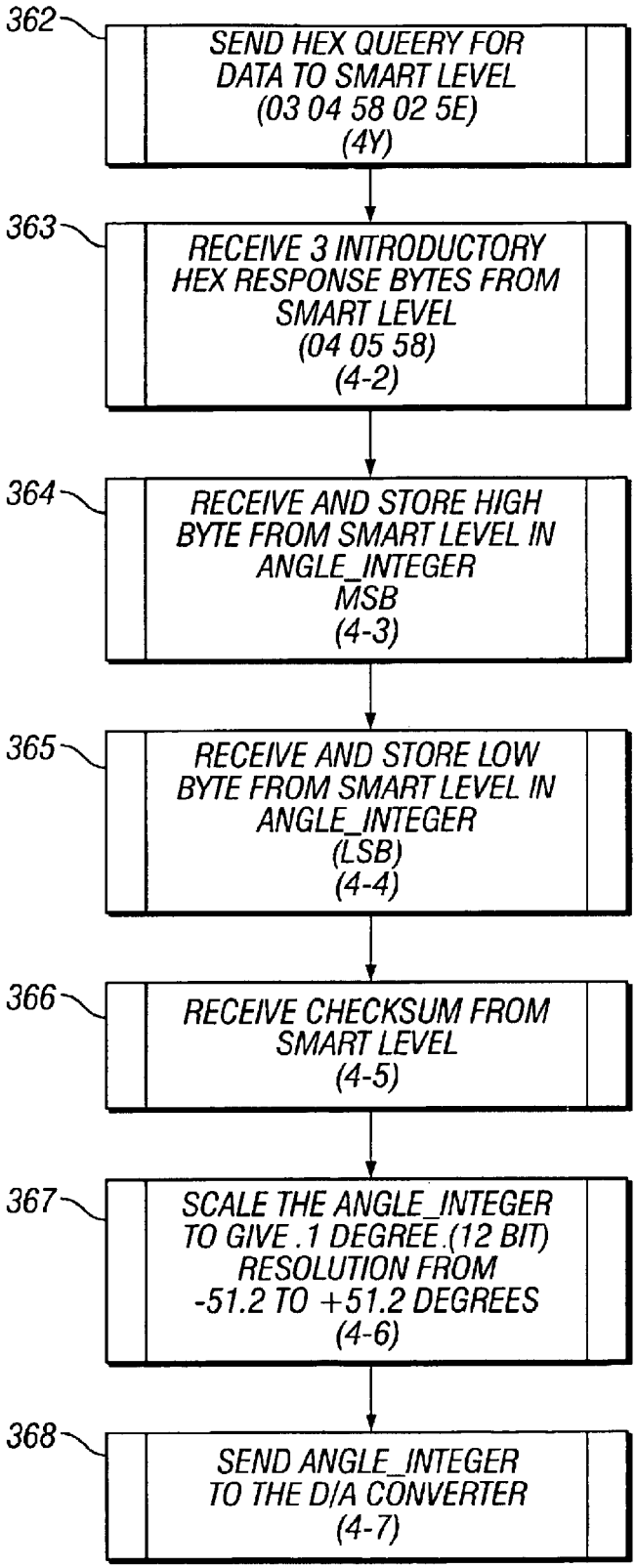

The high resolution rotation angle sensing algorithm 344 is best shown by FIGS. 27A–27C. This algorithm 344 allows for communication of rotation angle in either digital or analog format, allowing easy application in the widest variety of systems.

Upon initiation 345 of high resolution rotation angle sensing algorithm 344, the algorithm performs 346 initiation functions of serial communications controller 300 (as shown in FIG. 22) in which global variables are set as appropriate and communications are established at 9600 baud. The digital to analog converter 320, FIG. 22, is then initialized at step 347 in accordance with manufacturer's specification. Algorithm 344 then proceeds to step 348 wherein switch 316 is set to allow the serial communications controller 300 to monitor communication line 324 from plug 308 for the presence of serial communications, referenced herein FIG. 22. This monitoring takes place in step 349 of algorithm 344 as is expanded upon in FIG. 27B as sub-algorithm 356. Referring to FIG. 27B, sub-algorithm 356 launches and then enables the appropriate serial communications port of serial communications controller 300 to receive data. Upon initial entry to step 359 of sub-algorithm 356, a timer is started. So long as time elapsed is not greater than an established maximum value and no slave board 340 query has been received, the sub-algorithm 356 continues to strobe 360 the watchdog timer of reset circuitry 319 to prevent re-initialization of algorithm 344 and awaits a slave board 340 query. Upon reaching the maximum established counter value in step 359 without receiving a slave board 340 query, sub-algorithm 356 terminates 361 and returns to algorithm 344 at step 350.

In step 350 of algorithm 344, if no query was received in step 349 prior to time out of the counter, the algorithm is directed to the power-on loop established by steps 351 and 352. Within this power-on loop, the high resolution angle sensing system is said to be in its analog mode. Step 350 effects this analog mode by directing switch 316 to serial communications between controller 300 and inclinometer circuit board 289 through communications paths 326, 322, 323 and 327, (shown in FIG. 22). Direct serial communications to the slave board would at this time be disabled. So long as in step 351 sufficient power level is provided to angle sensor unit 288 through voltage regulator 321 and the watchdog input of reset circuitry 319 periodically receives strobes from communications line 330, the main analog mode program runs at step 352.

The details of the main program are best shown by FIG. 27C. In step 362 of algorithm 344 a query is generated by serial communications controller 300 and transmitted through switch 316 to inclinometer circuit board 289. This query requests transmission of angle data from the inclinometer circuit board 289. In step 363 of algorithm 344 three bytes of communications header data are transmitted from inclinometer circuit board 289 through switch 316 to controller 300. In steps 364 and 365 of algorithm 344 a most significant byte and a least significant byte, respectively, of measured angle data are transmitted from the inclinometer circuit board 289 to the controller 300 through switch 316. In step 366 a checksum byte is transmitted from the inclinometer circuit board 289 to the controller 300, again through switch 316. This checksum is evaluated for validity and if the transmissions of steps 363-366 are valid, step 367 of algorithm 344 processes the data in order to scale for one tenth of one degree resolution as measured at the 0 to 5 volts analog angle signal output from converter 320. The scaled data from step 367 is strobed 368 into digital to analog converter 320, the output of which is directly available through line 332 at plug 308 connected to the slave board 340. Step 352 continues until in step 351 power is determined insufficient, at which point algorithm 344 terminates at 355.

If in step 350 of algorithm 344 a slave board query is received prior to time out of the counter, step 353 establishes the high resolution angle sensing system in its digital mode. The digital mode is effected by direct connection of plug, and hence, slave board 340 to the inclinometer circuit board 289 through communications paths 324, 322, 323 and 325 (as shown in FIG. 22). In the digital mode, the slave board 340 is responsible for generation of all queries and interpretation of all serial communications as is handled by the serial communications controller 300 in the analog mode. In the digital mode, step 354 of algorithm 344 is effected to tend the watchdog timer of reset circuitry 319 preventing reset of the serial communications controller 300 and disruption of digital communications.

The rotation function control algorithm 235, embedded in slave board 340, is best shown by FIGS. 26A–26E. This algorithm 235 is unique in that it utilizes measurement of rotation angles to control only direction of spin of valve motors in order to track specific rotation angle targets. The resolution of such angle measurements is less than one-tenth of a degree, with lower levels of hysteresis. Therefore, the angle sensor should be selected accordingly. While this algorithm 235 comprises a feedback system, the system may not properly be termed a closed loop system as the measurements are not taken from the entity under direct control of the software. There is no necessary measurement of the valve spool position, hence reducing sensor costs and hardware complexity. Unlike prior art attempts to control rotation angle of air mattress systems, this system requires only measurement of rotation angle. Prior art systems have utilized software calculations based on measurements of air pressures in the rotation bladders. Because these pressures vary so radically with patient 81 shape, weight, position, softness, bladder permeability and bed configuration, pressure measuring systems are not able to rotate to specific angles, rotate while under pulsation or percussion, or rotate to accurate angles independent of head angle. This presently preferred embodiment 30 gives superior performance in any of these conditions. The ultimate result of incorporation of this method into bed 30 is provision of a platform type turn on an air mattress. The patient 81 is afforded the previously unavailable full therapeutic benefit of both platform surface beds and air beds.

Integration of this method into overall bed control software will be enabled for the software engineer skilled in the art of developing control software for therapeutic type beds after the detailed description of the angle tracking algorithm 235 described herein. Referring to FIGS. 26A–26E, the angle control algorithm 235, as well as sub-algorithm 250 for determination of present angle and speed of rotation (the usage of which will be apparent herein) and sub-algorithm 270 for generation of valve motor control signals, is described in detail.

Upon initiation 236 of algorithm 235, the software immediately calls 237 algorithm 250 for determination of the current rotation angle of the patient support surface 33 and speed of rotation called DELTA. Upon initiation 251 of sub-algorithm 250 shown in FIG. 26B, the software reads 252 the current signed angle generated originally from the angle sensor unit 288 shown in FIG. 21. Sub-algorithm 250 then determines 253 if the current signed angle has changed from the previously read angle. If in step 253 the angle read in step 252 is determined to be different from the previously known value, a loop counter variable, which counts the number of software loops undertaken since the last change in measured rotation angle, is set to the largest of the two values, a constant established minimum value or the present value of the variable. This step serves to limit the size of the speed of rotation variable DELTA which is then calculated in step 255. The value for DELTA is calculated in step 255 as the difference in current measured rotation angle and previously measured rotation angle divided by the loop counter variable the quotient of which is multiplied by an appropriately chosen constant determined by the clock speed of the microprocessor used to perform the algorithm. It is appropriate to mention that the inclinometer 290, (FIG. 21, chosen must be of sufficient resolution to give measurements which yield accurate angular velocity as measured by the calculation of DELTA. In the preferred embodiment, we find that one tenth of one degree is both necessary and sufficient. In any case, if fluttering of angle is detected by step 256 of sub-algorithm 250, the value for DELTA is set to zero. Fluttering is the condition resulting from a non-debounced inclinometer circuit board 289 output which gives the false appearance of high angular velocities and reversals thereof.

In step 257 of sub-algorithm 250 local variables for previous angle and previous DELTA are set to the values resulting from the immediately previous steps 253–256, and in step 258, the value of the loop counter variable is reinitialized to one. If in step 253 the angle read in step 252 is determined to be same as the previously known value, the value for DELTA is estimated 259 as a value slightly lower in magnitude than the previous value. This adjustment is made to allow estimation of reasonable angular velocity values in the absence of explicitly measured angular changes. Estimation is necessary due to physical limitation of inclinometer circuit board 289 to discrete output. Following determination of DELTA in step 259 of sub-algorithm 250, the loop counter is incremented in step 260. Sub-algorithm 250 then terminates at 261 returning to algorithm 235.

Again referring to FIG. 26A, upon completion of step 237 of algorithm 235 in which current rotation angle and speed of rotation variable DELTA are determined, algorithm 235 proceeds to determine in step 238 the state of rotation bladders 129 and 130 shown best in FIG. 5 with respect to the target rotation angle. Step 238 of algorithm 235, shown in detail by FIG. 26C broken into steps 262–269, essentially determines which of six possible rotation conditions has resulted from the present inflation status of turning bladders 129 and 130. The combinations attainable derive from the possibilities that the patient support surface 33 may be in either left rotation or right rotation and that the current rotation angle ascertained in step 237 may be less than, greater than, or within some region of acceptability about a software generated target angle which depends upon the cycle period of rotation desired by the care giver.

In the preferred embodiment, signed angles are generated by angle sensor board shown in FIG. 21. It is established that the right rotation of the patient 81 shall be negative and the left rotation of the patient 81 shall be positive. The only requirement is for consistency of convention. Referring now to FIG. 26C, step 262 of algorithm 235 is used to determine if desired rotation is right or left. If in step 262, the software generated target angle is found to be negative, right rotation is known and in step 263 of algorithm 235 the value for a bladder state variable is established as 10 and a Boolean variable for direction is established as 1 indicating right rotation. If in step 262, the software generated target angle is found to be positive, left rotation is known and in step 264 of algorithm 235 the value for the bladder state variable is established as 0 and the Boolean variable for direction is also established as 0 indicating left rotation. As will be apparent to those skilled in the art of software generation, the exact determination of the variables utilized in steps 263 and 264 of algorithm 235 are not critical and infinite alternate embodiments are possible. Steps 265 and 266 of algorithm 235 combine to determine if the current rotation angle is lower than, higher than or within acceptable range of the software generated target angle. Absolute magnitudes of the angles are utilized in all calculations in steps 265 and 266 since the direction of rotation is already known. Step 265 of algorithm 235 determines if the measured angle from step 237 is less than the quantity of the software generated target angle minus a tolerance acceptable below the target angle. If in step 265 the target angle minus the tolerance value is greater than the current measured angle, the current angle is termed low and algorithm 235 proceeds to step 267 wherein the value for the bladder state variable ascertained in either step 263 or 264 is incremented by one. If in step 265 the target angle minus the tolerance value is less than the current measured angle, the current angle may be either high or within acceptable range of the target angle and algorithm 235 proceeds to step 266 for determination. Step 266 of algorithm 235 determines if the measured angle from step 237 is less than or equal to the quantity of the software generated target angle plus a tolerance acceptable above the target angle. If in step 266 the target angle plus the tolerance value is greater than the current measured angle, the current angle is termed within acceptable range and algorithm 235 proceeds to step 268 wherein the value for the bladder state variable ascertained in either step 263 or 264 is incremented by two. If in step 266 the target angle plus the tolerance value is less than or equal to the current measured angle, the current angle is termed high and algorithm 235 proceeds to step 269 wherein the value for the bladder state variable ascertained in either step 263 or 264 is incremented by three. The acceptance band established about the software generated target values as implemented by high and low tolerance values in steps 265 and 266 of algorithm 235 depend upon resolution of angle sensing device and the specific implementation in software of the algorithm. A value which is too tight will cause breathing of the patient support surface 33, a condition caused by a tendency to overcontrol about the target. A value which is too loose may also cause breathing and will cause dramatic overshoot or undershoot of the target angle due to inadequate or delayed correction. For the preferred embodiment 30 detailed herein a tolerance region of plus or minus one half of one degree is utilized. Summarizing FIG. 26C, the bladder state variable may take on one of six values at the completion of step 267, 268 or 269 of algorithm 235. A value of 1 indicates the patient support surface 33 is low during a left rotation. A value of 2 indicates the patient support surface 33 is within the acceptance band during a left rotation. A value of 3 indicates the patient support surface 33 is high during a left rotation. A value of 11 indicates the patient support surface 33 is low during a right rotation. A value of 12 indicates the patient support surface 33 is within the acceptance band during a right rotation. A value of 13 indicates the patient support surface 33 is high during a right rotation.

Figure 26A:
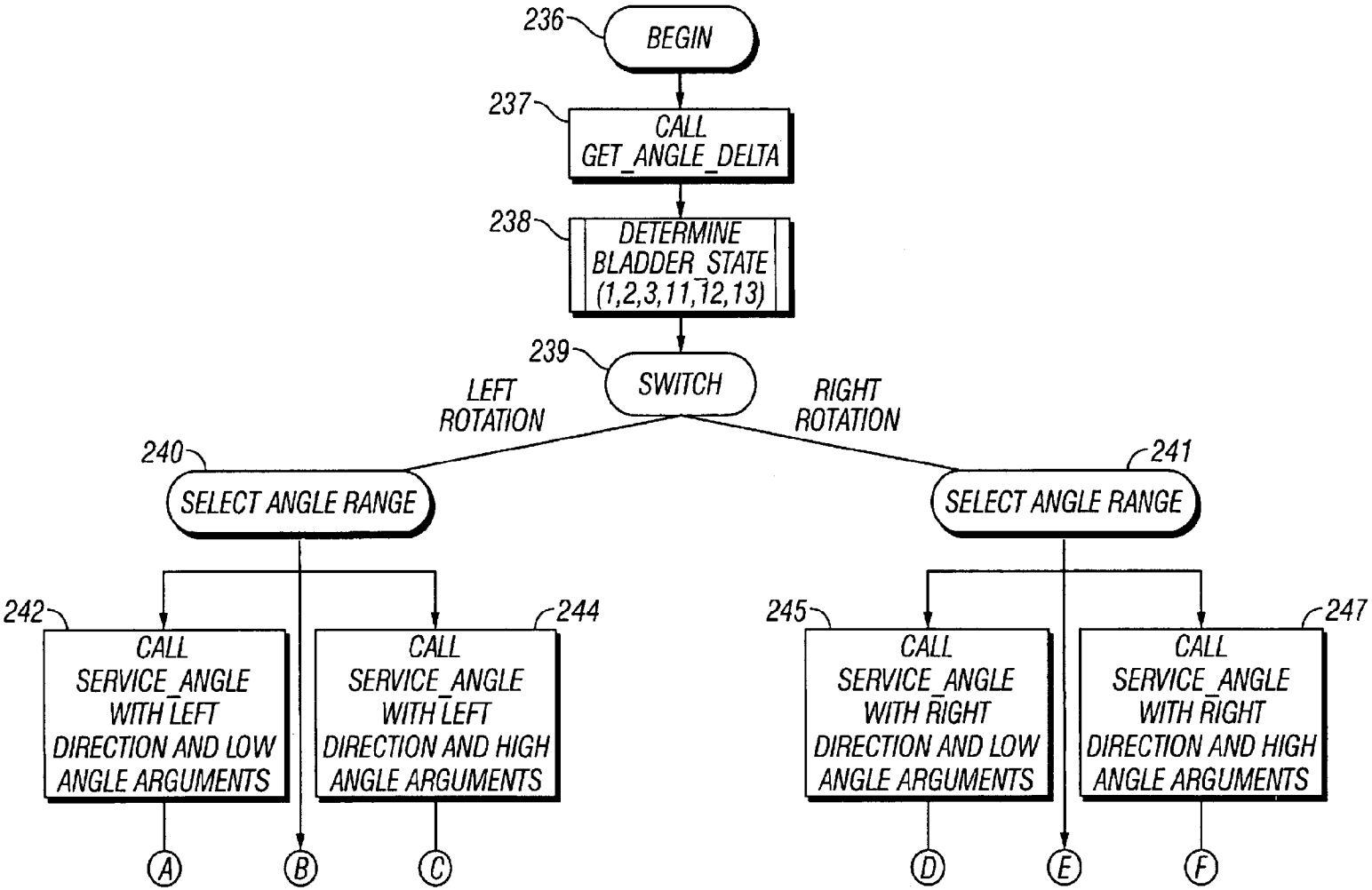
FIGS. 26–27 show flow diagrams of the control of the preferred embodiment.
Figure 26A:
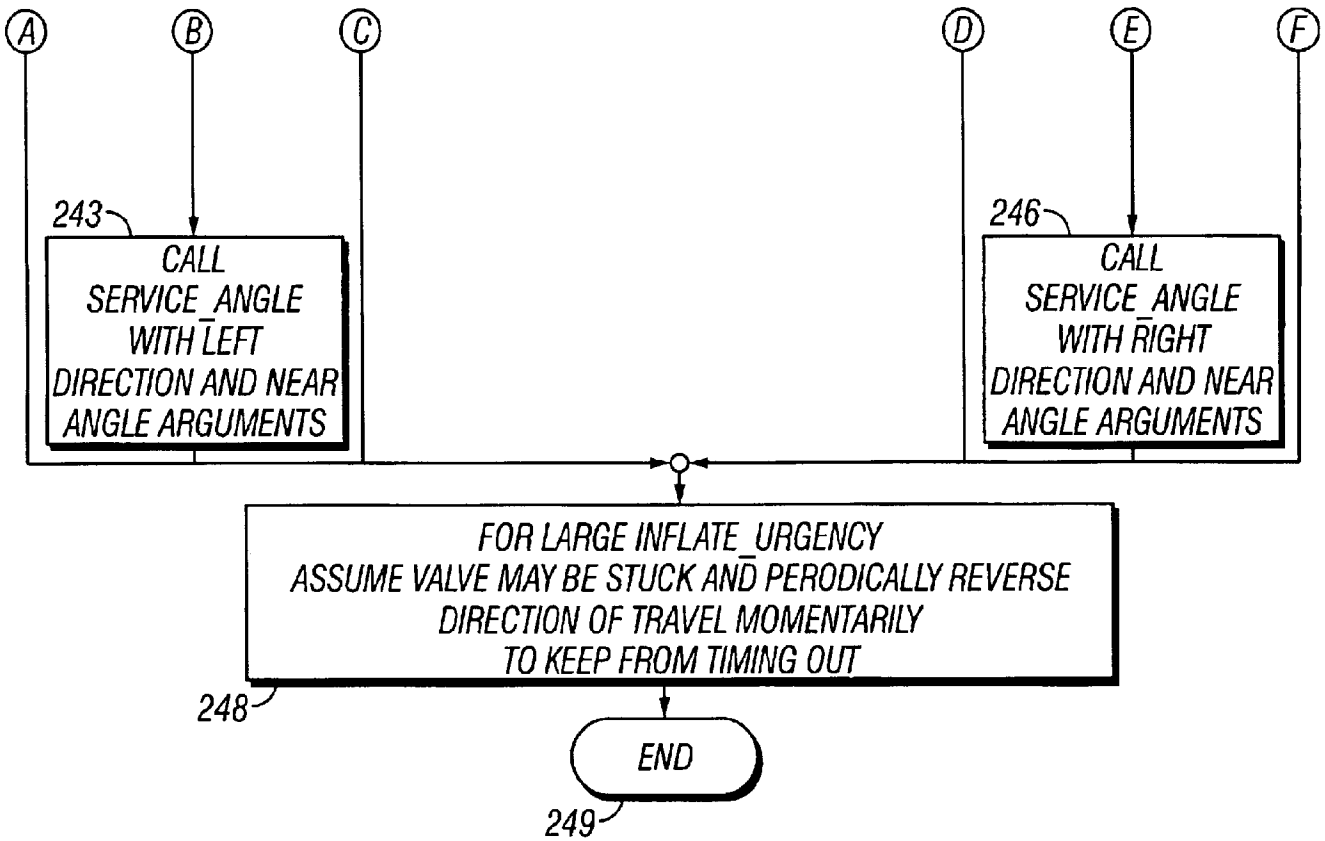
Figure 26B:
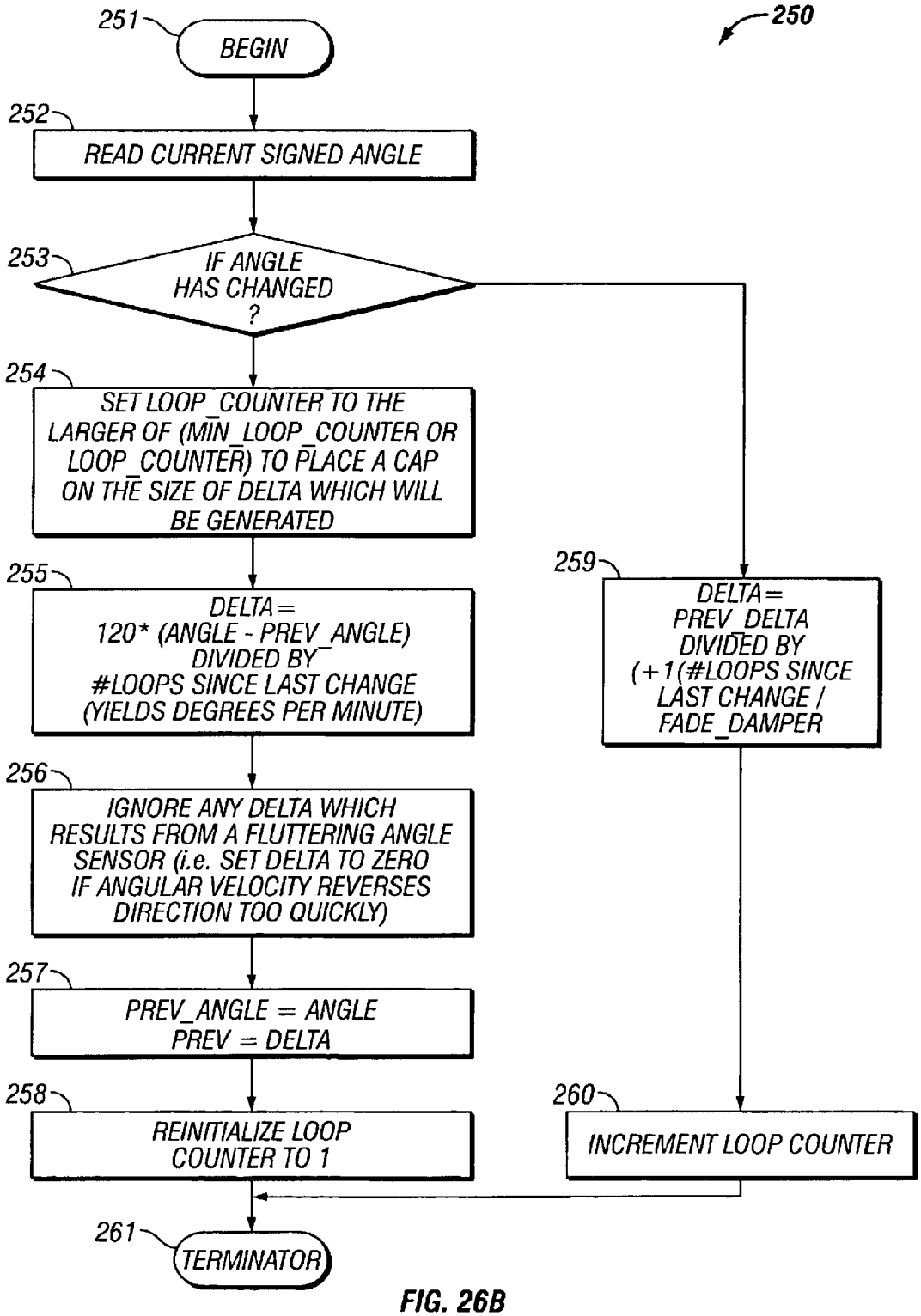
Figure 26C:
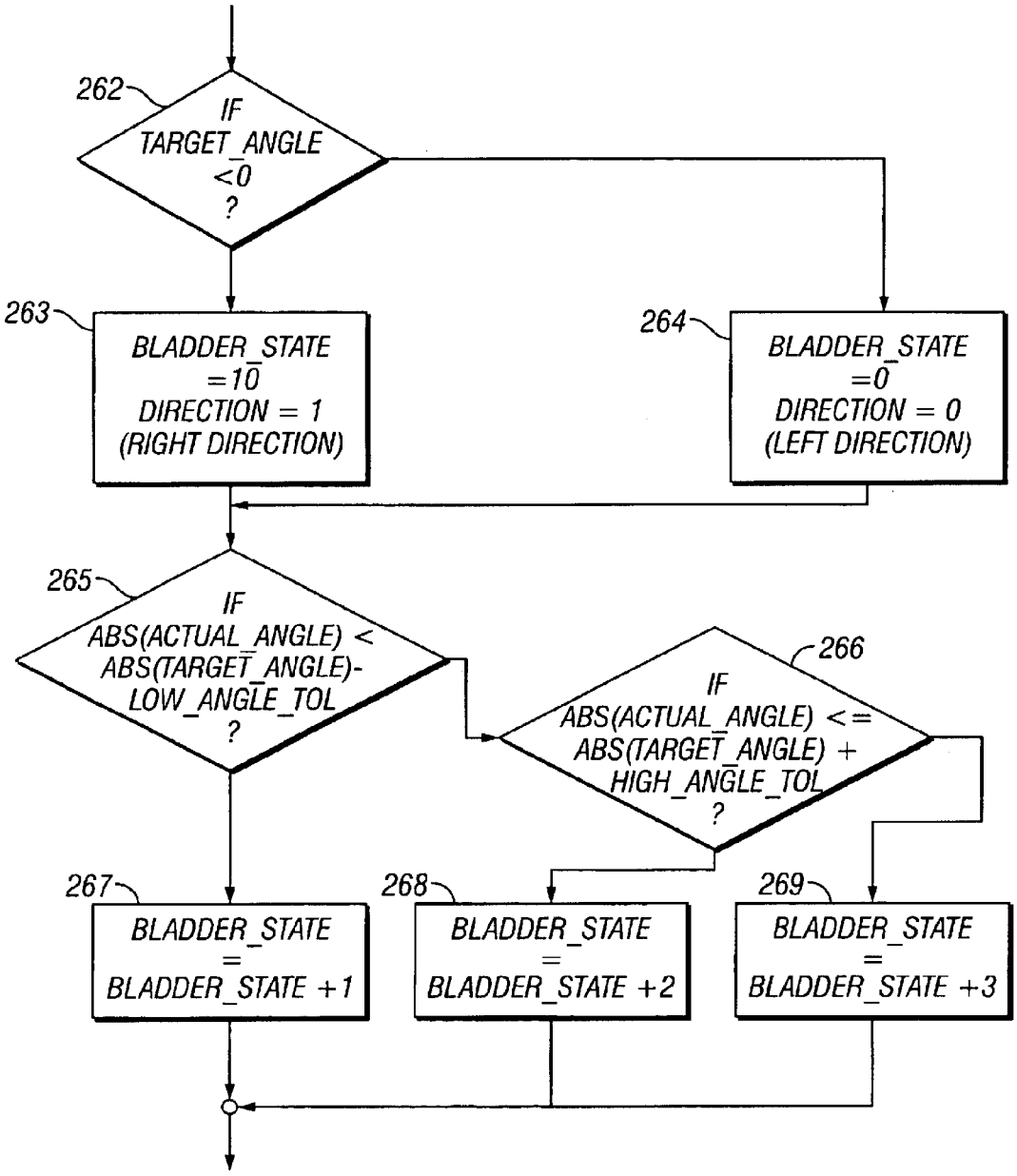
Figure 26D:
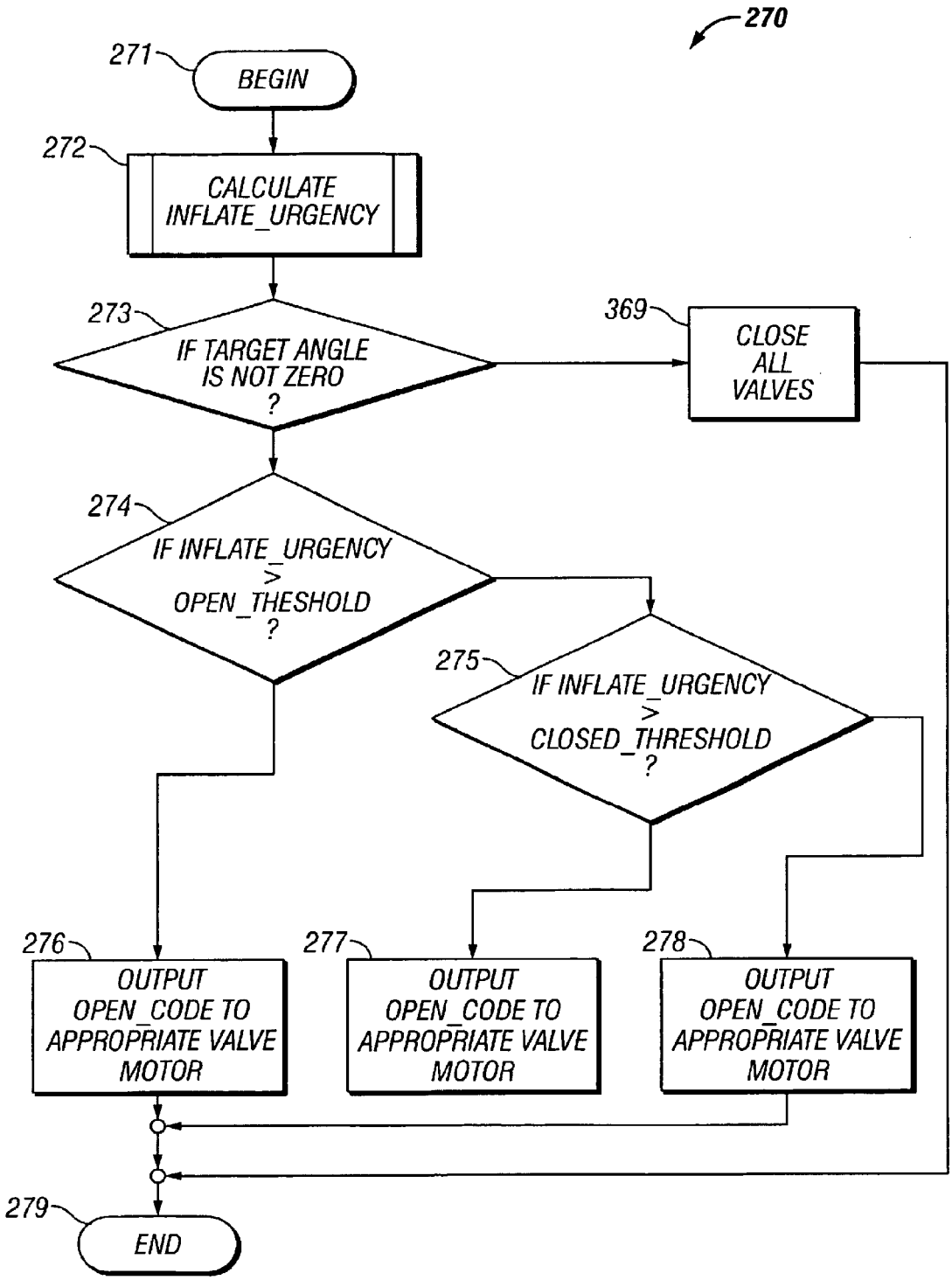

Returning to FIG. 26A, algorithm 235 continues with a two step selection process for the determination of parameters with which to call sub-algorithm 270 shown in FIG. 26D. The first step of selection 239 is based upon direction of rotation. If the Boolean variable direction is set to 0, then direction is left and the next step in algorithm 235 is step 240. If the Boolean variable direction is set to 1, then direction is right and the next step in algorithm 235 is step 241. In the case of left rotation, step 240 is invoked to determine rotation range based upon bladder state. If bladder state is 1, step 242 calls sub-algorithm 270 with parameters set for left direction and low angle. If bladder state is 2, step 243 calls sub-algorithm 270 with parameters set for left direction and near angle. If bladder state is 3, step 244 calls sub-algorithm 270 with parameters set for left direction and high angle. In the case of right rotation as determined in step 239, step 241 is invoked to determine rotation range based upon bladder state. If bladder state is 11, step 245 calls sub-algorithm 270 with parameters set for right direction and low angle. If bladder state is 12, step 246 calls sub-algorithm 270 with parameters set for right direction and near angle. If bladder state is 13, step 247 calls sub-algorithm 270 with parameters set for right direction and high angle.

Figure 26E:
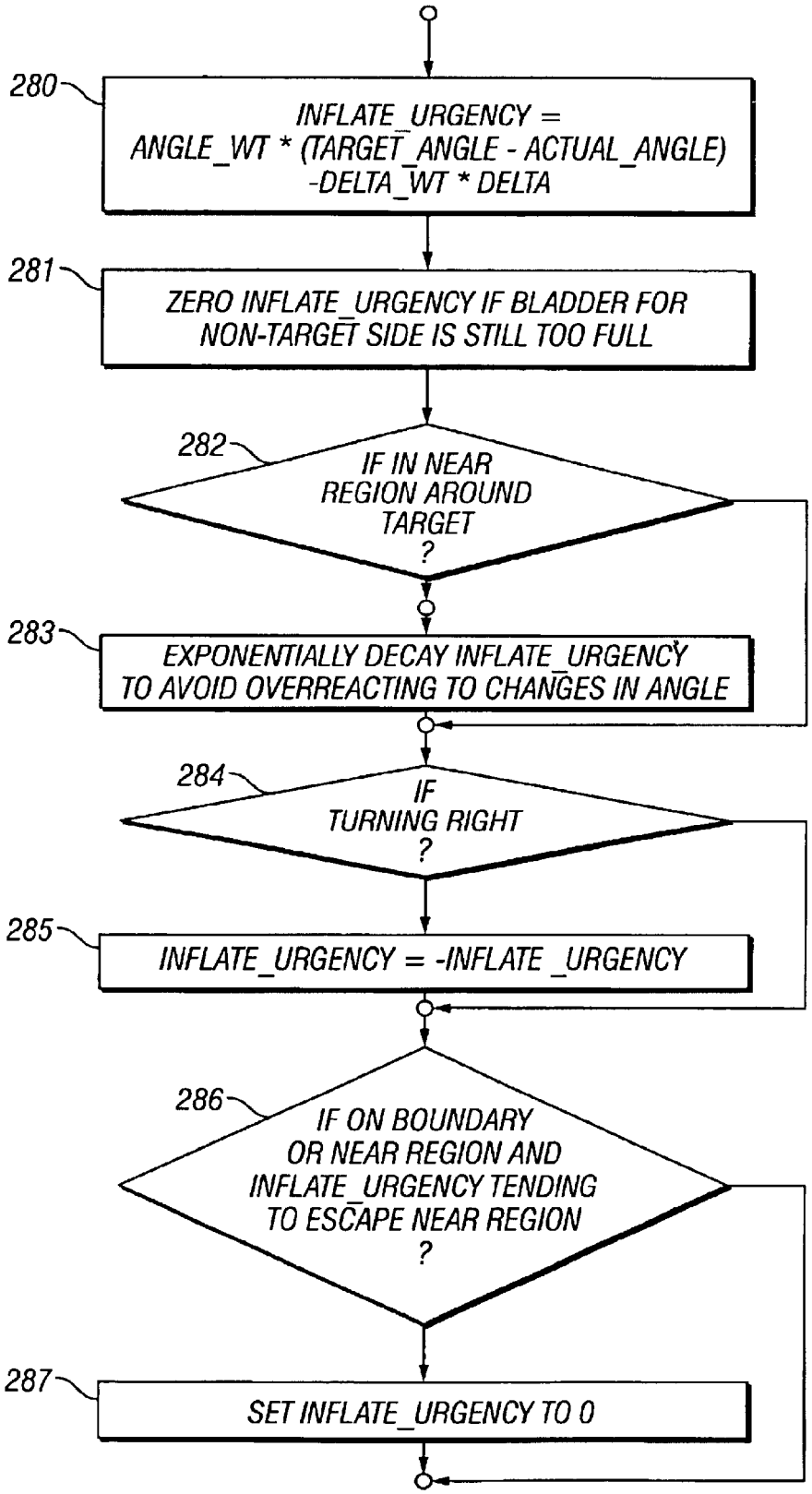

The sub-algorithm 270 shown in FIG. 26D effects changes to the valve control motors as appropriate for the parameters with which it was called in combination with an inflate urgency variable, the calculation of which takes place during execution of sub-algorithm 270 detailed herein and shown on FIG. 26E. Upon initiation 271 of sub-algorithm 270, the inflate urgency variable is calculated at step 272. Calculation of the inflate urgency variable is the means by which the preferred embodiment is able to turn aggressively toward a specific angle without excessive overshoot and hold that angle. Unlike previous embodiments which make no use of calculations of rotation speed, this preferred embodiment utilizes the first derivative of rotation angle to provide a damping factor which essentially slows rotation as the target angle is approached stopping near to exact on the desired angle. Performance of the rotation hinges significantly on the selection of constants utilized in the inflate urgency calculation.

Step 280 shown in FIG. 26E of sub-algorithm 270 calculates the inflate urgency variable as the difference of two products each involving a constant, one called ANGLE WEIGHT and the other DELTA WEIGHT. ANGLE WEIGHT represents the relative importance given to the difference in current rotation angle from target rotation angle when attempting to arrive at a particular target angle. DELTA WEIGHT represents the relative importance given to rotation speed when attempting to arrive at a particular target angle. DELTA WEIGHT is a positive constant, the negative of which is multiplied by DELTA which can be either positive or negative. DELTA WEIGHT thereby provides a contribution which always opposes the current direction of angular change. Utilization of DELTA WEIGHT as a damping factor is largely responsible for the success of this invention. When choosing values for ANGLE WEIGHT and DELTA WEIGHT, the software engineer must have some specific goals and considerations in mind. First, positive motion above a target angle should be aggressively quenched. Second, it is desirable to dampen motion as much as possible without reversing direction of rotation inside of the acceptance region. The designer should keep in mind that it is easier to deflate than to inflate. Remembering that it is ANGLE WEIGHT which promotes motion in order to correct a deviation from the target angle and DELTA WEIGHT which resists motion to dampen rotation about the target angle, the following rules for selection can be established. 1) ANGLE WEIGHT should be of high value when far from the target angle, i.e. outside of the acceptance region, 2) ANGLE WEIGHT should be of low value when near the target angle, i.e. inside of the acceptance region, 3) DELTA WEIGHT should be of high value when near the target angle, 4) because it is easier to deflate than inflate, there should be significant damping when coming down from a measured angle which is higher than the target angle, and 5) damping is not quite as important when going up from a lower measured angle than the target angle. Three sets of parameters are hence utilized for ANGLE WEIGHT and DELTA WEIGHT. In the preferred embodiment, if low angle parameters are called for, the ANGLE WEIGHT is set to 25 and the DELTA WEIGHT is set to 30. If near angle parameters are called for, the ANGLE WEIGHT is set to 5 and the DELTA WEIGHT is set to 30. Finally, if high angle parameters are called for, the ANGLE WEIGHT is set to 20 and the DELTA WEIGHT is set to 35. While one may naturally assume that when near the target angle a value of zero would be appropriate for ANGLE WEIGHT, the software designer is strongly cautioned that this selection may have a tendency to cause a statistical random walk within the acceptance region hence preventing settling about the target angle.

Returning to discussion of inflate urgency calculation, step 280 of sub-algorithm 270 calculates inflate urgency as the sum of the product of the quantity target angle minus actual angle and ANGLE WEIGHT and the product of IS DELTA and DELTA WEIGHT where DELTA is as determined in step 237 of algorithm 235, and ANGLE WEIGHT and DELTA WEIGHT are the appropriate constants for either low parameters, near parameters or high parameters. The value of inflate urgency will determine whether to cause a valve control motor to turn in an opening direction, exhausting direction or not turn at all. [In general, causing a valve control motor to turn in an opening direction causes increased air flow in the associated hose, as well as increased air pressure in and inflation of the turning bladders; causing a valve control motor to turn in a exhausting direction causes decreased air flow in the associated hose and decreased air pressure in the turning bladders which will cause either slower inflation or possibly deflation.] As will be evident further herein, a value of zero for inflate urgency will always cause the appropriate valve control motor to cease all turning. In a case where the turning bladder for the non target side is too full to safely inflate on the target side without potentially elevating the patient 81 above the side rails 52–55, it is desirable that the non target turning bladder be allowed to deflate prior to inflation of the target side. A value of zero is given to inflate urgency in step 281 of sub-algorithm 270 when such a condition exists, allowing the non target side to continue to deflate prior to inflation of the target side. Referring back to FIG. 26D, it is instructive to understand the full effect of inflate urgency prior to further discussion of determination of inflate urgency. If the target angle is zero, step 273 generates appropriate signals to cause all valve control motors to turn in the exhausting direction. Algorithm 270 then terminates at step 279. So long as the target angle is some value other than zero, step 279 of sub-algorithm 270 allows steps 274 and 275 to determine appropriate courses of action for the valve control motors. Steps 274 and 275 utilize the constants open threshold and close threshold. These constants are positive and negative values, respectively, chosen so as to give the finest control resolution possible. In order to do so, the magnitude of these values must be as large as possible within the integer arithmetic capability of the microprocessor used for implementation of the algorithm 235. In the case of the preferred embodiment, values of plus and minus 250 are chosen for open and close threshold, respectively. If the value returned in step 272 of sub-algorithm 270 is greater than the constant open threshold, step 274 advances the sub-algorithm to step 276 wherein a signal is generated to cause the appropriate valve control motor to turn in the opening direction, terminatin atg 279 sub-algorithm 270. If the value returned in 272 of sub-algorithm 270 is less than or equal to the constant open threshold, step 274 advances the sub-algorithm to step 275. In step 275 of sub-algorithm 270, the value of inflate urgency returned in step 272 is compared to the constant close threshold. If in step 275 it is found that the inflate urgency is greater than the constant close threshold, the sub-algorithm 270 advances to step 277 wherein a signal is generated to cause the appropriate valve control motor to stop turning, terminating at 279 sub-algorithm 270. If in step 275 it is found that the inflate urgency value is less than or equal to the constant close threshold, the sub-algorithm 270 advances to step 278 wherein a signal is generated to cause the appropriate valve control motor to turn in the exhausting direction, terminating at 279 sub-algorithm 270. Summarizing the effect of inflate urgency, FIG. 26D shows that inflate urgency values of 250 or greater cause valve control motors to turn in opening directions, inflate urgency values of negative 250 or less cause valve control motors to turn in exhausting directions, and all values in between cause the valve control motors to cease turning.

Understanding that it is desirable for turning to be less aggressive when near the target angle, refer to FIG. 26E for conclusion of the discussion on determination of inflate urgency. In step 282 of sub-algorithm 270, it is determined whether the current rotation angle is in the near region of the target angle. If in step 282 it is determined that the current angle is near the target angle, the inflate urgency value is exponentially decayed in step 283 in order to prevent overreacting to changes in angle. If in step 282 it is determined that the current angle is not in the near region about the target angle, step 283 is bypassed and the sub-algorithm 270 continues with step 284 without decay of the inflate urgency. Step 284 determines if the rotation is to the left or right so as to correct the inflate urgency for direction. The sub-algorithm 270 is based upon a left turning rotation; and so if the rotation is determined in step 284 to be toward the right the sign of the inflate urgency is reversed in step 285 which is passed over in cases of left rotation. Steps 286 and 287 combine to establish an inflate urgency of zero in cases where the current angle is on the boundary of the acceptance band and the calculated inflate urgency would otherwise tend to cause changes which would drive the actual angle in a direction tending to escape the acceptance region. At this point the inflate urgency calculation is completed and sub-algorithm 270 continues with steps 273–279 shown in FIG. 26D.

At the conclusion 279 of sub-algorithm 270, algorithm 235 continues with step 248 shown in FIG. 26A. In cases where a valve spool may become stuck, the appropriate effects will not reach the turning bladders. In these cases the inflate urgency will become very large and in step 248 of algorithm 235, a large inflate urgency will cause periodic reversing of valve control motor directions in order to free the stuck valve spool. Step 248 has no effect in cases of normal inflate urgency values. Following step 248, algorithm 235 concludes at 249.

The preferred embodiment of the invention disclosed herein is designed to offer a comprehensive system of pulmonary and skin care therapies for the critically ill, immobilized patient. Simple procedures have been developed to allow the care giver and/or patient 81 maximum means to access and operate the myriad functions offered.

To power up the preferred embodiment, the care giver first ensures that power cord 506 (FIG. 29) is plugged into a properly grounded 115 VAC wall outlet. In order to prevent accidental disruption of treatment, the care give should ensure that the outlet into which power cord 506 is plugged is not controlled by a wall switch. Upon supply of current through power cord 506, display 207 (FIG. 13) of main control panel 72 shown in FIG. 13 will reflect an appropriate message indicating that air is switched off, and further instructing the care giver to press the "ON/OFF" button to start. The care giver should then press on/off button 218 on main control panel 72 to proceed. After temporarily displaying an appropriate message to indicate air has been switched on, display 207 of main control panel 72 then changes to reflect the "Home Display."Pulsation will be automatically activated.

Main control panel 72 provides access to the Home Display, Bar Graph Display, Alarm Silence, Scale and Transport Mode features and functions of the preferred embodiment. Main control panel 72 is used to activate or deactivate the air supply to cushions and bladders on bed 30; view, set and adjust air functions and therapies (such as Rotation, Pulsation, Percussion, Warmer, Instaflate, Seat Deflate, Head Deflate and air pressures); view a bar graph of and manually adjust air pressures in each section of cushions (Head, Body and Foot); activate and silence the patient Exit Alarm; view, set and adjust Scale readings (Zero, Preset, Delay, Hold and Weight Trend Chart); and set and adjust air function Lock-Outs (for Rotation, Pulsation, Percussion, Warmer and air pressures). Access to and operation of each of these said features and functions is detailed further herein.

From the Home Display of main control panel 72, the care giver may activate or deactivate Instaflate, Seat Deflate, Head Deflate, Rotation, Pulsation, and Percussion or may access the Main Menu or the Status Display menu. Lock-Outs may be accessed from the Home Display within the first ten seconds after power cord 506 is plugged in. The Home Display also includes a graphic and numeric representation on display 207 of the current rotation angle.

The Instaflate function assists care givers in patient 81 transfer and bathing by increasing air pressures in all patient support air bladders 83–106 creating a firm patient support surface 33. Referring to FIGS. 5, 7, 10, 13, and 16, pressing button 213 on main control panel 72 from the Home Display (corresponding to "INSTAFLATE" on display 207) will activate the Instaflate function. Instaflate may also be activated and deactivated by pressing "INSTAFLATE" button 180 on nurse control panel 57. Nurse display 582 (as shown in FIG. 29) will appropriately indicate Instaflate is activated. Display 207 will reflect an appropriate message indicating Instaflate has been activated. Rotation, Pulsation and Percussion will be deactivated by initiation of Instaflate, but Warmer will not be affected. The signal generated by pressing button 213 will cause the appropriate valve motors to drive the appropriate valve spools open increasing air flow through hoses 145–149 until the care giver presses button 217 (corresponding to "CANCEL" on display 207) to cancel Instaflate. The increased air flow causes increased rigidity in patient support air bladders 83–106. In the preferred embodiment, an audible alarm sounds five beeps upon activation of Instaflate and sounds again every 20 minutes, until Instaflate is canceled. Upon deactivation by care giver via cancellation, signals are generated causing the valve motors to return the valve spools to their previous positions reinstating the previous flows through hoses 145–149. Cancellation of Instaflate causes display 207 to reflect a temporary confirmation message followed by restoration of the Home Display. If Pulsation or Percussion were active prior to activation of Instaflate, they will be automatically reactivated. If Rotation was active prior to activation of Instaflate, the audible alarm will sound five beeps and display 207 will visually prompt the care giver to restore Rotation. Rotation will not be restored except under the positive control of the care giver.

The Seat Deflate function assists in patient 81 exit and in bedpan placement by reducing the air pressures in the patient support air bladders 87–96 under region 33*b* by fifty percent. Again referring to FIGS. 5, 7, 13, and 16, pressing button 214 on main control panel 72 from the Home Display (corresponding to "SEAT DEFLATE" on display 207) will activate the Seat Deflate function. Seat Deflate may also be activated and deactivated by pressing "SEAT DEFLATE" button 181 on nurse control panel 57. Nurse display 582 will appropriately indicate Seat Deflate is activated. Display 207 will reflect an appropriate message indicating Seat Deflate has been activated. Rotation, Pulsation and Percussion will be deactivated by initiation of Seat Deflate, but Warmer will not be affected. The signal generated by pressing button 214 will cause appropriate activation of valve motors, to in turn cause the necessary valve spools to adjust air flow through hoses 147 and 148 as is required to maintain within patient support air bladders 87–96 air pressure fifty percent of the previously established air pressure. Seat Deflate will remain activated until the care giver presses button 217 (corresponding to "CANCEL" on display 207) to cancel Seat Deflate. In the preferred embodiment, an audible alarm sounds five beeps upon activation of Seat Deflate and sounds again every 20 minutes, until Seat Deflate is canceled. Upon deactivation by care giver cancellation, signals are generated to cause appropriate valve motors to drive appropriate valve spools in the necessary directions to restore air flow through hoses 147 and 148 such that pressures in patient support air bladders 87–96 are restored to the pressure level prior to activation of Seat Deflate. Cancellation of Seat Deflate causes display 207 to reflect a temporary confirmation message followed by restoration of the Home Display. If Pulsation or Percussion were active prior to activation of Seat Deflate, they will be automatically reactivated. If Rotation was active prior to activation of Seat Deflate, the audible alarm will sound five beeps and display 207 will visually prompt the care giver to restore Rotation. Rotation will not be restored except under the positive control of the care giver.

The Head Deflate function is used to gently hyper-extend the patient's neck and tilt chin upward, allowing for tube placement or other medical procedures. Referring still to FIGS. 5, 7, 10, 13, and 16, pressing button 215 on main control panel 72 from the Home Display (corresponding to "HEAD DEFLATE" on display 207) will activate the Head Deflate function. Display 207 will reflect an appropriate message indicating Head Deflate has been activated. Rotation, Pulsation and Percussion will be deactivated by initiation of Head Deflate, but Warmer will not be affected. The signal generated by pressing button 215 will cause appropriate activation of valve motors to in turn cause the necessary valve spools to adjust air flow through hoses 147–149 as required to reduce air pressure in patient support air bladders 83–95, and simultaneously increase air pressure in patient support air bladders 96–106. Head Deflate will remain activated until the care giver presses button 217 (corresponding to "CANCEL" on display 207) to cancel Head Deflate. In the preferred embodiment, an audible alarm sounds five beeps upon activation of Head Deflate and sounds again every 20 minutes, until Head Deflate is canceled. Upon deactivation by care giver via cancellation, signals are generated to cause appropriate valve motors to drive appropriate valve spools in the necessary directions to restore air flow through hoses 147–149 such that pressures in patient support air bladders 83–106 are restored to the pressure levels prior to activation of Head Deflate. Cancellation of Head Deflate causes display 207 to reflect a temporary confirmation message followed by restoration of the Home Display. If Pulsation or Percussion were active prior to activation of Head Deflate, they will be automatically reactivated. If Rotation was active prior to activation of Head Deflate, the audible alarm will sound five beeps and display 207 will visually prompt the care giver to restore Rotation. Rotation will not be restored except under the positive control of the care giver.

Rotation, Pulsation and Percussion may be toggled on or off from the Home Display of main control panel 72. Pressing button 208 on main control panel 72 from the Home Display (corresponding to "ROTATE: ON OFF" on display 207) will toggle Rotation on and off. Rotation may also be toggled on and off by pressing "ROTATION" button 179 on nurse control panel 57. Nurse display 582 will appropriately indicate Rotation Therapy is activated. Pressing button 209 on main control panel 72 from the Home Display (corresponding to "PULSE: ON OFF" on display 207) will toggle Pulsation on and off. Pressing button 210 on main control panel 72 from the Home Display (corresponding to "PERCUS: ON OFF" on display 207) will toggle Percussion on and off. Further Rotation, Pulsation and Percussion function controls are available through the Main Menu of main control panel 72 as detailed further herein.

From the Main Menu of main control panel 72, the care giver may access the Rotation, Pulsation, Percussion and Warmer Menus wherein adjustments may be made to the respective settings. The Height/Weight Preset is also accessed through the Main Menu. The Main Menu may further be used to rotate patient 81 either to the left or right and subsequently hold patient 81 at the chosen maximum left or right angle or patient 81 may be brought and held at level position. In the preferred embodiment, the Main Menu is entered by pressing button 216 on main control panel 72 from the Home Display (corresponding to "MENU" on display 207). If no input is made by care giver within approximately one minute of display of the Main Menu, display 207 automatically returns to the Home Display. Pressing button 217 on main control panel 72 from the Main Menu (corresponding to "EXIT" on display 207) will also cause display 207 to return to the Home Display.

Rotation Menu #1 and Rotation Menu #2 are used to view and adjust the Current Status of Rotation Therapy; Right and Left Rotation Angles; Right, Left and Center Pauses; to view the number of hours of Rotation Therapy the patient 81 has received and to zero the Rotation Hour Meter. Rotation Menu #1 is entered by pressing button 208 on main control panel 72 from the Main Menu (corresponding to "ROTATION" on display 207). Rotation Menu #1 allows selection of the Right Rotation Angle, the Right Pause time, and the Center Pause time. Rotation Menu #1 also displays the time in hours, accurate to the tenth of one hour, that the patient 81 has been in Rotation Therapy. Lastly Rotation Menu #1 allows the Rotation Therapy Hour Meter to be reset to zero.

The Right Rotation Angle is selected from 0°, 15°, 20°, 25°, 30°, 35°, 40° or MAX by sequentially pressing button 213 on main control panel 72 from Rotation Menu #1 (corresponding to "Right Angle:—ADJUST" on display 207). The selected rotation angle is utilized by algorithm 235 in order to generate target rotation angles. Said software generated target rotation angles are calculated based upon the maximum rotation angle, as above selected, and the desired time to complete one rotation cycle. Selection of "MAX" allows rotation to the highest angle attainable as limited by the mechanical components of bed 30. In the preferred embodiment, if a Left Rotation Angle of 0° is selected, the Right Rotation Angle cannot be adjusted to 0°.

Right Pause is the amount of time the patient 81 is held in place once the selected Right Rotation Angle is attained. Right Pause time is selected from 0, 2, 5, 10, 20 or 30 minutes by sequentially pressing button 214 on main control panel 72 from Rotation Menu #1 (corresponding to "Right Pause:—ADJUST" on display 207). The value selected for Right Pause is utilized in software generation of the target angle used by algorithm 235.

Center Pause time is the amount of time the patient 81 is held in a level position after rotating to the right or left. Center Pause time is selected from 0, 2, 5, 10, 20 or 30 minutes by sequentially pressing button 215 on main control panel 72 from Rotation Menu #1 (corresponding to "Center Pause:—ADJUST" on display 207). The value selected for Center Pause is utilized in software generation of the target angle used by algorithm 235.

The Rotation Hour Meter indicates the number of hours of Rotation Therapy a patient 81 has had. In the preferred embodiment, the Rotation Hour Meter may be reset or recalibrated to zero by pressing button 216 on main control panel 72 from Rotation Menu #1 (corresponding to "ZERO" on display 207). Upon initiation of the zero process, the preferred embodiment presents the care giver with an appropriate query on display 207 in order to ensure the care giver's intentions. The care giver confirms the action by pressing button 215 on main control panel 72 (corresponding to "YES" on display 207) or cancels the action by pressing button 217 on main control panel 72 (corresponding to "NO" on display 207). Upon confirmation of the intention to zero the Rotation Hour Meter, the display is set to "0.0" hours. In either case, display 207 returns to Rotation Menu #1.

Rotation Menu #2 is entered by pressing button 217 on main control panel 72 from Rotation Menu #1 (corresponding to "LEFT ROTATION SETTING" on display 207). Rotation Menu #2 allows selection of the Left Rotation Angle, the Left Pause time and activation or deactivation of Rotation Therapy.

The Left Rotation Angle is selected from 0°, 15°, 20°, 25°, 30°, 35°, 40° or MAX by sequentially pressing button 213 on main control panel 72 from Rotation Menu #2 (corresponding to "Left Angle:—ADJUST" on display 207). The selected rotation angle is utilized by algorithm 235 in order to generate target rotation angles. Said software generated target rotation angles are calculated based upon the maximum rotation angle, as above selected, and the desired time to complete one rotation cycle. Selection of "MAX" allows rotation to the highest angle attainable as limited by the mechanical components of bed 30. In the preferred embodiment, if a Right Rotation Angle of 0° is selected, the Left Rotation Angle cannot be adjusted to 0°.

Left Pause is the amount of time the patient 81 is held in place once the selected Left Rotation Angle is attained. Left Pause time is selected from 0, 2, 5, 10, 20 or 30 minutes by sequentially pressing button 214 on main control panel 72 from Rotation Menu #2 (corresponding to "Left Pause:—ADJUST" on display 207). The value selected for Left Pause is utilized in software generation of the target angle used by algorithm 235.

The Current Status display on Rotation Menu #2 indicates "ON" or "OFF" as Rotation Therapy is activated or deactivated, respectively. Activation or deactivation of Rotation Therapy may be toggled by pressing button 215 on main control panel 72 from Rotation Menu #2 (corresponding to "CHANGE" on display 207).

Rotation Menu #1 may be recalled by pressing button 216 on main control panel 72 from Rotation Menu #2 (corresponding to "PRIOR MENU" on display 207). Rotation settings may be saved by pressing button 217 on main control panel 72 from Rotation Menu #2 (corresponding to "ENTER" on display 207). Upon saving the Rotation settings, the care giver is presented with an Acclimation Option on display 207. The Acclimation Option is used to help the patient 81 adjust to the selected Rotation Angles by increasing the degree of Rotation in a series of steps until the selected Rotation Angles are achieved. Under the Acclimation Option and for selected Rotation Angles of 25° or more, the patient will rotate to 25° for six Rotation cycles. Rotation will then increase 10° every six cycles until the selected Rotation Angles are reached. If Rotation is interrupted subsequent to initiation of the Acclimation Option, the Acclimation cycle will be restored at the last completed cycle if the Acclimation Option is not canceled. The Acclimation Option is automatically canceled when air is turned off or if CPR Mode, detailed further herein, is activated. Upon presentation of the Acclimation Option, the care giver may accept by pressing button 215 on main control panel 72 (corresponding to "YES" on display 207) or decline by pressing button 217 on main control panel 72 (corresponding to "NO" on display 207). If the Acclimation Option is accepted, display 207 will return to the Home Display which will include the annotation "ACCLIMATION MODE" for the duration of the option. If the Acclimation Option is declined, display 207 returns to the Main Menu. In any case where in either Rotation Menu #1 or Rotation Menu #2 and the care giver fails to make any change within a time period of approximately one minute, the Rotation settings are saved as they stand and display 207 automatically returns to the Home Display.

The Pulsation Menu is used to view and adjust the Current Status, Intensity, and Cycle Time of Pulsation Therapy; to view on the Pulse Hour Meter the number of hours of Pulsation Therapy patient 81 has undergone and to zero the Pulse Hour Meter. The Pulsation Menu is entered by pressing button 209 on main control panel 72 from the Main Menu (corresponding to "PULSATION" on display 207). As discussed when addressing the Power-Up Procedure of bed 30, Pulsation Therapy is automatically activated when on/off button 218 on main control panel 72 is toggled "ON." If Pulsation Therapy has been deactivated by the care giver, it is automatically reactivated when button 209 corresponding to "PULSATION" is pressed.

The Current Status display on the Pulsation Menu indicates "ON" or "OFF" as Pulsation Therapy is activated or deactivated, respectively. Activation or deactivation of Pulsation Therapy may be toggled by pressing button 213 on main control panel 72 from the Pulsation Menu (corresponding to "CHANGE" on display 207).

The Intensity of Pulsation determines how high above and how low below the target pressure cushions will inflate during Pulsation Therapy. Intensity may be selected as LOW, MED or HI (corresponding to low, medium and high, respectively) by sequentially pressing button 214 on main control panel 72 from the Pulsation Menu (corresponding to "Intensity:—ADJUST" on display 207).

Cycle Time determines how quickly a cushion will complete a full cycle. A full cycle is defined as that period in which a cushion inflates, returns to the mid-pressure, deflates and returns again to the mid-pressure ready to again inflate. By sequentially pressing button 215 on main control panel 72 from the Pulsation Menu (corresponding to "Cycle Time:—ADJUST" on display 207), the Cycle Time may be set to 2, 5, 10, 20 or 40 minutes.

The Pulse Hour Meter indicates the number of hours of Pulsation Therapy a patient 81 has had. In the preferred embodiment, the Pulse Hour Meter may be reset or recalibrated to zero by pressing button 216 on main control panel 72 from the Pulsation Menu (corresponding to "ZERO" on display 207). Upon initiation of the zero process, the preferred embodiment presents the care giver with an appropriate query on display 207 in order to ensure the care giver's intentions. The care giver confirms the action by pressing button 215 on main control panel 72 (corresponding to "YES" on display 207) or cancels the action by pressing button 217 on main control panel 72 (corresponding to "NO" on display 207). Upon confirmation of the intention to zero the Pulse Hour Meter, the display is set to "0.0" hours. In either case, display 207 returns to the Pulsation Menu.

The Pulsation Menu settings are saved by pressing button 217 on main control panel 72 from the Pulsation Menu (corresponding to "ENTER" on display 207). Upon pressing button 217, display 207 returns to the Main Menu. In any case where the care giver goes for more than approximately one minute without effecting a change to the Pulsation Menu, display 207 will automatically return to the Home Display. In the preferred embodiment, all settings shown at the time of return will be automatically saved and will become the current Pulsation settings.

Percussion Menu #1 and Percussion Menu #2 are used to view and adjust the Current Status, Intensity, Duration and Frequency of Percussion Therapy; view on the Percussion Hour Meter the number of hours of Percussion Therapy the patient 81 has received and to zero the Percussion Hour Meter. Percussion Menu #1 is entered by pressing button 211 on main control panel 72 from the Main Menu (corresponding to "PERCUSSION" on display 207). Percussion Menu #1 allows the care giver to view and change the Current Status of Percussion Therapy and set the Intensity, Duration and Frequency of Percussion Therapy.

The Current Status display on Percussion Menu #1 indicates "ON" or "OFF" as Percussion Therapy is activated or deactivated, respectively. Activation or deactivation of Percussion Therapy may be toggled by pressing button 213 on main control panel 72 from Percussion Menu #1 (corresponding to "CHANGE" on display 207).

Percussion Intensity indicates the range of pressure exerted on the lung area of patient 81 during Percussion Therapy. The various pressures available allow increased care giver flexibility in mobilization of fluids and mucous from the patient's lungs. Intensity may be selected as LOW, MED or HI (corresponding to low, medium and high, respectively) by sequentially pressing button 214 on main control panel 72 from Percussion Menu #1 (corresponding to "Intensity:—ADJUST" on display 207).

Percussion Duration is the length of time Percussion Therapy will be provided. The care giver may select any multiple of five minutes up to 90 minutes by sequentially pressing button 215 on main control panel 72 from Percussion Menu #1 (corresponding to "Duration:—ADJUST" on display 207).

Percussion Frequency is the number of beats per second that Percussion Therapy will provide. The care giver may select any integer number from one to 19 beats per second by sequentially pressing button 216 on main control panel 72 from Percussion Menu #1 (corresponding to "Frequency:—ADJUST" on display 207).

Percussion Menu #2 allows the care giver to view and reset the Percussion Hour Meter and save the current Percussion Therapy settings. Percussion Menu #2 is entered by pressing button 217 on main control panel 72 from Percussion Menu #1 (corresponding to "NEXT MENU" on display 207).

The Percussion Hour Meter indicates the number of hours of Percussion Therapy a patient 81 has had. In the preferred embodiment, the Percussion Hour Meter may be reset or recalibrated to zero by pressing button 215 on main control panel 72 from Percussion Menu #2 (corresponding to "ZERO" on display 207). Upon initiation of the zero process, the preferred embodiment presents the care giver with an appropriate query on display 207 in order to ensure the care giver's intentions. The care giver confirms the action by pressing button 215 on main control panel 72 (corresponding to "YES" on display 207) or cancels the action by pressing button 217 on main control panel 72 (corresponding to "NO" on display 207). Upon confirmation of the intention to zero the Percussion Hour Meter, the display is set to "0.0" hours. In either case, display 207 returns to Percussion Menu #2.

Percussion Menu #1 may be returned to by pressing button 216 on main control panel 72 from Percussion Menu #2 (corresponding to "PRIOR MENU" on display 207). Percussion Therapy settings are saved by pressing button 217 on main control panel 72 from Percussion Menu #2 (corresponding to "ENTER" on display 207). Upon saving the current Percussion Therapy settings, display 207 returns to the Main Menu. In any case where the care giver goes for more than approximately one minute without effecting a change to either Percussion Menu #1 or Percussion Menu #2, display 207 will automatically return to the Home Display. In the preferred embodiment, all settings shown at the time of return will be automatically saved and will become the current Percussion Therapy settings.

The Warmer Menu is used to view and adjust the Current Status and Warmer settings. There are three settings for the warmer assembly 532 (see FIG. 29), providing comfort to patient 81 with varying degrees of warmth. The Warmer Menu is entered by pressing button 212 on main control panel 72 from the Main Menu (corresponding to "WARMER" on display 207). The Current Status display on the Warmer Menu indicates "ON" or "OFF" as the Warmer is activated or deactivated, respectively. Activation or deactivation of the Warmer may be toggled by pressing button 214 on main control panel 72 from the Warmer Menu (corresponding to "CHANGE" on display 207).

The Warmer Setting reflected on display 207 from the Warmer Menu indicates range of warmth in low, medium or high. The care giver may choose one of these respective ranges by sequentially pressing button 215 on main control panel 72 from the Warmer Menu (corresponding to "Warmer Setting:—ADJUST" on display 207) so as to highlight "LOW," "MED" or "HI" on display 207.

The Warmer Menu settings are saved by pressing button 217 on main control panel 72 from the Warmer Menu (corresponding to "ENTER" on display 207). Upon pressing button 217, display 207 returns to the Main Menu. In any case where the care giver goes for more than approximately one minute without effecting a change to the Warmer Menu, display 207 will automatically return to the Home Display. In the preferred embodiment, all settings shown at the time of return will be automatically saved and will become the current Warmer settings.

The preferred embodiment automatically sets the air pressures in each of the cushions including patient support sections 33*a*–33*c* according to the height and weight of patient 81. The Height/Weight Preset menu is used by the care giver to enter the patient's height and weight. Height values can be adjusted from 4-ft, 0-in to 6-ft, 6-in in one inch increments. Weight values can be adjusted from 50 pounds to 300 pounds in five pound increments. The Height/Weight Preset menu is entered from the Main Menu by pressing button 210 on main control panel 72 (corresponding to "HEIGHT/WEIGHT" on display 207). To increase the height value, the care giver sequentially presses button 213 on main control panel 72 from the Height/Weight Preset menu (corresponding to "Height:—INCREASE" on display 207). To decrease the height value, the care giver sequentially presses button 214 on main control panel 72 from the Height/Weight Preset menu (corresponding to "Height:—DECREASE" on display 207). To increase the weight value, the care giver sequentially presses button 215 on main control panel 72 from the Height/Weight Preset menu (corresponding to "Weight:—INCREASE" on display 207). To decrease the weight value, the care giver sequentially presses button 216 on main control panel 72 from the Height/Weight Preset menu (corresponding to "Weight—DECREASE" on display 207).

The Height/Weight Preset menu settings are saved by pressing button 217 on main control panel 72 from the Height/Weight Preset menu (corresponding to "ENTER" on display 207). Upon pressing button 217, display 207 returns to the Main Menu. In any case where the care giver goes for more than approximately one minute without effecting a change to the Height/Weight Preset menu, display 207 will automatically return to the Home Display. In the preferred embodiment, all settings shown at the time of return will be automatically saved and will become the current Height/Weight Preset settings.

Right Hold is used to turn the patient 81 to the selected Right Rotation Angle and hold the patient 81 at this angle. Right Hold is activated by pressing button 213 on main control panel 72 from the Main Menu (corresponding to "RIGHT HOLD" on display 207). Right Hold may also be activated by pressing "RT HOLD" button 176 on nurse control panel 57. Upon activation of Right Hold (and after the few moments required for the air pressures in the turning bladders to adjust), display 207 reflects the patient's position both graphically and numerically. Display 207 will change to reflect the changing position of patient 81. Nurse display 582 will reflect "Turn to Right & HOLD." Right Hold will cause Rotation Therapy to be deactivated, but will not affect Pulsation, Percussion or Warmer functions. Pressing button 217 on main control panel 72 during display of the patient 81 position (corresponding to "EXIT" on display 207) returns display 207 to the Home Display. Rotation is not automatically reactivated upon exit from the Right Hold function. If reactivation of Rotation Therapy is desired, the care giver must effect such desire from the Home Display or press the "ROTATION" button 179 on nurse control panel 57 (as show in FIG. 10).

Center Hold is used to turn the patient 81 at a level position. Center Hold is activated by pressing button 214 on main control panel 72 from the Main Menu (corresponding to "CENTER HOLD" on display 207). Center Hold may also be activated by pressing "HOLD" button 177 on nurse control panel 57. Upon activation of Center Hold (and after the few moments required for the air pressures in the turning bladders to adjust), display 207 reflects the patient's position both graphically and numerically. Display 207 will change to reflect the changing position of patient 81. Nurse display 582 will reflect "Turn to Center." Center Hold will cause Rotation Therapy to be deactivated, but will not affect Pulsation, Percussion or Warmer functions. Pressing button 217 on main control panel 72 during display of the patient 81 position (corresponding to "EXIT" on display 207) returns display 207 to the Home Display. Rotation is not automatically reactivated upon exit from the Center Hold function. If reactivation of Rotation Therapy is desired, the care giver must effect such desire from the Home Display or press the "ROTATION" button 179 on nurse control panel 57.

Left Hold is used to turn the patient 81 to the selected Left Rotation Angle and hold the patient 81 at this angle. Left Hold is activated by pressing button 215 on main control panel 72 from the Main Menu (corresponding to "LEFT HOLD" on display 207). Left Hold may also be activated by pressing "LT HOLD" button 178 on nurse control panel 57. Upon activation of Left Hold (and after the few moments required for the air pressures in the turning bladders to adjust), display 207 reflects the patient's position both graphically and numerically. Display 207 will change to reflect the changing position of patient 81. Nurse display 582 will reflect "Turn to Left & HOLD." Left Hold will cause Rotation Therapy to be deactivated, but will not affect Pulsation, Percussion or Warmer functions. Pressing button 217 on main control panel 72 during display of the patient 81 position (corresponding to "EXIT" on display 207) returns display 207 to the Home Display. Rotation is not automatically reactivated upon exit from the Left Hold function. If reactivation of Rotation Therapy is desired, the care giver must effect such desire from the Home Display or press the "ROTATION" button 179 on nurse control panel 57.

In the preferred embodiment, a Status Menu is provided where the care giver may view current settings for Rotation, Pulsation, Percussion and the Warmer. Rotation status includes state of activation, Right and Left Rotation Angle and Right and Left Pause Time. Pulsation status includes state of activation, Intensity and Cycle Time. Percussion status includes state of activation, Intensity and Frequency. Warmer status includes state of activation and Warmer Setting. The Status Menu is entered by pressing button 217 on main control panel 72 from the Home Display (corresponding to "STATUS" on display 207). To return to the Home Display, the care giver presses button 217 on main control panel 72 from the Status Menu (corresponding to "EXIT" on display 207). The Status Menu is for viewing only; the preferred embodiment returns automatically to the Home Display after approximately one minute.

The preferred embodiment is provided with Lock-Out Menus which allow the care giver to selectively disable air functions to prevent their activation ("Locked-Off"); to selectively allow air functions to be adjusted ("Unlock"); and to selectively freeze air function settings to prevent their adjustment ("Freeze"). Air Function Lock-Outs have varying affects on the functions of Rotation, Pulsation, Air-Adjust, Warmer and Percussion.

Pulsation and Air-Adjust (adjustment of which is detailed further herein) cannot be Locked-Off. Rotation, Warmer and Percussion are disabled when Locked-Off. In the preferred embodiment, an audible beep sounds when any function is initially Locked-Off. The Unlock status allows normal operation and adjustment of Rotation, Pulsation, Air-Adjust, Warmer and Percussion. In the Freeze mode, Rotation, Pulsation, Warmer and Percussion can each be activated or deactivated, but their respective settings cannot be adjusted. Triangular buttons 221–226 (detailed further herein) may not be used to adjust air pressure settings in the cushions including patient support sections 33*a*–33*c* while Air-Adjust is in the Freeze mode.

The Lock-Out Menus may be accessed within the first 10 seconds after bed 30 is plugged in by pressing button 213 on main control panel 72 (corresponding to "LOCK" on display 207). After approximately 10 seconds, display 207 reflects the normal Home Display and Lock-Out Menus are not accessible. Immediately upon entering the Lock-Out Menus, the care giver is presented with an appropriate query on display 207 inquiring if positioning packs 108–114 (see FIG. 5) are being used. The care giver responds affirmatively by pressing button 215 on main control panel 72 (corresponding to "YES" on display 207) or negatively by pressing button 217 on main control panel 72 (corresponding to "NO" on display 207). An affirmative response allows the patient 81 to receive greater than 20° of Rotation Therapy. If a negative response is entered, the patient 81 will receive no more than 20° of Rotation Therapy regardless of the selected Right and Left Rotation Angles. After the care giver has entered an appropriate response, Lock-Out Menu #1 is reflected on display 207.

From Lock-Out Menu #1, the care giver may select Lock-Out, Unlock or Freeze as appropriate for Rotation, Pulsation, Air-Adjust and Warmer. The care giver does so by sequentially pressing buttons 213, 214, 215 or 216 on main control panel 72 (corresponding to "Rotation:—CHANGE," "Pulsation:—CHANGE," "Air-Adjust:—CHANGE," and "Warmer:—CHANGE," respectively on display 207).

The care giver can access Lock-Out Menu #2 by pressing button 217 on main control panel 72 form Lock-Out Menu #1 (corresponding to "NEXT MENU" on display 207). The care giver may Lock-Out, Unlock or Freeze Percussion as desired by sequentially pressing button 213 on main control panel 72 from Lock-Out Menu #2 (corresponding to "Percussion:—CHANGE" on display 207).

The care giver can return to Lock-Out Menu #1 by pressing button 216 on main control panel 72 from Lock-Out Menu #2 (corresponding to "PRIOR MENU" on display 207). Lock-Out settings are saved by pressing button 217 on main control panel 72 from Lock-Out Menu #2 (corresponding to "ENTER" on display 207).

In the preferred embodiment, air pressures in each of the three patient support sections 33*a*–33*c* may be manually adjusted. Manual adjustment of these pressures overrides the automatic settings resultant from the Height/Weight Presets. Pressure may be increased in the cushions supporting the patient head section 33*a* by pressing triangular button 221 on main control panel 72. Pressure may be decreased in the cushions supporting the patient head section 33*a* by pressing triangular button 222 on main control panel 72. Pressure may be increased in the cushions supporting the patient buttocks section 33*b* by pressing triangular button 223 on main control panel 72. Pressure may be decreased in the cushions supporting the patient buttocks section 33*b* by pressing triangular button 224 on main control panel 72. Pressure may be increased in the cushions supporting the patient legs section 33*c* by pressing triangular button 225 on main control panel 72. Pressure may be decreased in the cushions supporting the patient legs section 33*c* by pressing triangular button 226 on main control panel 72. When ever any of triangular buttons 221–226 are pressed, display 207 presents the Bar Graph Display. The Bar Graph Display indicates the Height/Weight Presets, Manual settings and actual air pressures for cushions in patient support sections 33*a*–33*c*. Actual air pressures are indicated with two arrows for each section so as to allow accurate representation of the different pressures present under Pulsation Therapy. The care giver may return to the Home Display by pressing button 217 on main control panel 72 from the Bar Graph Display (corresponding to "EXIT" on display 207).

The preferred embodiment includes a sophisticated menu system to make use of scale data ascertained through communication with scale board 342 (shown in FIG. 25). Through the Scale Menu, the care giver may view the weight of patient 81; recalibrate the scale to zero; preset the scale to a known patient weight; activate or deactivate a patient Exit Alarm system; or postpone patient weighing for a specified length of time. The care giver may also store and view the date, time and weight value of the initial weight reading and the four most recent readings in a Weight Trend Chart.

The Scale Menu is viewed on display 207 by pressing SCALE button 220 on main control panel 72. Rotation, Pulsation and Percussion are automatically deactivated when the Scale Menu is displayed, as well as during all scale functions. In the preferred embodiment, Pulsation is automatically restored upon exit from the Scale Menu. Rotation and Percussion may be restored from the Home Display.

A Zero function is used to recalibrate the scale to zero pounds, prior to patient 81 placement but subsequent to placement of all linens and equipment on weighed portions of the bed 30. Zero is effected by pressing button 209 on main control panel 72 from the Scale Menu (corresponding to "ZERO" on display 207). Upon initiation of the zero process, the preferred embodiment presents the care giver with an appropriate query on display 207 in order to ensure the care giver's intentions. The care giver confirms the action by pressing button 215 on main control panel 72 (corresponding to "YES" on display 207) or cancels the action by pressing button 217 on main control panel 72 (corresponding to "NO" on display 207). Upon confirmation of the intention to zero the scale, a message instructs the care giver not to touch the bed 30 for ten seconds while the scale is recalibrated. In either case, display 207 eventually returns to the Scale Menu.

A Preset function is provided which allows the care giver to recalibrate the scale to the weight of patient 81 (without weighing), if the patient's weight should be known prior to placement on bed 30. The Preset function is initiated by pressing button 210 on main control panel 72 from the Scale Menu (corresponding to "PRESET" on display 207). Weight values are increased or decreased in increments of 0.1 Kg by sequentially pressing button 214 or 215, respectively, on main control panel 72 (corresponding to "Patient Weight:—INCREASE" and "Patient Weight:—DECREASE," respectively, on display 207).

The Preset function may be canceled by pressing button 216 on main control panel 72 (corresponding to "CANCEL" on display 207). To recalibrate the scale to the entered value, the care giver presses button 217 on main control panel 72 (corresponding to "ENTER" on display 207). A message then instructs the care giver not to touch the bed 30 for 10 seconds while the scale is recalibrated. In either case ("CANCEL" or "ENTER"), display 207 eventually returns to the Scale Menu.

The preferred embodiment includes an Exit Alarm, which when activated sounds an audible alarm if a 10% or more decrease in patient 81 weight is detected. The Exit Alarm is activated by pressing button 211 on main control panel 72 from the Scale Menu (corresponding to "ALARM" on display 207). In the preferred embodiment, the Exit Alarm cannot be activated for patient 81 weight values of less than 10 Kg. The Exit Alarm will be silenced if the patient 81 re-enters the bed 30 or by pressing ALARM button 219 on main control panel 72. The Exit Alarm may also be silenced by pressing "ALARM" button 183 on nurse control panel 57 (shown in FIG. 10). The Exit Alarm is deactivated by the Zero and Preset recalibration functions.

A Delay feature is provided which allows the care giver to postpone weighing of patient 81 from a specified amount of time while tubes, equipment and the like are lifted. The resultant weight is then held until read and recorded. Delay also allows the option of adding a weight to the Weight Trend Chart, detailed further herein. The Weigh Delay Menu is entered from the Scale Menu by pressing button 214 on main control panel 72 (corresponding to "DELAY" on display 207). Delay time can be adjusted from 5 to 30 seconds in 5 second intervals. To increase the Delay time, the care giver sequentially presses button 214 on main control panel 72 from the Weigh Delay Menu (corresponding to "Weigh Delay: —INCREASE" on display 207). To decrease the Delay time, the care giver sequentially presses button 215 on main control panel 72 from the Weigh Delay Menu (corresponding to "Weigh Delay:—DECREASE" on display 207). The Weigh Delay function may be canceled by pressing button 216 on main control panel 72 (corresponding to "CANCEL" on display 207). Canceling the function returns the care giver to the Home Display. To begin the Delay process, the care giver presses button 217 on main control panel 72 from the Weigh Delay Menu (corresponding to "START" on display 207). In the preferred embodiment, an audible tone sounds every second for the duration of the Delay period, said tone being louder during the last 5 seconds of Delay. Upon conclusion of the count down, display 207 presents the care giver with the option to enter the weight on the Weight Trend Chart. The option is accepted by pressing button 216 on main control panel 72 (corresponding to "ENTER" on display 207) or declined by pressing button 217 on main control panel 72 (corresponding to "EXIT" on display 207). Accepting the option effects the recording of the value and returns the care giver to the Scale Menu. Declining the option returns the care giver to the Home Display.

A Hold function is provided which retains the current weight value in memory while other weight, such as traction equipment, is added or removed. The added or removed weight will not be reflected in the weight reading. Hold is initiated by pressing button 215 on main control panel 72 from the Scale Menu (corresponding to "HOLD" on display 207). A message instructs the care giver not to touch the bed 30 for 10 seconds while the present weight is taken. After the weight is taken, a message is portrayed on display 207 indicating that Weight Holding is activated. The care giver may then add or remove weight as required. After weight has been added or removed, the care giver presses button 217 on main control panel 72 (corresponding to "CANCEL" on display 207). A message instructs the care giver not to touch the bed 30 for 10 seconds while the present weight is recalibrated to the previously ascertained value. If previously activated, the Exit Alarm, remains active during Weigh Delay.

A Weight Trend Chart is used to view the initial patient weight and the date of reading, as well as the date, time and weight value of the four most recent weight readings. The Weight Trend Chart, which is for viewing only, is entered by pressing button 216 on main control panel 72 from the Scale Menu (corresponding to "TREND" on display 207). The Home Display is returned to by pressing button 217 on main control panel 72 from the Weight Trend Chart (corresponding to "EXIT" on display 207).

The Scale may also be accessed for display of patient weight on nurse display 582 by pressing "SCALE" button 182 on nurse control panel 57. Rotation is deactivated during weighing and the care giver should press "ROTATION" button 179 on nurse control panel 157 to reactivate Rotation Therapy, if desired. (Refer to FIG. 10)

Referring to FIGS. 1, 10, 11 & 12, bed position control panel 73 is used to adjust the height and angle of the bed surface 33 and support frame 31. The bed position control panel 73 is located on the side of foot end rail 71 facing away from patient 81 just beneath main control panel 72. The head end patient support surface 33*a* may be raised or lowered by pressing button 197 or button 198, respectively, on bed position control panel 73. Button 185 and button 186 on nurse control panel 57 and button 193 and button 194 on patient control panel 56 operate exactly as button 197 and button 198 on bed position control panel 73, respectively. The head end of patient support surface 33*a* may be articulated from the horizontal position to a raised position of 90°. Rotation Therapy is deactivated at any time the head angle exceeds 35°. Light emitting diode display 199 on bed position control panel 73 indicates the current "head-up" angle. Safety switches 601–602 (shown in FIG. 29)under the side edges of patient head end support surface 33*a* automatically stop lowering of the head end if an obstruction is encountered.

Still referring to FIGS. 1, 10, 11, and 12) button 200 or button 201 on bed position control panel 73 may be pressed to raise or lower, respectively, the "knee gatch" of patient support surface 33*b* and 33*c*. Button 187 and button 188 on nurse control panel 57 and button 195 and button 196 on patient control panel 56 operate exactly as button 200 and button 201 on bed position control panel 73, respectively. The knee gatch may be articulated from 0° to 35°. Safety switches 603–604 (shown in FIG. 29)under the side edges of the patient support surface 33*b* automatically stop lowering of the knee gatch if an obstruction is encountered.

Patient support surface 33 may be raised or lowered to any height between 22½ and 35 inches. Adjustment is made by pressing button 202 on bed position control panel 73 to raise the surface 33. Surface 33 is lowered by pressing button 203 on bed position control panel 73. Button 189 and button 190 on nurse control panel 57 operate exactly as button 202 and button 203 on bed position control panel 73, respectively.

Button 204 on bed position control panel 73 is pressed to adjust patient support surface 33 to up to 12° Trendelenburg. Button 205 on bed position control panel 73 is pressed to adjust patient support surface 33 up to 12° reverse Trendelenburg. Button 191 and button 192 on nurse control panel 57 operate exactly as button 204 and button 205 on bed position control panel 73, respectively. Light emitting diode display 206 on bed position control panel 73 indicates the present degree of Trendelenburg therapy.

A cardiac chair position may automatically be obtained by pressing button 201*a* on bed position control panel 73. The bed 30 will automatically adjust to 60° head articulation, 35° knee gatch and 12° reverse Trendelenburg.

When the patient 81 is lying on one side, as may be necessary for bathing or other procedures, the patient is at a particular risk of bottoming. The preferred embodiment provides a Boost function in which all cushions under patient support surface receive increased pressure. Boost is activated and deactivated by pressing "BOOST" button 184 on nurse control panel 57. Nurse display 582 (shown in FIG. 29) indicates that Boost is activated. Pulsation, Percussion and Rotation are deactivated during Boost activation. Subsequent to deactivation of Boost, Pulsation and Percussion are automatically restored. Rotation may be restored as desired by pressing "ROTATION" button 179 on nurse control panel 57.

Upon power down of bed 30 by removing plug 506 from the wall outlet, the care giver is given the option of turning off battery back up. To accept this option, the care giver presses button 217 on main control panel 72. It should be noted that the bed 30 must be stored in a plugged in state to retain battery 502–503 charge.

Figure 30:
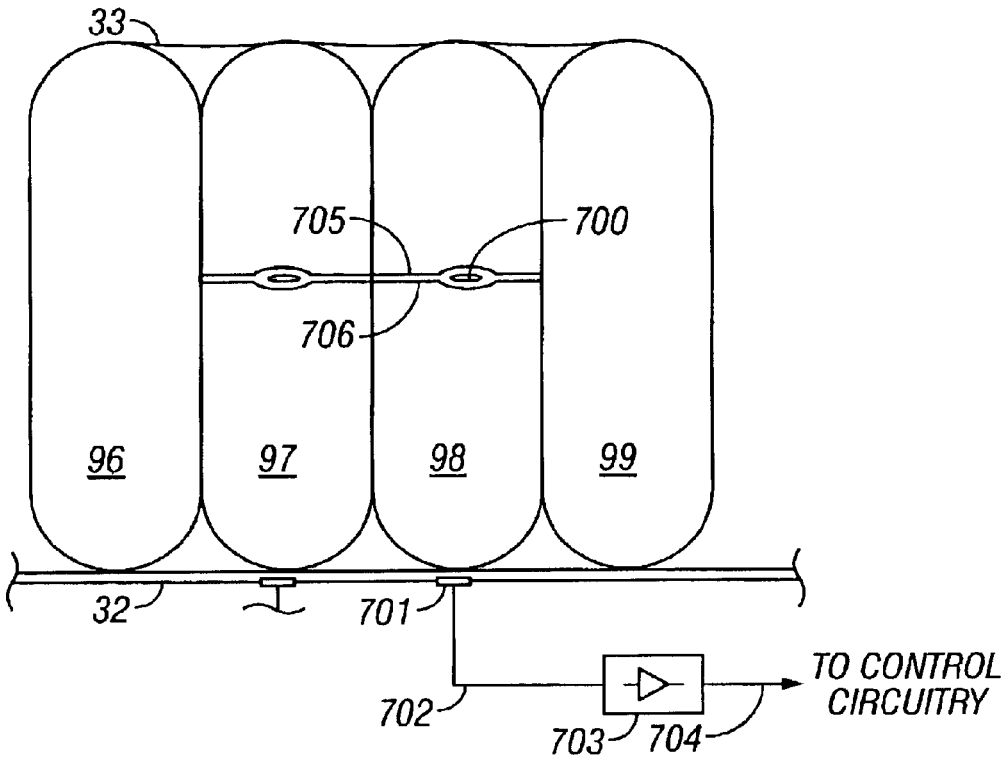
FIG. 30 shows a cross-sectional view of certain mattress cushions incorporating an alternate embodiment.

In an alternate embodiment, patient treatment bed 30 is provided with means for automatically adjusting air flow into the patient support bladders 83–106 (see FIG. 5) according to the relative position of the patient support surface 33 and the upper patient support sub-frame 32. Referring to FIG. 30, one such embodiment is shown.

As shown in FIG. 30, a plurality of Hall effect sensors 701 are removably attached to the upper patient support sub-frame 32. Permanent magnets 700 are centrally embedded within baffles formed on the interiors of bladders 83–106. A suitable baffle may be constructed of two pieces of Nylon cloth 705 and 706. The two pieces of cloth 705 and 706 may be heat sealed, sewn or joined in any other manner as is well known to those skilled in the manufacture of air mattresses.

An approximately inverse-squared relationship is known to exist between field strength of a permanent magnet and distance to a Hall effect sensor. The Hall effect sensors 701 detect the strength of the permanent magnets' 700 field and in turn convert field strength to a weak voltage. The weak voltage is conveyed by cable 702 to a local amplifier circuit 703. The amplified voltage is then conveyed by cable 704 to appropriate control circuitry such as that depicted in FIG. 25.

Choice of appropriate Hall effect sensors 701, permanent magnets 700 and amplifier circuits 703 varies widely with specific implementations. Hall effect sensors 701 measure magnetic flux density; results are affected by the shape, strength and number of poles of magnet 700. Outside magnetic sources will also affect results. Examples of Hall effect sensors 701 considered appropriate for the preferred embodiment include the GH-700 or GH-800 models commercially available from F.W. Bell in Orlando, Fla. The preferred embodiment uses common "refrigerator-type" permanent magnets 700 as are widely available. Aplifier circuit 703 may suitably comprise a TL074 Quad Operational Amplifer based circuit or its equivalent. Such an amplifier circuit is readily within the means of those skilled in electrical designs.

The preferred usage of such an automated distance sensing system is as follows. Upon power up of bed 30, but prior to activation of air functions and inflation of bladders 83–106, the voltage output of all Hall effect sensors 701 is measured. Preferably, the INSTAFLATE function (decribed hereinabove) is then activated to fully inflate bladders 83–106. The voltage output of all Hall effect sensors 701 is then again measured. The values thus obtained are utilized by appropriate mathematical algorithms to then interpolate distance between surface 33 and sub-frame 32 relative the maximum distance. Such distance may then be utilized to automatically control the provision of sufficient air flow into bladders 83–106 in order to maintain a user-determined or preset percentage inflation of bladders 83–106. In this manner, bottoming of patient 81 is automatically prevented.

As will be evident to those of ordinary skill in the art, similar distance sensing aspects may be incorporated into other mattress systems. Other means of sensing the degree of inflation may also be substituted while still appreciating certain aspects of the invention.

For instance, an alternate embodiment comprising an electrical loop may be constructed as follows. Baffle sheet 706 is constructed of an electrically conductive material. The interior portion of bladder 98 proximate sub-frame 32 would also comprise an electrically conductive material. These two conductive elements are connected to appropriate electrical detection circuitry (not shown). As bladder 98 deflates, baffle sheet 706 loops down and into contact with the conductive portion of bladder 98, closing an electrical loop. The circuitry, having detected closure of the electrical loop, may then automatically effect increased air flow into bladder 98.

While the description given herein reflects the best mode known to the inventor, those who are reasonably skilled in the art of the design and manufacture of therapeutic patient treatment beds will quickly recognize that there are endlessly many alternate embodiments of the teachings herein. Recognizing that those of reasonable skill in the art will easily see such alternate embodiments, they have in most cases not been described herein in order to preserve clarity.

We claim:

1. A medical bed comprising:

a mattress having a head section, a foot section and a longitudinal axis;

a first inflatable enclosure for laterally rotating said head section such that said head section rotates in a first direction relative to said foot section, said first inflatable enclosure comprising an inflatable bladder for lifting one side of said head section relative to the opposite side of said head section;

a second inflatable enclosure for laterally rotating said foot section such tat said foot section rotates in a second direction relative to said head section, wherein said second direction opposes said first direction, said second inflatable enclosure comprising an inflatable bladder for lifting one side of said foot section relative to the opposite side of said foot section; and said first and second inflatable enclosures being operable in two modes, the first of said modes comprising providing substantially no support to the mattress and the second of said modes comprising providing support to said mattress while imparting a rotating force to said mattress.

2. A medical bed comprising:

a mattress having a head section, a foot section and a longitudinal axis, said mattress comprising a plurality of inflatable air cells for supporting a patient;

a first inflatable enclosure for laterally rotating said head section such that said head section rotates in a first direction relative to said foot section, said first inflatable enclosure comprising a first elongate inflatable bladder for lifting one side of said head section relative to the opposite side of said head section, said first elongate inflatable bladder being oriented substantially parallel to the longitudinal axis of said mattress and positioned beneath said plurality of inflatable air cells;

a second inflatable enclosure for laterally rotating said foot section such that said foot section rotates in a second direction relative to said head section wherein said second direction opposes said first direction, said second inflatable enclosure comprising a second elongate inflatable bladder for lifting one side of said foot section relative to the opposite side of said foot section, said elongate bladder being oriented substantially parallel to the longitudinal axis of said mattress and being positioned beneath said plurality of inflatable air cells.

3. The medical bed of claim 2, further comprising a support system for positioning the patient relative to said mattress.

4. A medical bed comprising:

a mattress having a head section, a foot section and a longitudinal axis;

a first inflatable enclosure for laterally rotating said head section such that said head section rotates in a first direction relative to said foot section;

a second inflatable enclosure for laterally rotating said foot section such that said foot section rotates in a second direction relative to said head section, wherein said second direction opposes said first direction;

said first and second inflatable enclosures being operable in two modes, the first of said modes comprising providing substantially no support to the mattress and the second of said modes comprising providing support to said mattress while imparting a rotating force to said mattress; and an articulated critical care frame for supporting the mattress and facilitating care of a patient thereon.

5. A medical bed, comprising:

a mattress having a head section, a foot section, and a longitudinal axis;

a first inflatable enclosure for laterally rotating said head section, such that said head section rotates in a first direction relative to said foot section;

a second inflatable enclosure for laterally rotating said foot section, such that said foot section rotates in a second direction relative to said head section wherein said section direction opposes said first direction; and a radiolucent hinge secured between said articulated frame and said mattress and having a pivotal axis parallel to the longitudinal axis of the bed, said hinge being adapted to promote rotation of said head section about said pivotal axis in response to actuation of said first inflatable enclosure.

6. The medical bed of claim 5, wherein said radiolucent hinge comprises a plurality of interdigitated fabric straps secured at their opposite ends between said mattress and said articulated critical care frame.

7. A medical bed comprising:

a low air loss mattress having a head section and a foot section;

one or more inflatable head rotation bladders for rotating the head section upon inflation, such that the head section rotates relative to the foot section of said mattress;

one or more inflatable foot rotation bladders for rotating the foot section upon inflation, such that said foot rotation bladder is operated independently of said head rotation bladder; and a controlled air supply for selectively inflating each of said bladders to achieve such rotation of said head and foot sections.

8. The medical bed of claim 7, further comprising a switch for controlling the direction of rotation of said foot section.

9. The medical bed of claim 8, wherein said switch comprises a setting allowing said foot section to rotate in a direction opposite the direction of said head section.

10. The medical bed of claim 8, wherein said switch comprises a setting inhibiting rotation of said foot section during rotation of said head section.

11. A critical care system, comprising:

a plurality of transversely-oriented inflatable therapeutic cushions, each having an upper surface and a lower surface;

a source of pressurized gas in fluid communication with said inflatable therapeutic cushions;

one or more magnetic field strength sensors responsive to changes in distance between the upper surface and lower surface of at least one of said inflatable therapeutic cushions; and a controller operable for regulation of said source of pressurized gas in counter response to the distance detected by said magnetic field strength sensor.

12. The critical care system of claim 11, wherein said sensor comprises:

a magnet embedded within a baffle provided interior said inflatable therapeutic cushion; and a Hall effect device.

13. The critical care system of claim 11, wherein said inflatable therapeutic cushions are adapted for use in a low air loss therapeutic bed system.

14. A critical care system, comprising:

a plurality of transversely-oriented inflatable therapeutic cushions, each having an upper surface and a lower surface;

a source of pressurized gas in fluid communication with said inflatable therapeutic cushions;

an electrically conductive baffle sheet positioned interior at least one said inflatable therapeutic cushion;

electrically conductive material proximate the interior, lower surface of at least one said inflatable therapeutic cushion;

electrical detection means responsive to contact between said electrically conductive baffle sheet and said electrically conductive material proximate the lower surface; and a controller operable for regulation of said source of pressurized gas in counter response to detection of contact between said electrically conductive baffle sheet and said electrically conductive material proximate the lower surface.

15. A medical bed comprising:

a mattress having a head section, a foot section and a longitudinal axis;

a first inflatable enclosure for laterally rotating said head section such that said head section rotates in a first direction relative to said foot section;

a second inflatable enclosure for laterally rotating said foot section such that said foot section rotates in a second direction relative to said head section, wherein said second direction opposes said first direction;

said first and second inflatable enclosures being operable in two modes, the first of said modes comprising providing substantially no support to the mattress and the second of said modes comprising providing support to said mattress while imparting a rotating force to said mattress; and a pneumatic switch for selectively actuating said second inflatable enclosure for laterally rotating said foot section.

16. The medical bed of claim 15, wherein said switch allows reversal of said second direction such that said foot section rotates in a direction substantially the same as the direction of rotation of said head section.

17. A therapeutic mattress assembly, comprising:

a mattress having a head section, a foot section and a longitudinal axis;

a first inflatable enclosure, substantially adjacent said head section, for laterally rotating said head section such that said head section rotates in a first direction relative to said foot section;

a second inflatable enclosure, substantially adjacent said head section, for laterally rotating said head section such that said head section rotates in a first direction relative to said foot section;

a second inflatable enclosure, substantially adjacent said head section, for laterally rotating said head section such that said head section rotates in a second direction relative to said foot section;

a support system for positioning a patient relative to said mattress;

an air supply; and an air distribution system positioned in fluid communication between said air supply and each said inflatable enclosure for controlling the inflation of each said inflatable enclosure.

18. The therapeutic mattress assembly of claim 17, further comprising a radiolucent hinge associated with said mattress, said hinge being adapted to promote rotation of said head section.

19. A medical bed, comprising:

a mattress having a longitudinal axis;

a first inflatable enclosure for laterally rotating said mattress such that said mattress rotates in a first direction approximately about said longitudinal axis;

a second inflatable enclosure for laterally rotating said mattress such that said mattress rotates in a second direction approximately about said longitudinal axis, wherein said second direction opposes said first direction;

a first restraint detachably affixed adjacent a first side of said mattress generally opposite said second inflatable enclosure;

a second restraint detachably affixed adjacent a second side of said mattress generally opposite said first inflatable enclosure; and a controller for controlling inflation of said first and second inflatable enclosures, sad controller being adapted to restrict inflation of said first and second enclosures in the absence of one of said first and second restraints.

20. The medical bed as recited in claim 19, wherein said controller is further adapted, in the absence of one of said first and second restraints, to limit inflation of said first and second inflatable enclosures such that said mattress rotates a maximum of approximately 200 about said longitudinal axis.

21. The medical bed as recited in claim 19, wherein said first and second restraints comprise inflatable bladders.

22. The medical bed as recited in claim 21, wherein said controller is father adapted to control inflation of said first and second restraints.

23. A medical bed, comprising:

a mattress having a longitudinal axis, said mattress comprising a plurality of transversely oriented air sacs in a chest region of said mattress;

a first inflatable enclosure for laterally rotating said mattress such that said mattress rotates in a first direction approximately about said longitudinal axis;

a second inflatable enclosure for laterally rotating said mattress such that said mattress rotates in a second direction approximately about said longitudinal axis, wherein said second direction opposes said first direction; and a third inflatable enclosure positioned substantially beneath said air sacs for selectively imparting a percussive force upward and through said air sacs during rotation of said mattress.

24. The medical bed as recited in claim 23, further comprising a controller for controlling inflation of said first, second and third inflatable enclosures.

25. The medical bed as recited in claim 24, wherein said controller is adapted to substantially maintain said mattress in a rotated position while said third enclosure imparts the percussive force upward and through said air sacs.

26. A medical bed, comprising:

a mattress having a longitudinal axis;

a first inflatable enclosure for laterally rotating said matte such that said mattress rotates in a first direction approximately about said longitudinal axis;

a second inflatable enclosure for laterally rotating said mattress such that said mattress rotates in a second direction approximately about said longitudinal axis, wherein said second direction opposes said first direction;

a controller for controlling inflation of sad first and second inflatable enclosures, said controller being adapted to:

alternately inflate said first and second inflatable enclosures; and automatically increase the degree of inflation of said first and second inflatable enclosures after a selectable number of alternate inflations thereof.

27. The medical bed as recited in claim 26, wherein said controller is further adapted to automatically increase the degree of inflation of said first and second inflatable enclosures such that said mattress rotates from side to side approximately 25° for six cycles whereafter the degree of inflation is automatically increased such that said mattress rotates an additional 10° to each side thereof.

* * * * *

UNITED STATES PATENT AND TRADEMARK OFFICE

CERTIFICATE OF CORRECTION

PATENT NO. : 6,892,405 B1
APPLICATION NO. : 08/672442
DATED : May 17, 2005
INVENTOR(S) : Dan Dimitriu and Alan L. Bartlett It is certified that error appears in the above-identified patent and that said Letters Patent is hereby corrected as shown below:

Column 36, line 18 replace “tat” with --that--
Column 39, line 37 replace “200” with --20°--
Column 39, line 32 replace “father” with --further--
Column 40, line 23 replace “matte” with --mattress--
Column 40, line 31 replace “sad” with --said--

Signed and Sealed this

Seventeenth Day of April, 2007

JON W. DUDAS
*Director of the United States Patent and Trademark Office*